US007018293B2

(12) United States Patent
Brown et al.

(10) Patent No.: US 7,018,293 B2
(45) Date of Patent: Mar. 28, 2006

(54) GAME AND GAMING MACHINE WITH OPERATIVE THEME HAVING ELEMENT LINKING LOGIC ORGANIZATION

(75) Inventors: Duncan F. Brown, Grayslake, IL (US); Alfred Thomas, Las Vegas, NV (US); Scott D. Slomiany, Streamwood, IL (US); Lawrence E. DeMar, Winnetka, IL (US); Benjamin T. Gomez, Chicago, IL (US)

(73) Assignee: Case Venture Management, LLC, Northbrook, IL (US)

( * ) Notice: Subject to any disclaimer, the term of this patent is extended or adjusted under 35 U.S.C. 154(b) by 0 days.

(21) Appl. No.: 09/967,505

(22) Filed: Sep. 28, 2001

(65) Prior Publication Data

US 2003/0100356 A1 May 29, 2003

(51) Int. Cl.
*A63F 9/24* (2006.01)

(52) U.S. Cl. ..... 463/20; 463/25

(58) Field of Classification Search ..... 463/16–22, 463/12–13; 273/138.1, 138.2, 139, 143 R
See application file for complete search history.

(56) References Cited

U.S. PATENT DOCUMENTS

| | | | | |
|---|---|---|---|---|
| 4,114,890 | A | 9/1978 | Yamamoto et al. | 273/237 |
| 4,171,814 | A | 10/1979 | Tamano | 273/243 |
| 5,647,798 | A | 7/1997 | Falciglia | 463/19 |
| 5,697,843 | A * | 12/1997 | Manship et al. | 463/20 |
| 5,848,932 | A | 12/1998 | Adams | 463/20 |
| 5,927,714 | A * | 7/1999 | Kaplan | 273/143 R |
| 6,159,097 | A * | 12/2000 | Gura | 463/20 |
| 6,173,955 | B1 * | 1/2001 | Perrie et al. | 273/146 |
| 6,174,235 | B1 | 1/2001 | Walker et al. | 463/25 |
| 6,190,255 | B1 | 2/2001 | Thomas et al. | 463/20 |
| 6,315,660 | B1 | 11/2001 | DeMar et al. | 463/16 |
| 2002/0107066 | A1 * | 8/2002 | Seelig et al. | 463/20 |

FOREIGN PATENT DOCUMENTS

| | | |
|---|---|---|
| EP | 874 337 A1 | 10/1998 |
| EP | 926 645 A2 | 6/1999 |
| EP | 945 837 A2 | 9/1999 |
| EP | 984 407 A2 | 3/2000 |
| EP | 984 408 A2 | 3/2000 |

(Continued)

OTHER PUBLICATIONS

Monopoly Blackjack Edition Game, described in Mikohn brochure, 2000.

(Continued)

*Primary Examiner*—Mark Sager
(74) *Attorney, Agent, or Firm*—Baniak Pine & Gannon

(57) ABSTRACT

An apparatus and method for playing a game has in one aspect a plurality of game elements of at least two types, such as game pieces which have two different sides, and are arranged in a matrix of rows and columns, for instance. A player may select a number of arrangements of matching game elements (e.g., lines of contiguous matching game-piece sides) to wager upon in the chance outcome arrangement in play. Aggregation of the number of winning arrangements determines the outcome, most preferably with an increasing non-linear payout in view of that aggregate number. The invention also discloses a related bonus game, which in a preferred embodiment is based upon an Othello®-type game particularly for a gaming machine using outflanking game pieces, such that any game pieces with opponent's side or color showing are converted to game pieces with player's side or color, with an award or payoff according to the level of successful advancement in the game.

40 Claims, 34 Drawing Sheets

FOREIGN PATENT DOCUMENTS

EP 989 531 A2 3/2000

OTHER PUBLICATIONS

Monopoly Blackjack Edition Game, website article: http://www.mikohn.com/products/tables_games/Monopoly_Blackjack.com, Dec 14, 2001.

Monopoly Poker Edition Game, website article: http://www.mikohn.com/products/table_games/Monopoly/Poker-.com, Dec. 14, 2001.

How To Play Scrabble website: http://www.wmsgaming-.com/products/video/scr/howto.html, Jan. 18, 2002.

* cited by examiner

Lines won

| | 1 | 2 | 3 | 4 | 5 | 6 | 7 | 8 | 9 | 10 | 11 | 12 | 13 | 14+ |
|---|---|---|---|---|---|---|---|---|---|---|---|---|---|---|
| 1 | 11 | --- | --- | --- | --- | --- | --- | --- | --- | --- | --- | --- | --- | --- |
| 2 | 9 | 100 | --- | --- | --- | --- | --- | --- | --- | --- | --- | --- | --- | --- |
| 3 | 8 | 75 | 200 | --- | --- | --- | --- | --- | --- | --- | --- | --- | --- | --- |
| 4 | 7 | 61 | 250 | 500 | --- | --- | --- | --- | --- | --- | --- | --- | --- | --- |
| 5 | 8 | 26 | 250 | 350 | 750 | --- | --- | --- | --- | --- | --- | --- | --- | --- |
| 6 | 7 | 23 | 200 | 275 | 500 | 1000 | --- | --- | --- | --- | --- | --- | --- | --- |
| 7 | 8 | 22 | 80 | 350 | 550 | 1000 | 1500 | --- | --- | --- | --- | --- | --- | --- |
| 8 | 8 | 19 | 65 | 275 | 375 | 600 | 800 | 2000 | --- | --- | --- | --- | --- | --- |
| 9 | 8 | 17 | 55 | 225 | 360 | 600 | 750 | 1500 | 2500 | --- | --- | --- | --- | --- |
| 10 | 8 | 17 | 45 | 185 | 500 | 600 | 750 | 1500 | 3000 | 3000 | --- | --- | --- | --- |
| 11 | 8 | 16 | 30 | 185 | 550 | 600 | 750 | 1000 | 2000 | 3500 | 3500 | --- | --- | --- |
| 12 | 8 | 15 | 26 | 155 | 475 | 750 | 950 | 1200 | 2000 | 4000 | 4000 | 4000 | --- | --- |
| 13 | 8 | 14 | 26 | 115 | 435 | 750 | 900 | 1500 | 2500 | 4500 | 4500 | 4500 | 4500 | --- |
| 14 | 8 | 14 | 26 | 105 | 300 | 750 | 900 | 1500 | 2500 | 4000 | 5000 | 5000 | 5000 | 5000 |
| 15 | 8 | 14 | 26 | 90 | 265 | 650 | 775 | 1000 | 2000 | 4000 | 6000 | 6000 | 6000 | 6000 |
| 16 | 9 | 14 | 25 | 75 | 180 | 530 | 750 | 875 | 1000 | 2000 | 3500 | 5000 | 7500 | 7500 |
| 17 | 9 | 14 | 25 | 50 | 180 | 530 | 685 | 750 | 900 | 1500 | 2500 | 5000 | 10000 | 10000 |
| 18 | 9 | 14 | 25 | 45 | 170 | 500 | 625 | 750 | 900 | 1500 | 5000 | 10000 | 15000 | 25000 |

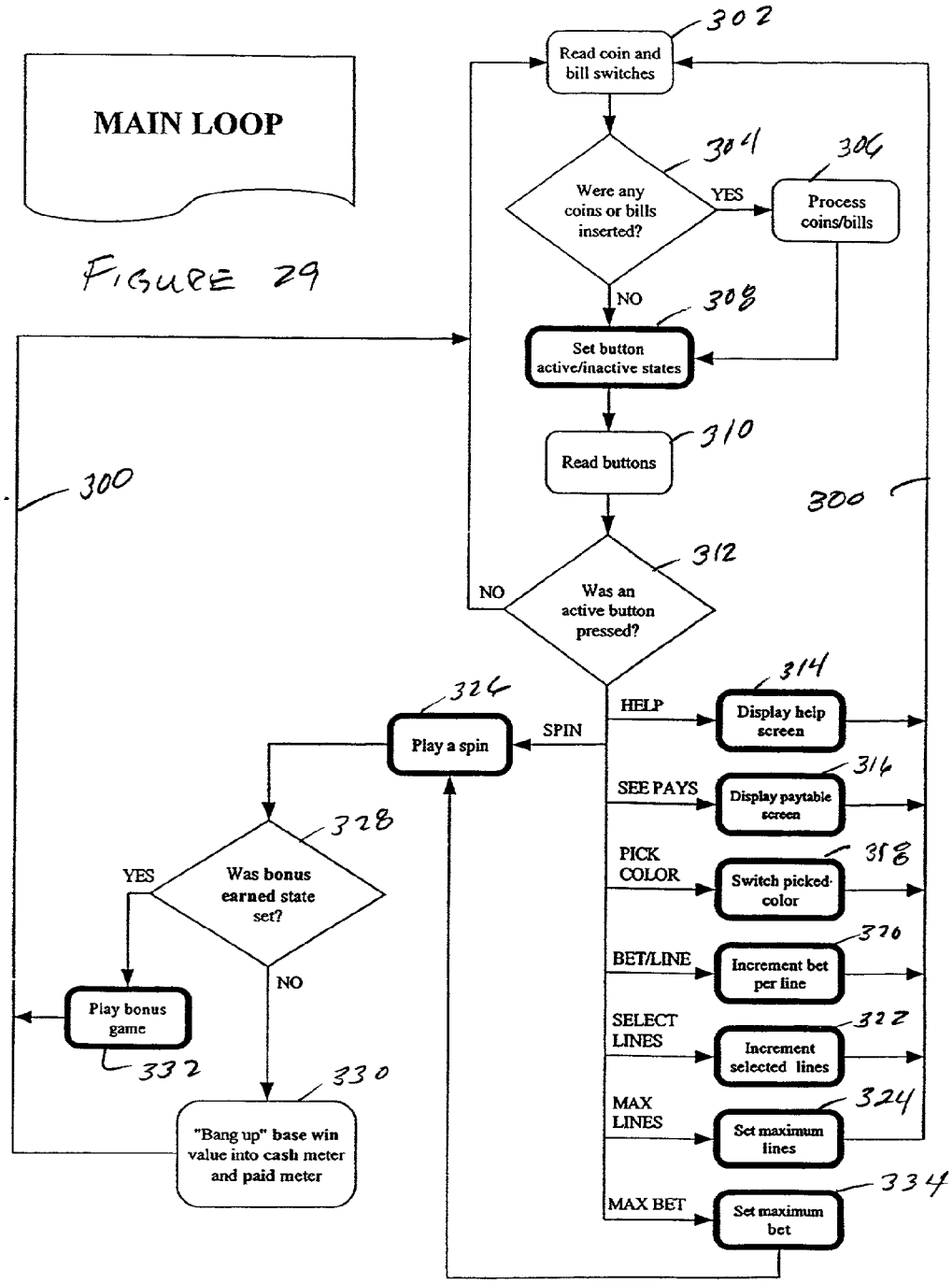
MAIN LOOP
FIGURE 29
Read coin and bill switches
302
Were any coins or bills inserted?
304
YES
Process coins/bills
306
NO
Set button active/inactive states
308
Read buttons
310
300
300
Was an active button pressed?
312
NO
HELP
Display help screen
314
SPIN
Play a spin
324
SEE PAYS
Display paytable screen
316
PICK COLOR
Switch picked color
318
BET/LINE
Increment bet per line
320
SELECT LINES
Increment selected lines
322
MAX LINES
Set maximum lines
324
MAX BET
Set maximum bet
334
Was bonus earned state set?
328
YES
NO
Play bonus game
332
"Bang up" base win value into cash meter and paid meter
330

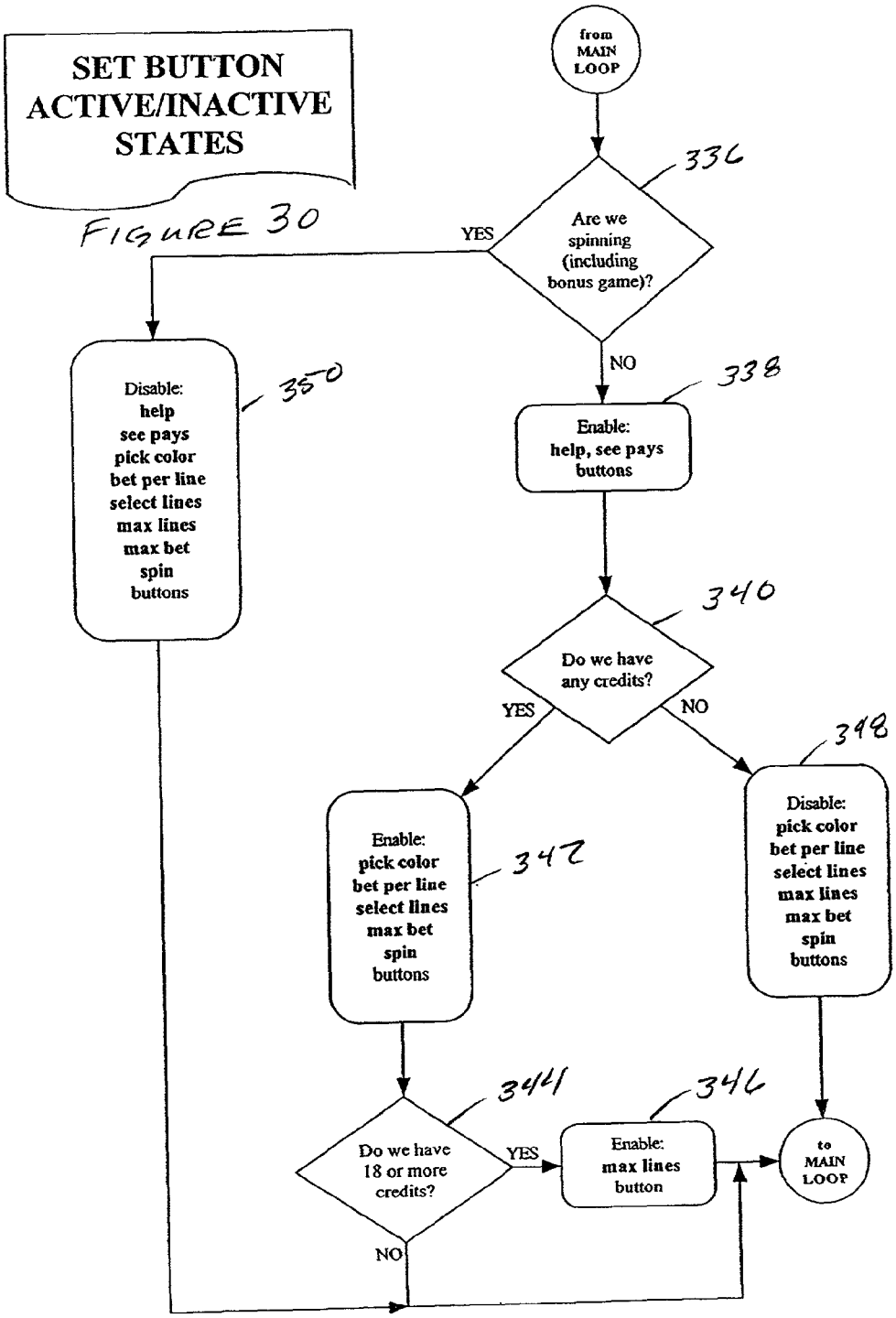
SET BUTTON ACTIVE/INACTIVE STATES
FIGURE 30
from MAIN LOOP
336
Are we spinning (including bonus game)?
YES
NO
350
Disable: help see pays pick color bet per line select lines max lines max bet spin buttons
338
Enable: help, see pays buttons
340
Do we have any credits?
YES
NO
348
Disable: pick color bet per line select lines max lines max bet spin buttons
342
Enable: pick color bet per line select lines max bet spin buttons
344
Do we have 18 or more credits?
YES
NO
346
Enable: max lines button
to MAIN LOOP

DISPLAY HELP SCREEN

INCREMENT BET PER LINE from MAIN LOOP
376
Add one to coins per line
378
Is selected lines times coins per line greater than the value in the cash meter?
YES
NO
380
Set coins per line to 1
384
Is coins per line greater than 5?
YES
NO
382
Update display meter to show new coins per line value
386
Update display to show all the paylines represented by selected lines value
to MAIN LOOP

INCREMENT SELECTED LINES from MAIN LOOP
388
Add one to selected lines
390
Is selected lines times coins per line greater than the value in the cash meter?
YES
NO
392
Set selected lines to 1
396
Is selected lines greater than 18?
YES
NO
394
Update display meter to show new selected lines value
398
Update display to show all the paylines represented by selected lines value
to MAIN LOOP

PLAY A SPIN

PROCESS CURSOR RESULT from PLAY BONUS GAME
482
Is cursor location a square with "Collect"?
YES
NO
Set bonus game over
492
484
Place a player-color piece at cursor location
486
Draw bonus lines
488
Flip bonus pieces
490
Place bonus Collects
to PLAY BONUS GAME

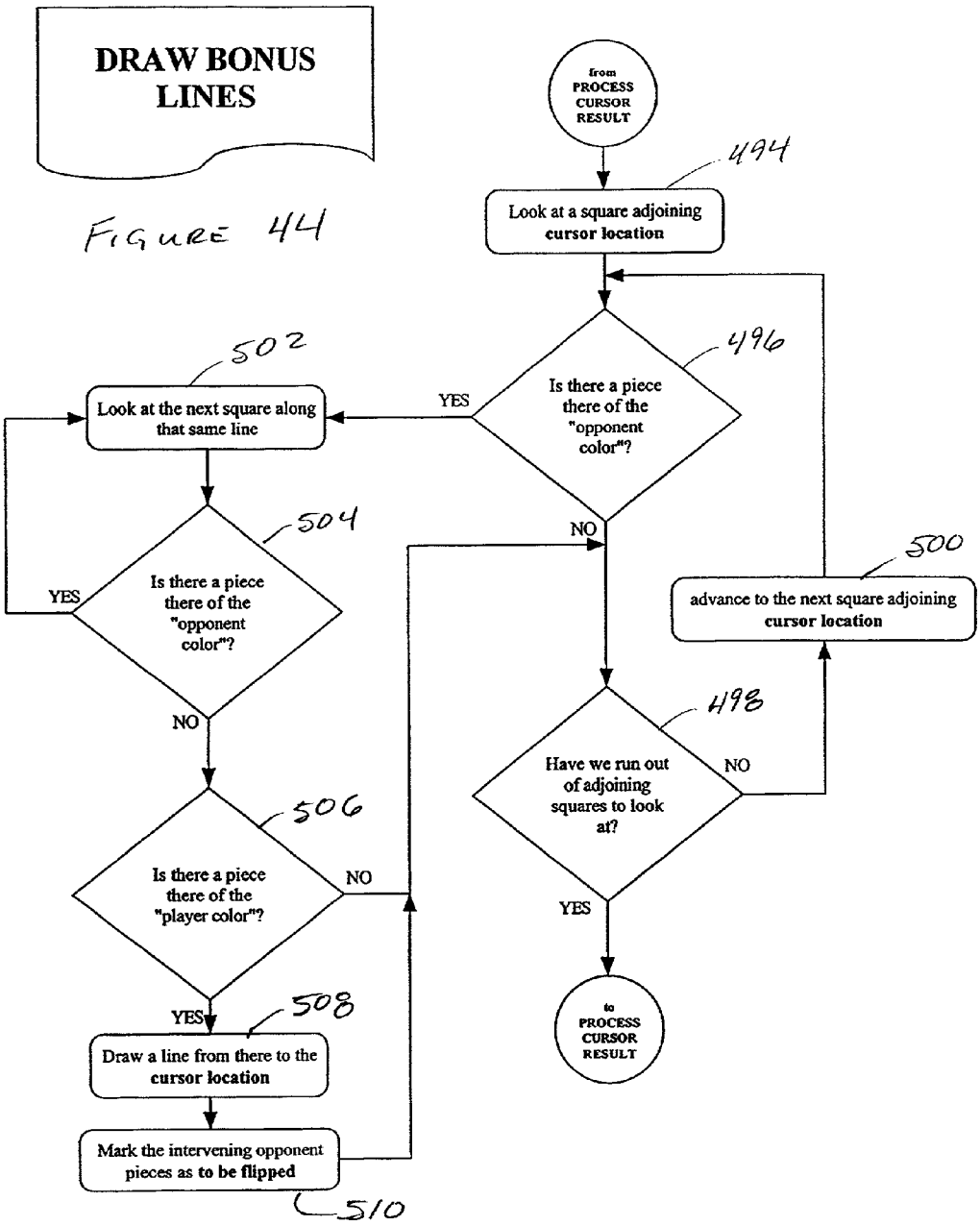
DRAW BONUS LINES
FIGURE 44
from PROCESS CURSOR RESULT
494
Look at a square adjoining cursor location
496
Is there a piece there of the "opponent color"?
YES
NO
502
Look at the next square along that same line
504
Is there a piece there of the "opponent color"?
YES
NO
506
Is there a piece there of the "player color"?
NO
YES
508
Draw a line from there to the cursor location
Mark the intervening opponent pieces as to be flipped
510
500
advance to the next square adjoining cursor location
498
Have we run out of adjoining squares to look at?
NO
YES
to PROCESS CURSOR RESULT

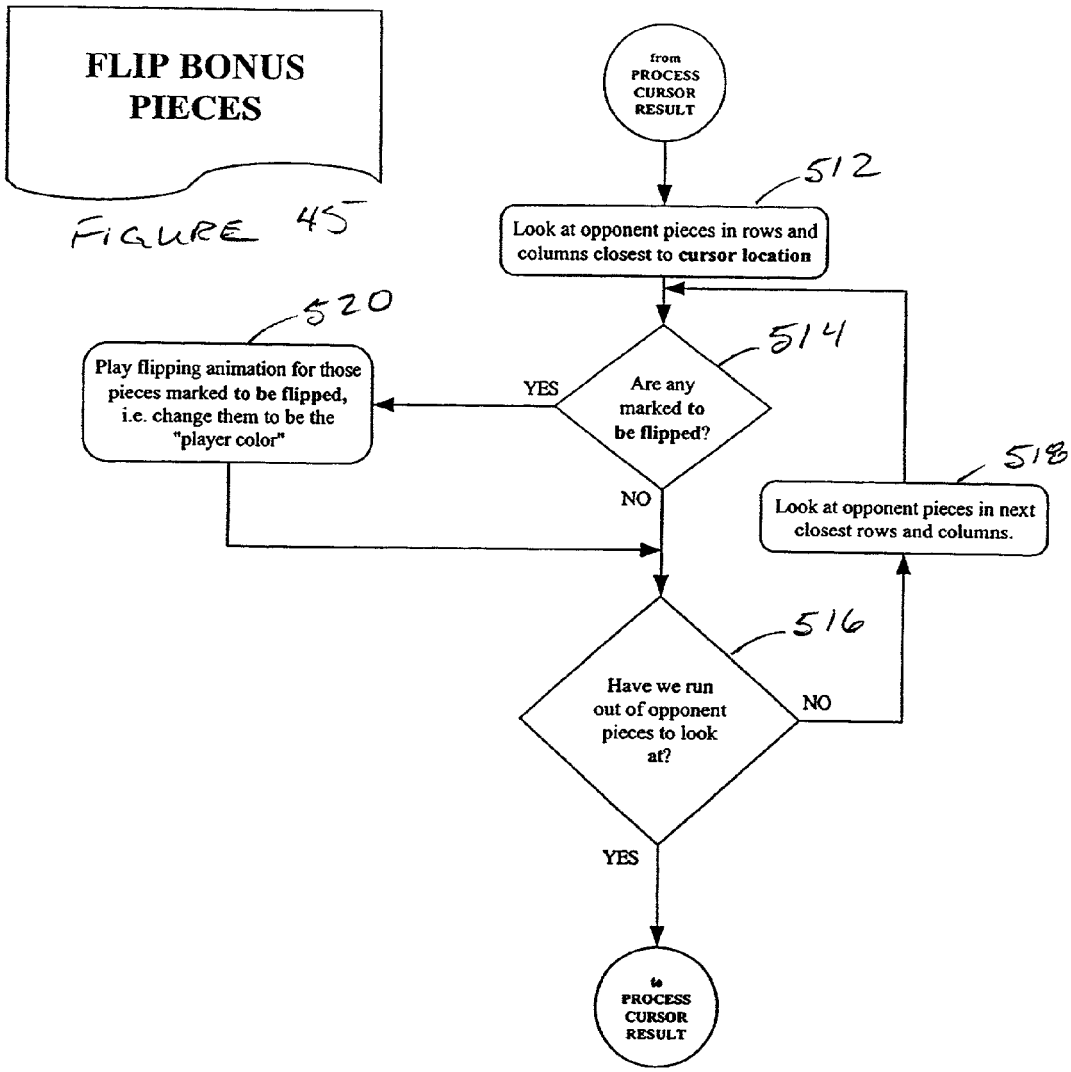
FLIP BONUS PIECES
FIGURE 45
from PROCESS CURSOR RESULT
512
Look at opponent pieces in rows and columns closest to cursor location
514
Are any marked to be flipped?
YES
NO
520
Play flipping animation for those pieces marked to be flipped, i.e. change them to be the "player color"
518
Look at opponent pieces in next closest rows and columns.
516
Have we run out of opponent pieces to look at?
NO
YES
to PROCESS CURSOR RESULT

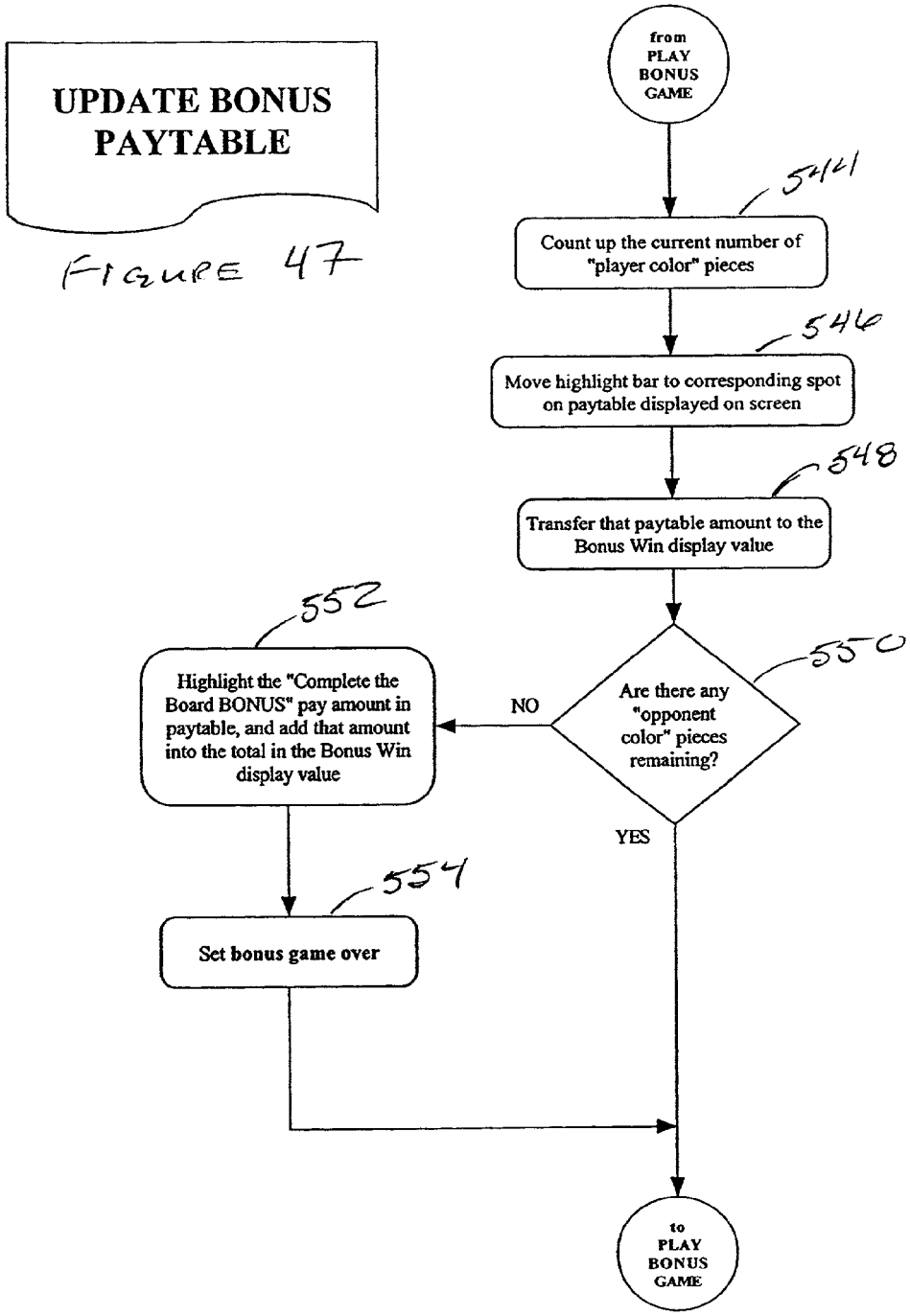
UPDATE BONUS PAYTABLE
FIGURE 47
from PLAY BONUS GAME
544
Count up the current number of "player color" pieces
546
Move highlight bar to corresponding spot on paytable displayed on screen
548
Transfer that paytable amount to the Bonus Win display value
550
Are there any "opponent color" pieces remaining?
NO
YES
552
Highlight the "Complete the Board BONUS" pay amount in paytable, and add that amount into the total in the Bonus Win display value
554
Set bonus game over
to PLAY BONUS GAME

GAME AND GAMING MACHINE WITH OPERATIVE THEME HAVING ELEMENT LINKING LOGIC ORGANIZATION

FIELD OF THE INVENTION

This invention generally relates to games of chance, such as for pure amusement as on devices such as a home (personal) computer or a home game console, hand held game players (either dedicated or generic, such as Game Boy®[1]), coin-operated amusement devices, as well as for live games and gaming machines in a wagering environment, as in a casino or Internet setting format. More specifically, one aspect of the invention is directed to a game of chance using elements in a matrix of rows and columns, the element being of at least two types, such as game pieces with two different sides, where certain predetermined spatial arrangements of matching types result in winning combinations; and even more particularly, another aspect of the invention is such a game having a payout which increases non-linearly with the aggregate number of winning arrangements. Yet another aspect of the invention is directed towards a game of chance for a gaming machine having one or more player pieces, and one or more opponent pieces, wherein the object of the game is to outflank opponent pieces with player pieces along a line such that outflanked opponent pieces are converted to player pieces, with a randomized movement of player pieces and a paytable having a payout which increases with ongoing relative success in the play of the game to a maximum number of possible moves.

[1] Game Boy is a registered trademark of Nintendo of America Inc.

BACKGROUND OF THE INVENTION

The present invention has its genesis in the video gaming machine environment. While it will be particularly discussed with respect to embodiments in that arena, it will be understood that this is but one application of the invention, and the invention has much broader scope.

So said, traditional slot machines have a plurality of rotating mechanical drums, which "rotate" (either through actual movement of reels or video illustrations of moving reels) and then stop to show symbols, which are typically on one or more paylines across the reels. Players wager coins or credits on one or more of these paylines and are paid for certain combinations of symbols on a payline for which a wager has been placed. In certain slot machines, there may be combinations of symbols that pay the player that are not necessarily confined to strict paylines, such as so-called scatter pays which may be awarded when certain symbols appear in any visible position on certain reels. Video slot machines often add in a bonus game that occurs when a game results in a particular symbol combination or some other triggering event.

In a typical multi-line slot machine, each line that is wagered upon uses the same or a similar pay schedule. Multiple chances for the symbols to land in a paying combination are provided. However each payline played is treated in essence as its own independently played game.

Keno is another well-known wagering game. In a typical Keno game a player selects between one and fifteen numbers in the range of one to eighty. The game is played by randomly selecting some of the eighty possible numbers. It is customary to draw twenty numbers at random as the winning numbers, and in live Keno games this is usually accomplished using air blown ping-pong balls with one ball representing each of the possible eighty numbers. There is usually a separate paytable for each quantity of numbers played (e.g., a particular paytable with pay values is used when fifteen numbers are chosen that, for example, will pay the player whenever six or more of the selected numbers are drawn. A different paytable would ordinarily be used for ten numbers chosen, which may pay the player whenever five or more of the selected numbers are drawn). The paytables usually increase in pay value for the more matching numbers that are drawn. One attractive feature of most Keno paytables is that the increase in payoff (for more correct numbers selected) increases in a non-linear fashion that results in very high awards as the number of matches increases. This non-linear paytable is the result of the extremely low probability of hitting a high quantity of selected numbers (such as thirteen or more matches out of fifteen selected numbers). This very low probability allows very high awards to be possible.

SUMMARY OF THE INVENTION

When we set out to make the present invention, and then in the course of developing the invention, we had a number of objectives in mind, which we consider that the present invention accomplishes, as disclosed hereafter.

One object of the invention is to provide a gaming machine that has an exciting quick symbol selection process utilizing a reel-type arrangement, particularly with an attractive non-linear payback scheme, such as an Othello®[2]-type game. "Reel-type" arrangement is used broadly in this context, essentially encompassing the type of matrix-like display produced by a slot machine, such as one with Australian slot format.

[2] Orthello is a registered trademark of ANJAR Co.

Another object of this invention is a method of operating a slot-type machine with a matrix of different paylines having winning (or losing) events in an organization where a number of these events determines the payout. A related objective is to provide awards that increase non-linearly which are derived from aggregating results on multiple paylines up to a reasonably large number of paylines.

Still another object of this invention is to provide a game, as for a gaming machine, having an aggregation of independent events for a payout scheme based on these aggregate totals. Yet another related object of this invention is a slot machine that uses a different paytable for each possible maximum number of events and to have the paytables increase in a non-linear fashion, such that as more winning events are achieved the payoffs can increase in a spiraling upward manner.

Another object of this invention is to provide a new type of game, and particularly a new bonus game. In this game, game pieces are placed on empty squares on a partially populated game board. Based on a play mechanic, some of the empty squares are considered legal moves and others are considered illegal moves. Squares are randomly chosen in one form of the invention, and each time the random choice results in a legal move the piece is placed. Based on the play mechanic of the game, certain squares that were formerly legal moves may become illegal moves, and certain squares that were illegal moves may become legal moves. The board is updated to reflect this, and another selection of a square is made. When the (preferably) randomly chosen square results in an illegal move, then the round ends. Thus, the round has possible events that at one time in the round are disadvantages for the player, and then later in the round become advantageous.

A still more particular objective of this new legal/illegal movement-changing game embodiment is to have two types of pieces on a game board: a player's type piece, and an opponent's type piece. Each time a player's piece is placed in a legal square of the game board, one or more opponent's pieces are replaced with player's pieces, with an enhanced payoff if the game results in all of the opponent's pieces being replaced by the player's pieces in a maximum number of possible moves.

It is an object of the invention that additional embodiments of the invention include, but are not limited to, playing the games herein using a simulator on a home (personal) computer. Such an embodiment could accommodate any input with a mouse, keyboard, etc. This embodiment could accommodate wagering, or could be for amusement purpose only. It is envisioned that the game can be adapted for play on a Game Boy™ device or a television using a Nintendo GAMECUBE®. Yet other embodiments of the invention can be adapted for play using a home computer connected to the Internet via an Internet casino website. The above embodiments can be played using Hyper Text Transfer Protocol (HTTP) language, Hyper Text Markup language (HTML), Java language, Shockwave or Flash players. The above are examples of some of the ways that the invention can be practiced, but it is envisioned the invention is to include more specific embodiments mentioned.

In further summary of the invention, one aspect of the invention is a method of playing a game with an initial step of providing a game matrix with a plurality of locations. The matrix may be of any type, and is broadly intended to define a real, or imaginary, spatial orientation of locations (e.g., x–y coordinates). A plurality of game elements are used in play of the game, wherein each of the game elements has a first set of indicia and a second set of indicia, and the sets are distinct from each other. The indicia, also referred to herein as aspects, characteristics, features and the like, may be of a certain distinguishing type in two (or more) sets of identical indicia (e.g., black or white), or could be non-identical in a given set but linked in some manner by a theme (e.g., flora or fauna); these are but two examples of the differentiable indicia contemplated. More than two sets of indicia may be employed, so the reference to first and second sets should not be considered as limiting in this respect.

Play is affected by randomly selecting a game element from the sets of indicia for association with at least some, and most preferably all, of the locations in a played presentation. A methodology is provided to establish a plurality of predetermined winning arrangements of game elements of a set of indicia when so associated in the matrix. An awards table has a structure of awards wherein awards increase in value relative to a game outcome in a non-linear fashion as the aggregate number of winning arrangements approaches a maximum number of winning arrangements. Play concludes by determining the outcome for the game based upon comparison of the aggregate number of winning arrangements achieved in the played presentation with its corresponding value in the awards table. The aggregation referred to in this aspect is the total number of winning arrangements, regardless of a possible separate internal value that might also be available for a particular kind of arrangement. In yet another aspect, the aggregation is the total number of winning arrangements, depending upon the possible separate internal value that might also be available for a particular kind of arrangement.

In an application of the above method, the predetermined arrangements of game elements are discrete spatial arrangements in the matrix. In still another variation, the matrix is comprised of rows and columns to establish the locations. The discrete spatial arrangements are, in a preferred embodiment, selected from a group of arrangements comprising a plurality of indicia of a set of indicia appearing in a column, a row, or a diagonal line. The discrete spatial arrangements could be other preset geometric organizations of indicia of a set of indicia, such as four corners, a circular arrangement, and so forth. The concept behind the discrete spatial organization is to distinguish a randomized presentation of elements in a scatter-pay. Some aspects of the invention nonetheless encompass a scatter-pay winning event, so the foregoing distinction is not to be globally applied in considering every aspect of the invention herein described and claimed.

In an embodiment of the above method, the game elements each have two "sides" with one side representing the first set of indicia and the other side being different in appearance from one side and representing the second set of indicia. The predetermined winning alignments may include a minimum plurality of game elements representing the same side in a line. The line could be a straight line in the matrix extending in at least one of a vertical and diagonal direction relative to the matrix, and the winning alignment in a line requires that the game elements be contiguous in the line, such as completing the entire line. "Sides" is broadly used herein, since a visualization on a video screen would not really have sides, but could be made to so appear. A linear strip with alternating indicia would likewise present two (or more) "sides" in play.

Still another aspect of the invention is a method of playing a wagering game. The wagering game is initiated by providing a plurality of game elements in a matrix, such as the row and column matrix referenced above, each of the game elements having at least two aspects (features, characteristics, etc.). The player then places a wager based in part upon a player selecting a desired number of potentially winning arrangements of the game elements. Play continues by randomly determining which aspect of each of the game elements will be displayed upon operation of the game. The game is operated to establish a played presentation of the game elements after the random determination. Play concludes by determining an outcome for the game based upon comparison of the played presentation with predetermined winning alignments of the game elements, and providing a payout based upon the outcome in view of a payout table.

In a variation of this aspect, the wagering step includes the player selecting a number of arrangements in the form of slot-type lines to bet upon up to a preset maximum number of lines. Here, the payout preferably increases in a non-linear fashion as the number of winning lines achieved in the outcome approaches the maximum number of lines.

Another aspect of the invention is in the context of operating a gaming machine. The operation is started by providing a plurality of game elements for a display, as in a row and column matrix of game element locations. Each of the game elements has at least one feature categorizable into a particular set of at least two predetermined sets of features. Each of the sets of features has a characteristic differentiating that set from another set. A wager input by a player is registered, with the player selecting at least one possible winning arrangement of game elements of a plurality of winning arrangements. (Selection here includes merely picking a certain number of arrangements, or making a bet of a certain magnitude whereby the number of arrangements bet upon is thereby determined, and so forth.) The arrangements are chosen from a group including matches of game elements of a particular set of arrangements, such as in geometric vertical, horizontal and diagonal lines yielded by the matrix. The wager may further include registration of an amount to bet per arrangement. Game elements are randomly selected and associated with a respective location for a play of the game (i.e., one game element per location in play). At least one feature of each selected game piece in the play of the game is then displayed. An outcome of the play of the game is then determined based upon the number of winning arrangements actually achieved, if any, and a payout based upon at least the aggregate number of winning arrangements achieved and the amount bet. In a preferred version of this method, the payout increases in a non-linear fashion as the number of winning arrangements achieved in the outcome approaches the maximum number of arrangements.

It is envisioned that still another aspect of the invention is a gaming machine. The gaming machine includes a display for a plurality of game elements, the display preferably defining the foregoing rows and columns in a matrix of game element locations. Game elements are included each having at least one feature categorizable into a particular set of at least two predetermined sets of features. Each of the sets of features has a characteristic differentiating that set from another set. A wager input mechanism is included which registers a wager input by a player upon an outcome of the game.

The gaming machine includes an operating system including a methodology for playing the game wherein the arrangements are chosen from a group including matches of game elements of a particular set in some order, such as the noted geometric vertical, horizontal and diagonal lines yielded by the matrix. Also included is a mechanism to randomly select game elements and associate each selected game element with a respective location for a play of the game. A determination of an outcome of the play of the game based upon the number of winning arrangements actually achieved, if any, is calculated, along with a payout based upon the number of winning arrangements achieved and the amount bet.

The above gaming machine preferably further includes a look-up paytable having a payout that increases in a non-linear fashion as the number of winning arrangements achieved in the outcome approaches a maximum number of arrangements.

In yet another variation of the gaming machine, the gaming machine is a video gaming machine, the display is a video monitor, and the operating system includes a CPU with a program having the methodology as part of the program. The program further includes a drive for the display, and a random number generating routine.

Still another broad aspect of the invention is an improved method of determining a payout for a wagering game, where the game includes a plurality of different predetermined winning arrangements of game elements. The improvement is a paytable wherein at least some payouts increase in value relative to a game outcome in a non-linear fashion as the aggregate (i.e., total) number of winning arrangements approaches a maximum number of winning arrangements.

Another related aspect to the foregoing is an improved gaming machine, wherein the game includes a plurality of different predetermined winning arrangements of game elements upon which a wager can be placed for a payout. The gaming machine includes a paytable with at least some payouts that will increase in value relative to a game outcome in a non-linear fashion as the aggregate (i.e., total) number of winning arrangements approaches a maximum number of winning arrangements.

Yet another broad aspect of the invention is a method of playing a game, and particularly a bonus game, that is provided in conjunction with a base game. As a bonus game, play is effected by establishing a predetermined triggering event for the bonus game in the play of the base game. The bonus game is engaged to play upon the triggering event. The bonus game is played by having a structure of play including bonus game-continuing moves and bonus game-ending moves. At least some of the game-ending moves change to game-continuing moves in the progress of play of the bonus game. The outcome of the bonus game is determined based upon progress according to game-continuing moves.

In a variation of the foregoing method, the bonus game comprises a matrix of locations upon which the bonus game is played. At least some locations constitute game-ending moves during the course of play. However, selection of a location for a player's "piece" can change another game-ending location to a game-continuing location through the structure of play. The structure of play includes at least one game element of a player and a set of game elements of an opponent. The method may include game elements of the player being selectively located in an outflanking manner to a game element of the opponent as a permitted "move" of the game.

In yet another variant of this method, the moves are completed in accordance with the rules of the game of Othello.® The game can have a finite number of game-continuing moves, and include the step of determining at least some moves, and most preferably all moves, according to random selection by a random selection mechanism. The outcome increases in value according to a predetermined table of values based upon the number of the game-continuing moves accomplished in a play of the bonus game.

Yet another aspect of the invention is a method of playing a bonus game for a gaming machine with a base game. This bonus game is played by providing a plurality of game elements used in play of the base game. The base game elements comprise a first set of indicia and a second set of indicia, where the first and second sets of indicia are differentiable from each other and are randomly positioned in a base game matrix. Play of the bonus game is earned upon the random selection of a predetermined arrangement of the game elements in the matrix. The bonus game has awards associated with at least some of the game elements in the predetermined arrangement that are initially hidden from view of a player. The player then selects at least one of the game elements in the predetermined arrangement, and selects additional game elements thereafter in the predetermined arrangement until reaching a preset bonus game-ending criterion. The method of play concludes by awarding a bonus game payout in accordance with awards associated with the selected game elements before the game-ending criterion.

A variation of this bonus game includes a predetermined arrangement of the game elements as a spatially specific organization of the game elements in the matrix, such as a straight line in the matrix of a predetermined plurality of contiguous game elements of only one set of the indicia. Furthermore, the base game may include the step of a player selecting one of the sets of indicia, wherein the predetermined arrangement requires the game elements be of a different set of indicia from that selected.

These and other objectives and advantages achieved by the invention will be further understood upon consideration of the following detailed description of embodiments of the invention taken in conjunction with the drawings, in which:

BRIEF DESCRIPTION OF THE DRAWINGS

FIGS. 29 through 48 are diagrammatic flowcharts of one embodiment of a game program made in accordance with the present invention.

DETAILED DESCRIPTION OF EMBODIMENTS OF THE INVENTION

Figure 1:
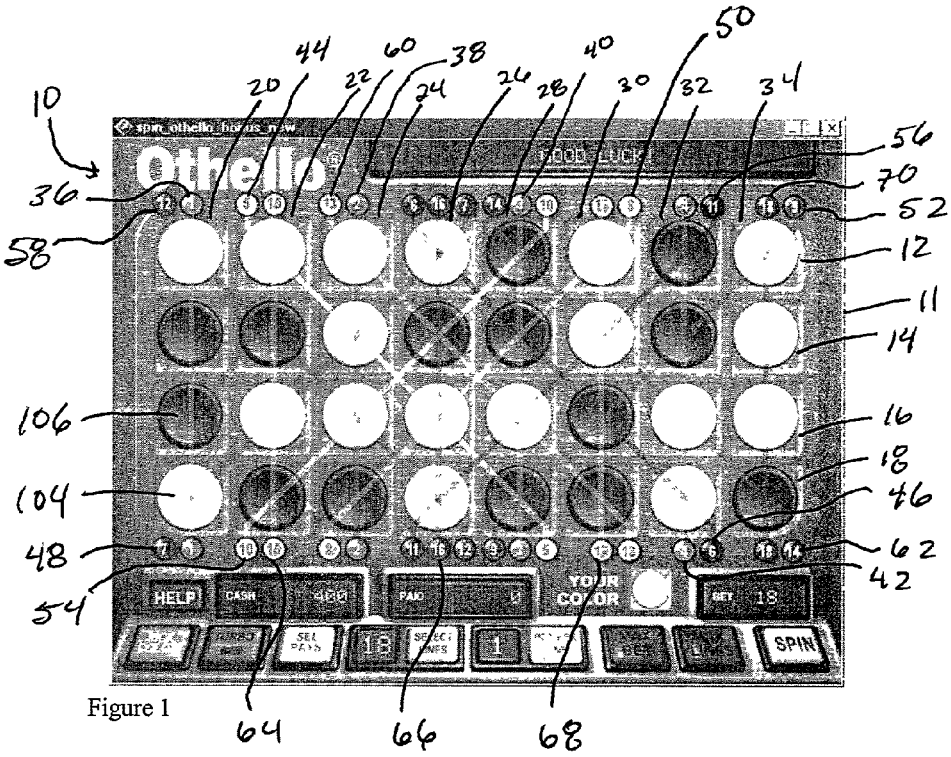
FIGS. 1 through 4 show various views of game displays of one embodiment of the invention.

In a first illustrative embodiment, the game employs a matrix of pieces shown in one of two possible positions, where each piece is displayed on a screen 10 of a video monitor 11, as shown in FIG. 1. Again, and as noted above, the invention has found particular application in a video gaming machine, but it is adaptable to non-wagering, as well as non-video applications, for instance. Returning to FIG. 1, one possible configuration of these pieces could be in four rows of eight pieces each, forming a matrix of four rows indicated at 12, 14, 16, and 18 and eight columns indicated at 20, 22, 24, 26, 28, 30, 32 and 34. It can also be seen in FIG. 1 that each piece has two sides, a white side 104 and a black side 106. Each piece is shown displaying one side or the other. Of course the game could use "heads" and "tails" of a coin for the pieces without departing from the invention as well as pieces that have more than two possible resulting symbols, just to name two variations. The symbols could be displayed in reel strips that are horizontally mounted (showing eight symbols from each reel, for one instance) or vertically mounted (showing four symbols from each reel, for one instance). The display could be of thirty-two independent slot reels, each having two or more possible symbols to be shown. In short, a wide variety of indicia and devices may be used to reveal the pieces at each position in the game.

Also, the use of four rows of eight symbols is arbitrary, and the arrangement of symbols can be in any format, although it is most preferred that multiple paylines are provided. Arrangements or paylines therefore encompass other geometric (or non-geometric) organizations or associations of matching elements, and need not be lines per se.

In this embodiment there are eighteen paylines (indicated at 36, 38, 40, 42, 44, 46, 48, 50, 52, 54, 56, 58, 60, 62, 64, 66, 68, and 70) that are formed through linear combinations of four pieces each. Again, there may be fewer or a greater number of paylines, and the lines may pass through more or fewer pieces. It is not necessary for each payline to pass through the same number of pieces. Also, while the pieces of FIG. 1 are of like kind (i.e., black and white disks), the pieces may be of different types.

Figure 2:
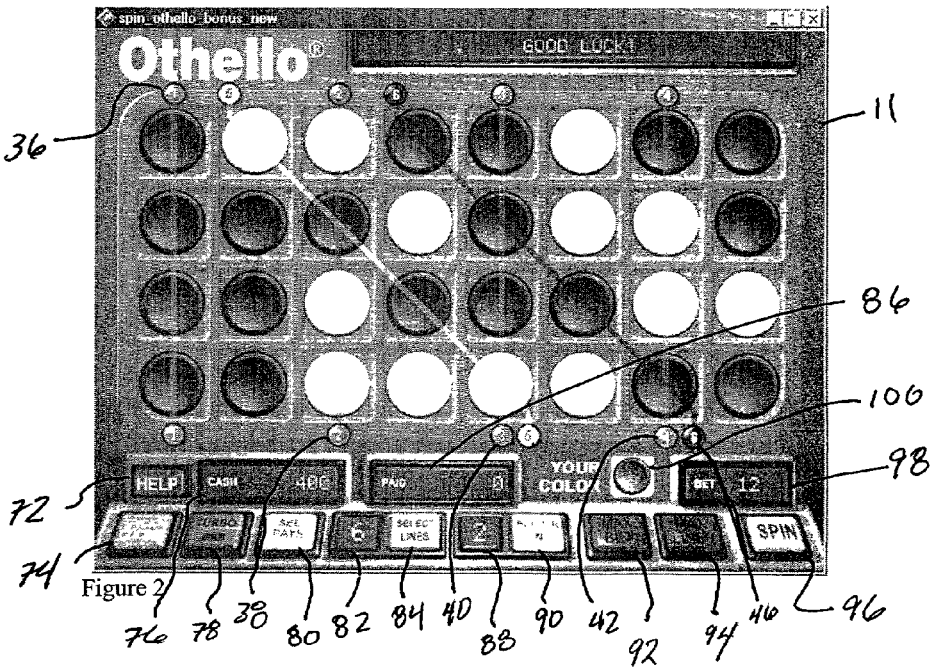

FIG. 2 shows this embodiment with the first six of the eighteen paylines indicated with lead lines 36, 38, 40, 42, 44, and 46 displayed on the screen 10 of the video monitor 11. The paylines indicated with circled #1 through #4 are vertically disposed, each passing through the four pieces in a vertical column. Paylines indicated with circled #5 and #6 are diagonally oriented, passing through four pieces each in a different row and column. In this embodiment, there are a total of eighteen possible paylines comprised of the eight vertical columns and ten possible diagonals running through four pieces each. All eighteen paylines (indicated at lead lines 36, 38, 40, 42, 44, 46, 48, 50, 52, 54, 56, 58, 60, 62, 64, 66, 68, and 70, as well as with the circled numbers 1 through 18) are shown in FIG. 1.

FIG. 2 also illustrates some of the various meters and buttons that may be used in various embodiments of the invention. The player may establish credits, coins, or cash values on the machine through the insertion of money, vouchers, electronic posting of funds, and the like, as is well known by those skilled in the art. Posted credits are displayed in a "Cash" meter 76.

The player may use a "Select Lines" button 84 to select from one to eighteen lines to be played. The buttons shown on the screen 10 of the video monitor 11 of FIG. 2 may be selected by using a touchscreen, a mouse or other pointing device, or may be provided instead of, or in addition to, mechanical buttons on a control panel, all as is well known in the art. By repeatedly pressing the "Select Lines" button 84, a "Lines Selected" meter 82 will cycle from 1 to 18 then back to 1. As the "Select Lines" button 84 is pressed, the "Lines Selected" meter 82 will show the number of lines selected for play. It is also envisioned that the game may include highlighting each line on the screen 10 of the video monitor 11 that is bet upon. FIG. 2 shows the display after the selected lines have been set to 6 lines, while FIG. 1 shows the display after the display has been set to eighteen lines. Alternatively, the player may press a "Max Lines" button 94 to enable all eighteen lines without having to cycle up to 18 using the "Select Lines" button 84.

In this embodiment, the player wagers one coin or credit for each line selected. The game could be configured to allow any size bet with any number of lines without departing from the invention. In one such variation of the invention, for instance, the game is set up to require a higher bet to play the more exciting higher number lines.

In this embodiment, the player may use a "Bet Per Line" button 90 to scale the bet and payouts, again as is well known by those skilled in the art. This allows the player to wager one to five coins or credits on each of the lines selected using the "Bet Per Line" button 90. The maximum of five credits per line is arbitrary, and may be any amount. The total amount bet, shown in a "Bet" meter 98, is the product of the number of lines selected as shown on the "Lines Selected" meter 82 and the bet per line as shown on the "Bet Per Line" meter 88. In FIG. 2, the six lines selected are multiplied by a bet of two coins or credits per line for a total bet of twelve credits.

Also in this embodiment, the player may actuate a "Pick Color" button 74 to select the color of pieces for play. The color or side of the pieces is shown in a "Your Color" display 100. The player will win based on the number of paylines that contain the color selected by the player. It is envisioned that the player could play both colors simultaneously by doubling the bet.

Once the bet has been established and the player's color has been selected, the player initiates play by pressing a "Spin" button 96. The number of credits specified by the "Bet" meter 98 is deducted from the "Cash" meter 76, bringing the FIG. 1 credit total from 400 to 382. All thirty-two pieces then start to "spin" as depicted in FIG. 3.

Figure 3:
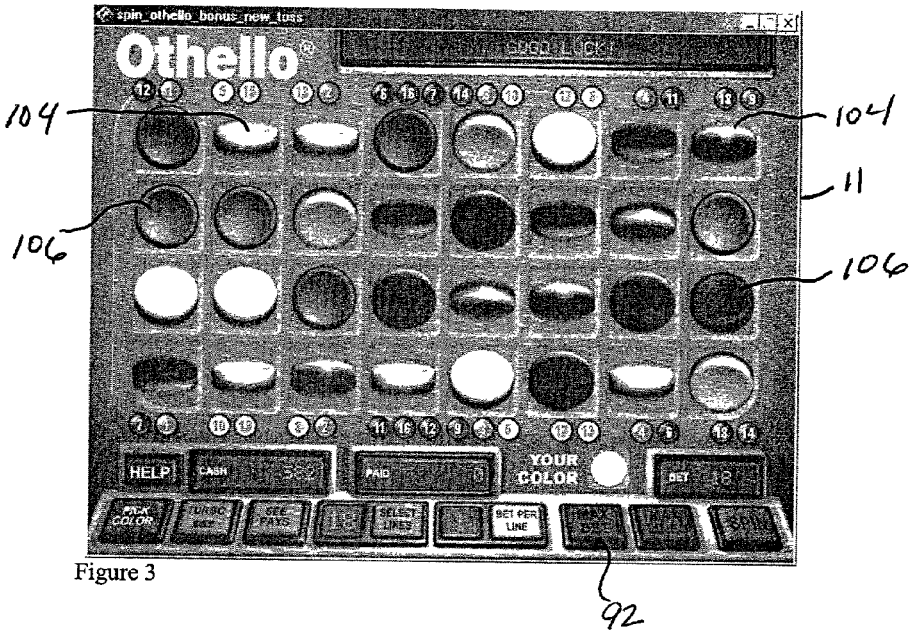

It can be seen clearer in FIG. 3 that each piece has two sides, a white side 104 and a black side 106. Each piece is shown displaying one side or the other. The CPU (not shown, but of any well know variety) uses a Random Number Generator (RNG) as is well known in the art to determine the stop position indicia for each piece. In this embodiment, the CPU "stops" each piece, showing either the white side 104 or the black side 106.

Figure 4:
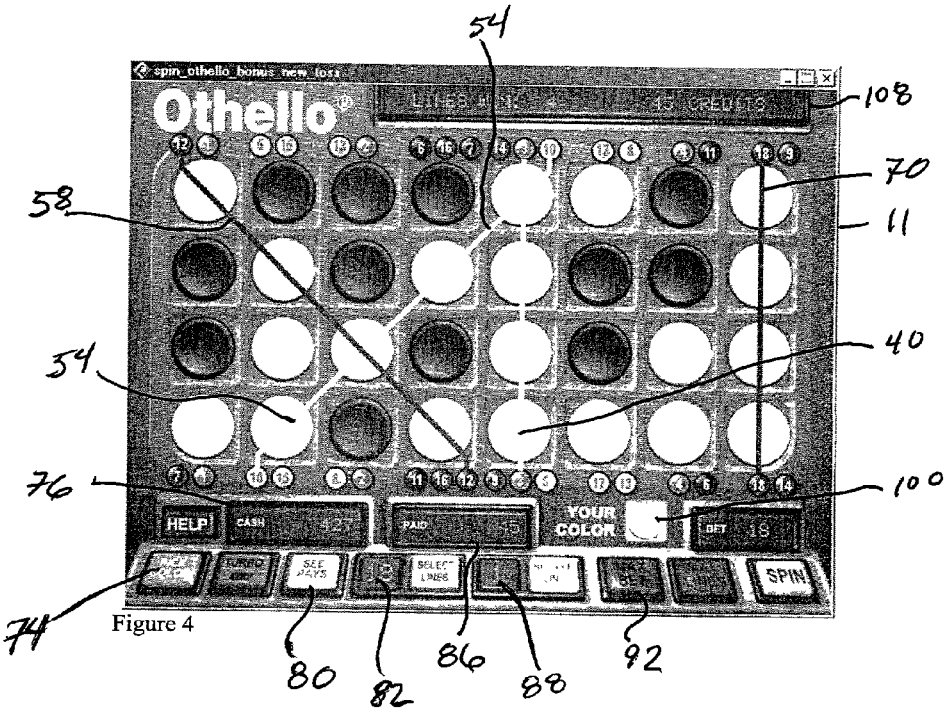

One possible result is shown in FIG. 4. The CPU determines whether all four pieces on a payline which has been bet upon match the color selected by the player (which is white in this case indicated by the "Your Color" display 100). A match of each piece on a payline to the selected color is the winning criterion for this embodiment, although other criteria may be used to determine whether a payline is a winning or losing result. While each winning payline contributes one unit to the total winning payline total in this version, other embodiments may assign different numerical values to different winning results to be aggregated for payout determination.

In this embodiment, each line that contains all four pieces of the player's selected color is considered to be a winner. The CPU highlights all winning lines in some manner, such as drawing the payline through winning lines as shown in FIG. 4. In this case, lines with the circled #3, #10, #12 and #18 are winning lines (also indicated by lead lines 40, 54, 58, 70). The number of winning lines is totaled, and this total (four lines) is shown in a display 108 at the top of the screen 10 in FIG. 4. Forty-five credits are won as a result of four winning lines and displayed in a "Paid" meter 86. This total is added to the "Cash" meter 76.

Figure 5:
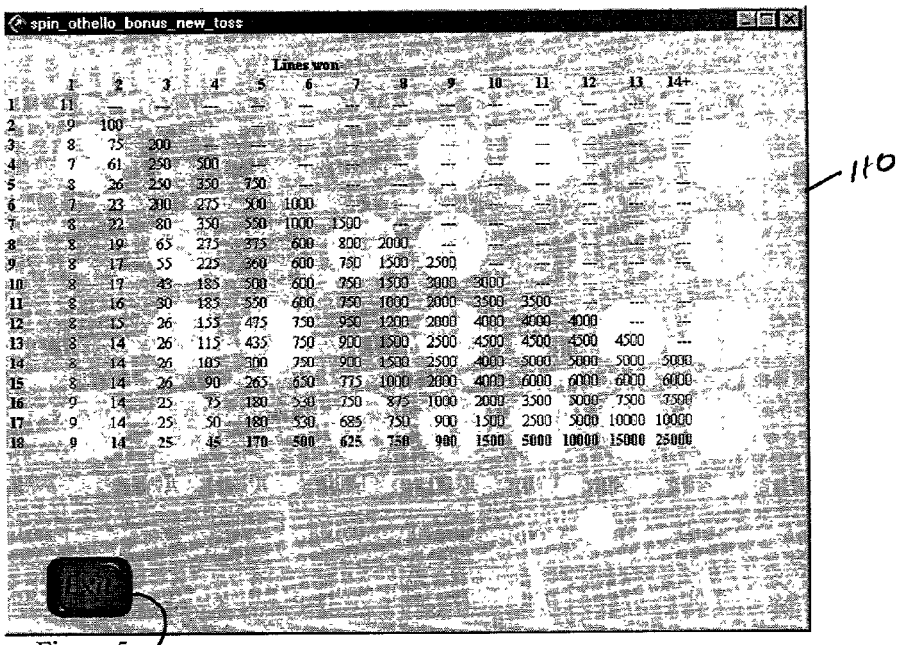
FIG. 5 shows a paytable display in accordance with one embodiment of the invention.

Additionally in this embodiment, a "Help" button 72 may be actuated at any time to display instructional pages in a manner well known in the art. The player may also actuate a "See Pays" button 80 at any time to view the paytable for each of the possible combinations of winning lines and number of lines selected. FIG. 5 shows the paytable 110 for an embodiment after the player has actuated the "See Pays" button 80. The left column of the paytable indicates the number of lines being played. There is a separate paytable for each possible number of lines played from 1 to 18. For a given number of lines played, the paytable row shows the number of credits won based on the number of winning lines. For example, in FIG. 4, eighteen credits were bet to play eighteen lines. There were four lines containing all white pieces, which matched the white piece selected by the player. The $18^{th}$ row of the paytable corresponding to playing eighteen lines shows 9, 14, 25, and 45 credits awarded respectively for winning on 1, 2, 3 and 4 lines. Thus, the player wins forty-five credits for winning on four lines in the FIG. 4 example.

Referring again to FIG. 5, this embodiment has pay values for one or more lines in each paytable row. In this version, the only total losing "spin" occurs when no lines are winners. For games playing nine lines or more, the player wins less than the amount bet when only one line is a winner. The game could be set up to require more than one winning line before any value is paid, or with a different number of lines required before winning as much or more than was wagered. Conversely the paytable could be constructed such that the player always received at least the amount bet with one or more winning payline. These variations will be further discussed hereafter when looking at the construction of the paytables. Additionally, the player may exit the paytable 110 and return to the game at any time by actuating an "Exit" button 112.

Referring back to FIG. 4, the player could have actuated a "Max Bet" button 92 that sets "Lines Selected" meter 82 to 18, sets the "Bet Per Line" meter 88 to 5, and initiates a "spin". If there are less than ninety credits on the machine, the CPU will establish the highest line/bet per line combination available with the number of credits and initiate the spin. Alternatively the CPU may deactivate this button when there are not enough credits to wager the maximum of ninety credits.

It is currently very popular to embed special bonus games in games of chance. In some traditional slot machines, there are certain indicia that initiate a bonus round when certain combinations of the indicia appear on a payline that was wagered upon. In other machines, the bonus round is initiated by what is called a "scatter pay" which is defined as a certain combination or combinations of visible symbols without regard to a particular payline. The term "scatter pay" is derived from winning combinations that instead of being required to be on a wagered payline, are symbols that can be scattered anywhere in the results of a spin. In a multi-line game, this type of bonus game traditionally pays a multiple of the entire wager for the spin since the combination is not tied to a particular payline. There are some games that have other rules for winning symbol combinations within the visible symbol field that are not related to paid paylines. These are known as scatter pays to those skilled in the art even though they may have a more rigid definition of the alignment of symbols. When a scatter-type pay is used, the bonus round is initiated when the combination appears, without regard to which paylines have received a wager. The awards from a scatter pay bonus round are typically multiples of the wager used in the initiating spin. Conversely, when a bonus round is initiated through particular symbols landing on a wagered payline, the bonus is typically paid in multiples of the number of credits wagered on the specific line where the initiating symbols appeared. Once more, how a bonus round is initiated is subject to a wide variety of triggering events. These are but a few of them.

The current invention can easily accommodate the initiation of a bonus round based on initiating symbols on a payline. As a non-limiting example, imagine an eight by eight matrix of black and white playing pieces. This could provide eighteen paylines (eight horizontal, eight vertical, and two diagonal). One definition of a "winning payline" could be any payline with six or more of the player's color, and the paytable would show pays for achieving one through eighteen lines with six or more of the player's color. Additionally, any line that received a wager and had all eight pieces of the player's color could initiate a bonus round. This example could also use the variable win per payline mentioned above. For example, any payline that received seven or eight of the player's pieces could result in a win equal to two lines, thus the paytable would pay from one to thirty-six possible line wins. There are many other ways to configure a payline-based bonus round using this invention, which is not limited by the above example.

There is also a way to use the aggregating nature of this invention to initiate a bonus round in another manner. For example, the bonus round may be initiated in place of any particular pay of a paytable. In the case of the paytable of FIG. 5 with all eighteen lines played, the bonus round could occur any time exactly five lines contain the winning event (e.g., of matching the player's selected color). Instead of receiving the pay of 170 credits, the game could initiate a bonus round that had an expected value of 170 credits. Another alternative could be to configure the game to begin a bonus round any time that seven or more lines contained winners or other aggregate criteria. Any two consecutively numbered paylines resulting in a winning combination could initiate a bonus round. Alternatively, any two adjacent vertical lines with all symbols matching the player's selected color could initiate the bonus round. Or still alternatively, a scatter-type award could be made anytime a pre-set number of pieces matching the player's color is achieved, such as with seventeen or more matching pieces and no winning lines, to provide an award when the player gets many of his or her pieces, but nothing lines up. These, again, are just some non-limiting examples.

Figure 6:
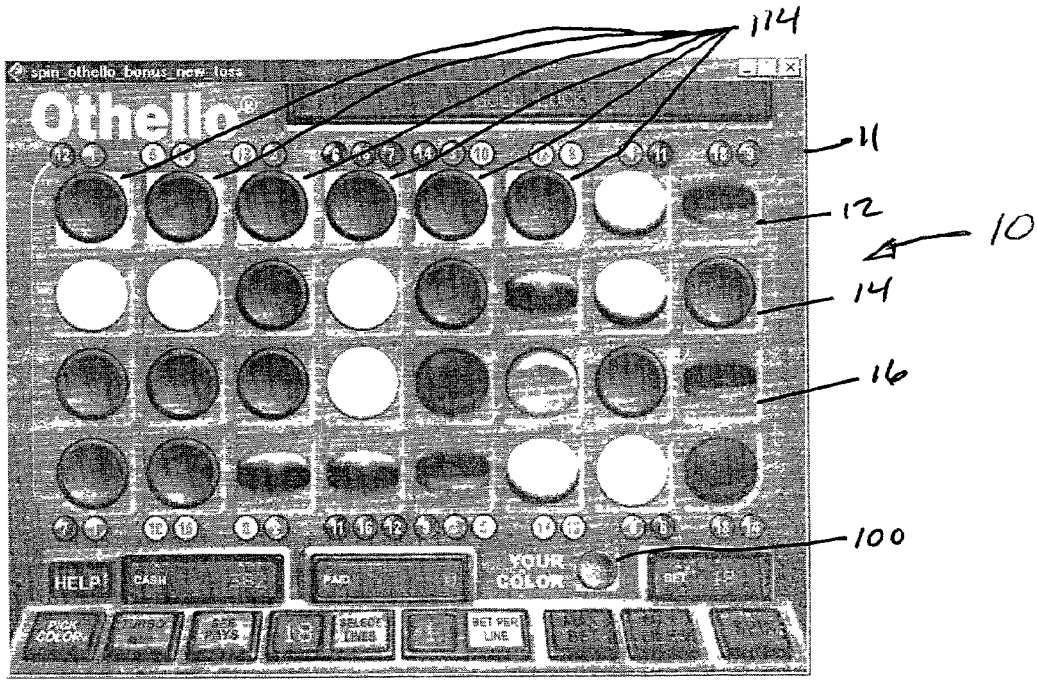
FIGS. 6 and 7 show additional views of game displays of one embodiment of the invention similar to that of FIGS. 1 through 4.

In one embodiment of the invention, a bonus round is initiated when any of the four horizontal rows result with all eight pieces matching the color selected by the player. Furthermore, to add excitement to the presentation of the game, as the pieces are stopped in a roughly left to right manner, the game draws attention to the possible bonus initiating combination by sequentially lighting up the background behind the pieces as they are stopped, once any horizontal line contains four of the selected pieces and until a piece of the other color appears in the row. FIG. 6 shows such a game display in mid spin, after six of the required eight pieces have matched the selected color in the first row 12 of the screen 10. It can be seen that the background 114 of each of the first six squares in the first row 12 is brighter, to add to the anticipation of being awarded a bonus game. The brighter backgrounds 114 are initiated if the first four or more pieces match the color the player has chosen as indicated by the "Your Color" display 100. In addition to the brightened backgrounds, sounds may be played to add anticipation of a possible bonus round, bells or sirens may go off, confetti may explode from the machine, a line of chorus girls may appear, or the like. If a piece in the row subsequently stops on the non-matching color, the highlight of the entire row is returned to normal, or turned off, as illustrated in the second and third rows 14, 16.

Figure 7:
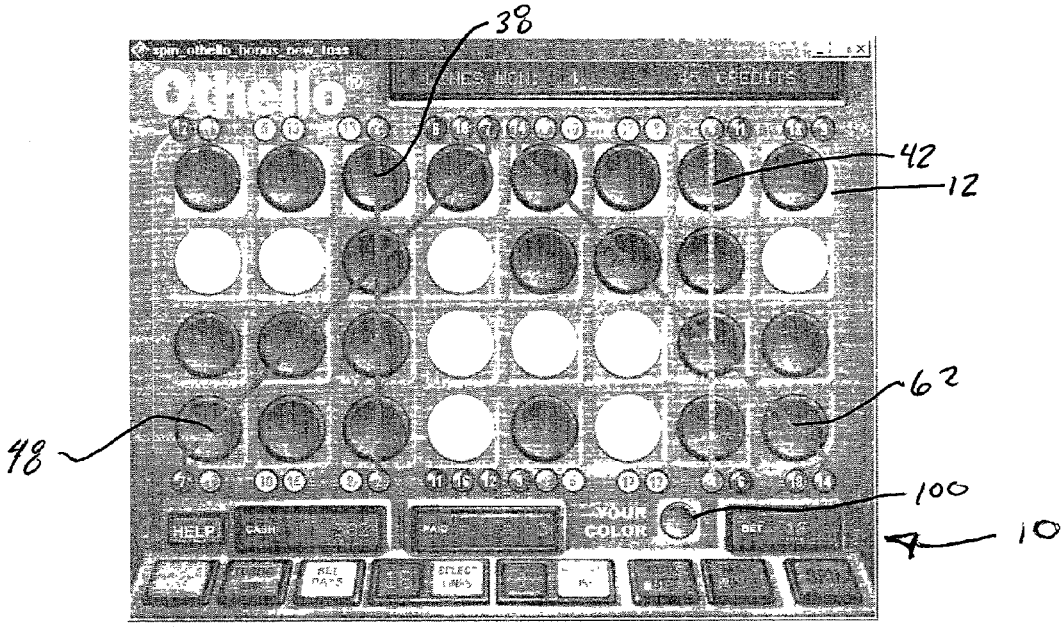

FIG. 7 shows a possible outcome of the "spin" of FIG. 6 after all of the pieces have stopped. In FIG. 7, the game shows four winning lines (lines with circled #2, #4, #7 and #14) as also indicated by lead lines 38, 42, 48, and 62 on the screen 10. This will result in a payout of 45 credits (i.e., paytable of FIG. 5). In addition to the 45 credit payout, the occurrence of all eight pieces across the top row 12 matching the selected color of black will result in the play of the bonus game. There are many possible bonus games that could be used once initiated from the base game, but the instant invention has as one aspect a new bonus game.

Figure 8:
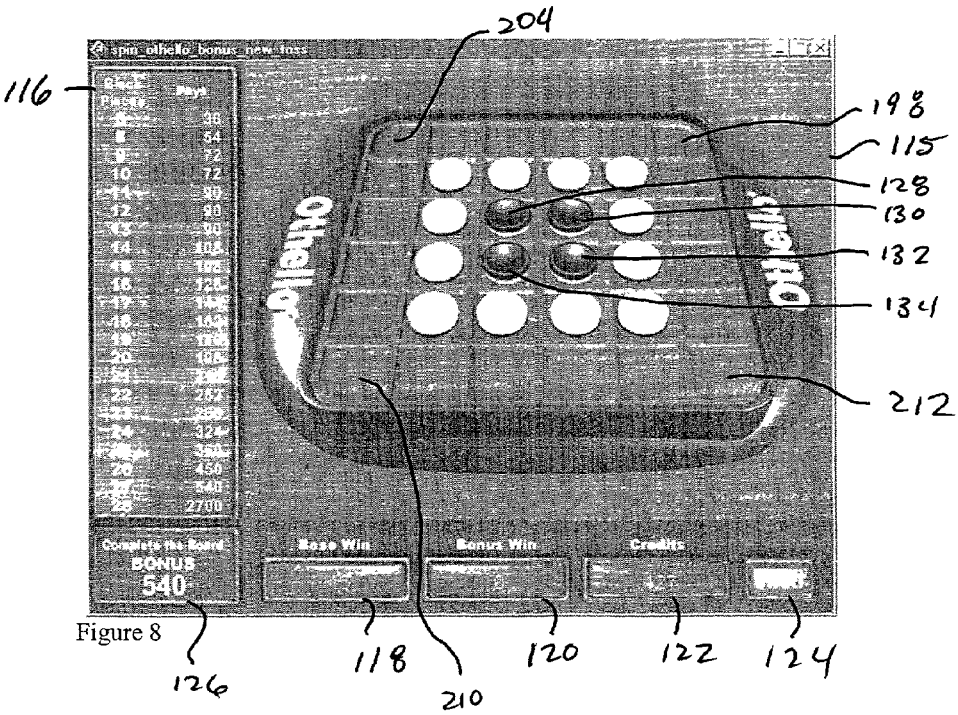
FIGS. 8 through 20 show various views of game displays of another embodiment of the invention taking the form of a bonus game.

FIG. 8 shows one embodiment of a bonus game. This bonus game is played on a representation of a game board similar to the popular Othello®-type board game. The bonus game screen 115 primarily shows a modified game board with a six by six grid of squares. Additionally shown are a bonus game paytable 116, a "Base Win" meter 118, a "Bonus Win" meter 120, a "Credit" meter 122, and a "Start" button 124. Other meters may or may not be displayed, as needed or desired. One such meter is a "Complete the Board Bonus" meter 126 that indicates even more possible wins upon specified outcomes. Here, the additional "Complete the Board Bonus" meter 126 indicates additional possible winnings of 540 credits for completing the board.

In the initiating base game spin shown in FIGS. 6 and 7, the player selected the black color as indicated by the "Your Color" display 100. "Base game" is meant to refer to the primary game being played, also sometimes referred to as the principal, main or underlying game. The bonus game begins with four pieces 128, 130, 132, and 134 in the center of the six by six board with the player's color displayed. Surrounding these four pieces are twelve pieces with the opponent's color which is the color not selected by the player, or in this case white. Of course, the bonus game could be started in a different initial configuration, as with different starting patterns on different bonus games, either in a randomized fashion or based on some other criteria such as the outcome of the triggering "spin" in the base game.

In this embodiment, and in keeping with the base game theme, the pieces of the bonus game are all black on one side and white on the other side, similar to an Othello®-type game. The operation of the bonus game is based on the basic legal move in the Othello®-type board game. The basic legal move in the Othello®-type game is a placing of pieces with the player's color next to any opponent's colored pieces, such that an "outflanking" of the opponent's colored pieces may occur. Outflanking occurs when a game piece with the player's color is placed in an empty square such that one or more of the opponent's pieces are in consecutive squares (in a line) between the new position of the player's piece and another piece of the player's color. This may occur on a horizontal, vertical or diagonal line. After the piece is played, all of the outflanked pieces of the opponent's color are flipped or turned over so that they now show the player's color. According to this game's methodology, a piece cannot be legally placed in an open square that does not outflank opponent's pieces as described above.

Returning to FIG. 8, at the beginning of the bonus game, the twenty squares on the perimeter of the board are open squares. At the start of the bonus round, each of these twenty perimeter squares is a legal move for the player's black piece because it will outflank exactly one piece.

Figure 9:
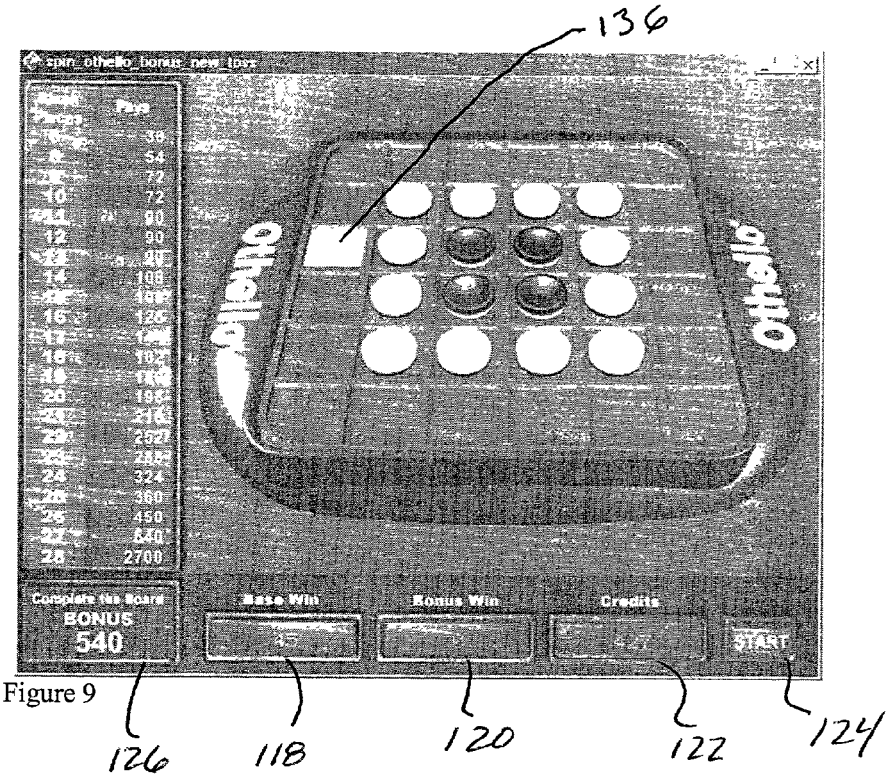

In this embodiment of the invention, the player actuates the flashing "Start" button 124 to begin operation of the bonus round. The CPU (not shown) uses its RNG (not shown) to randomly select one of the twenty open squares on the board. An animation moves a highlight around through the open squares in a clockwise fashion stopping on the randomly selected square 136. Other forms of selecting an open square may be utilized without departing from the invention. FIG. 9 illustrates one possible selection with a selected square 136 highlighted.

Figure 10:
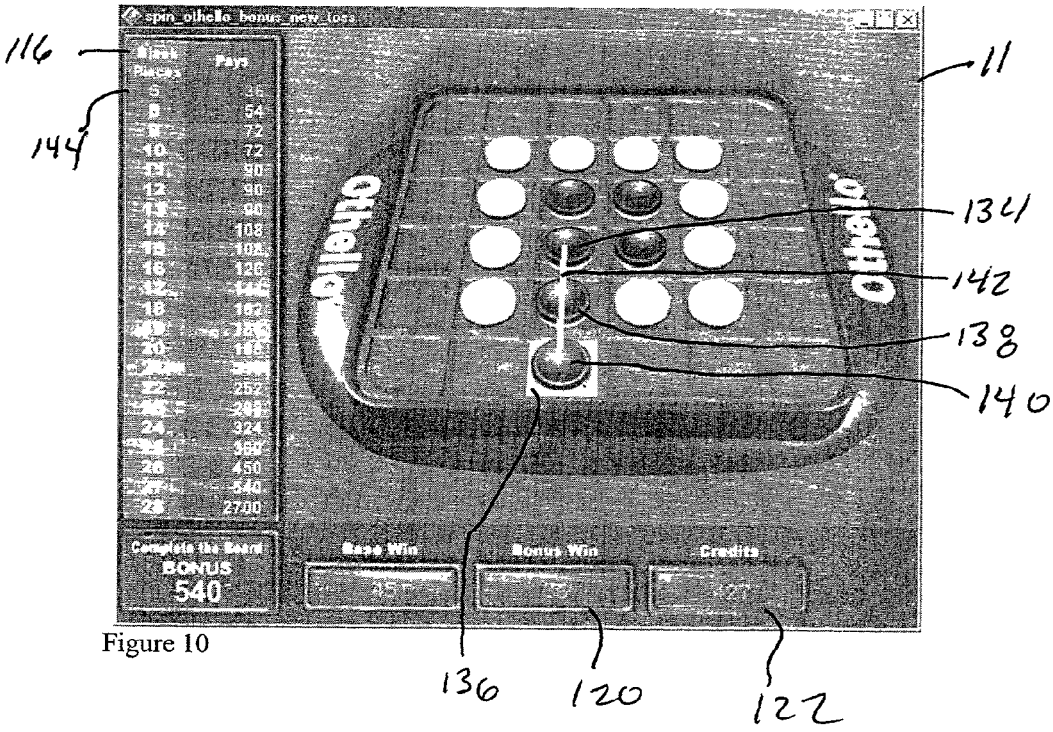

As illustrated in FIG. 10, once the highlight stops on the selected square 136, a new piece with the player's color 140 (black in this case) is placed in the square 136 and any opponent (white in this case) pieces outflanked by the new piece 140 and another piece with the player's color 134 are turned to the player's color (black). In FIG. 10, lead line 138 indicates the opponent's piece that is outflanked by the new piece 140. The CPU (using CPU expansively herein to also refer to the programming therein) draws a line 142 between the player's pieces through the outflanked piece or pieces. The opponent's pieces in this line are then flipped to all show the player's color.

After the opponent pieces are flipped, the CPU determines the number of player's pieces (black) on the board and highlights the corresponding value in the paytable 116. FIG. 10 shows the highlighted line 144 indicating a pay of 36 credits for six black pieces on the board game. This 36 credit value is also shown in the "Bonus Win" meter 120.

Figure 11:
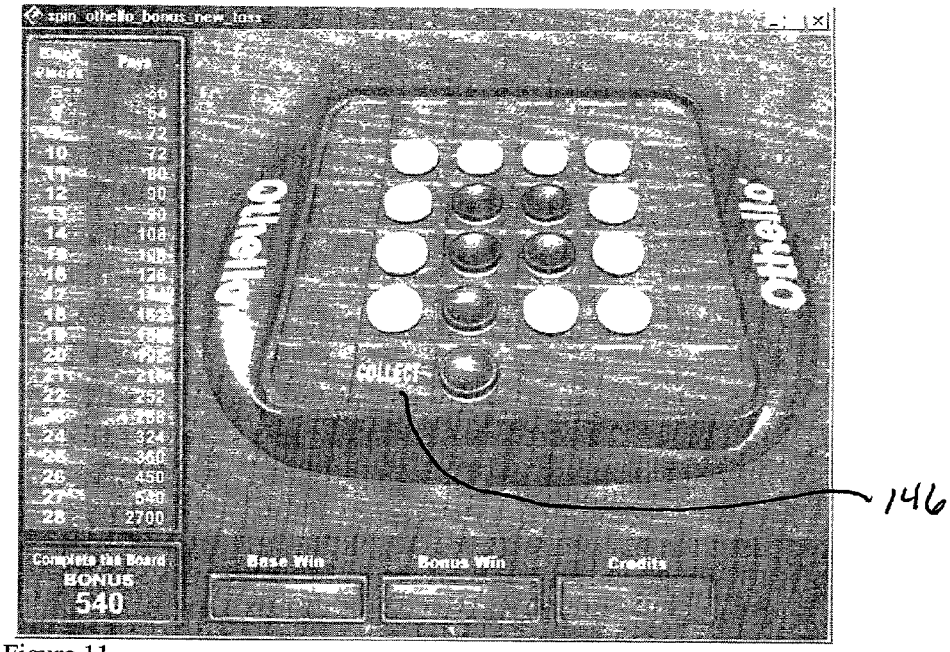

The CPU next analyzes each of the remaining unoccupied perimeter squares to determine which squares are legal moves according to the foregoing rules of the bonus game. Any square that is not a legal move (because the new piece will not outflank opponent pieces) is labeled "Collect" which is an indication that the selection of this square will result in the collection of the paytable value for the number of pieces on the board, and end the bonus round. All open squares that are legal moves are left blank, and a selection of any blank square will result in the placement of an additional new piece. FIG. 11 shows that a single square 146 is labeled "Collect" due to the piece placement in FIG. 10.

Figure 12:
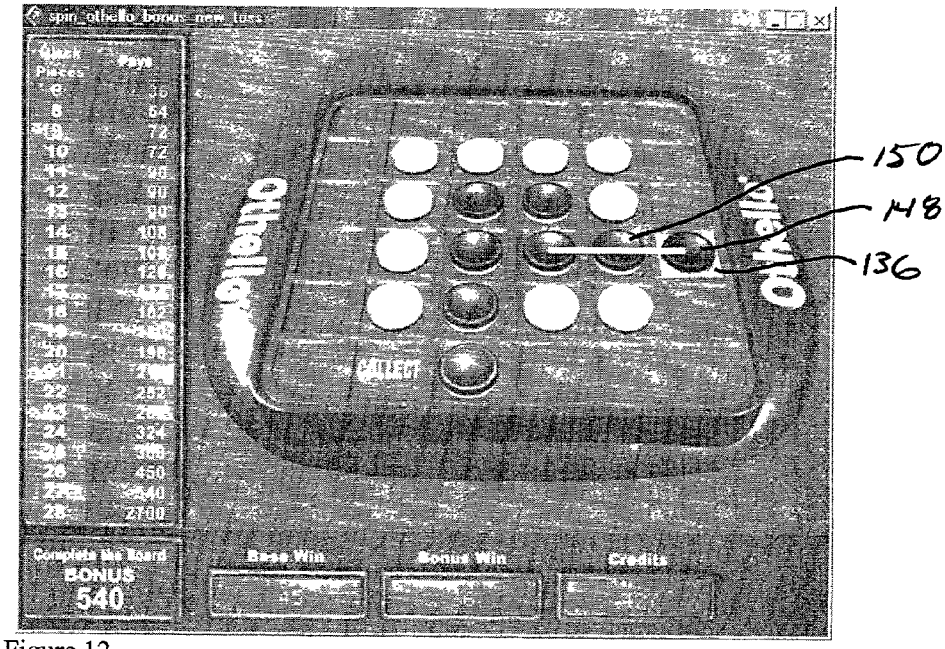

The process of randomly selecting one of the remaining open squares with a highlighted square 136 is then continued until an open square is chosen that is labeled "Collect." FIG. 12 shows another randomly selected square 136 with a new piece 148 having the player's color. Again, any of pieces with opponent's color that are outflanked are flipped to reveal the player's color. In this case, the outflanked piece 150 is flipped to show the black side.

Figure 13:
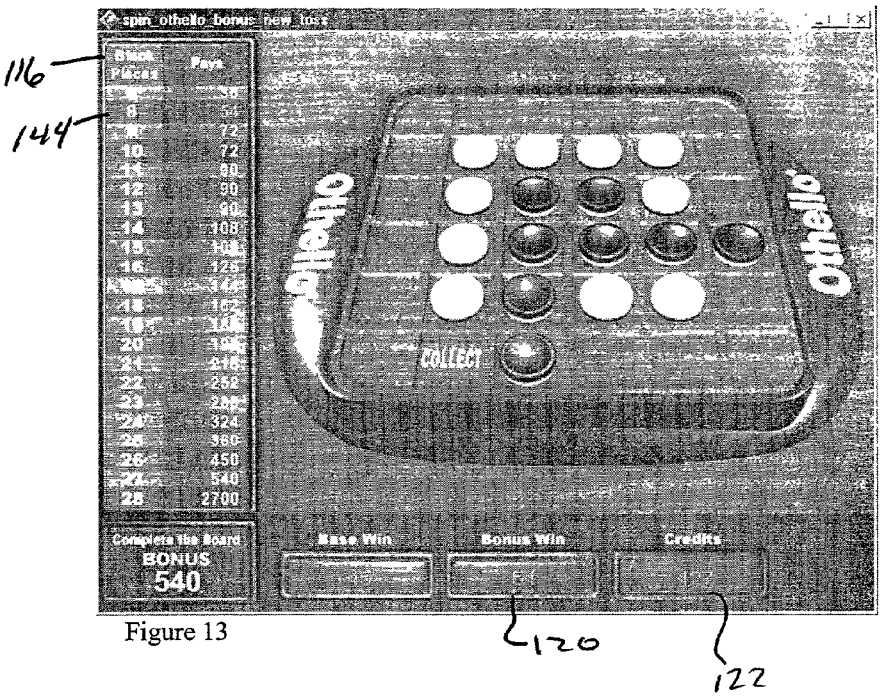

FIG. 13 shows the updated highlighted line 144 in the paytable 116 for eight pieces with the player's color. The highlighted line 144 indicates that 54 total credits have been won and the "Bonus Win" meter 120 also indicates 54 credits. The process of randomly selecting one of the remaining open squares with a highlighted square 136 is then continued In FIG. 13, the rescan for legal moves does not add or remove any "Collect" squares since the possible legal moves does not change. The CPU then randomly selects another open square.

Figure 14:
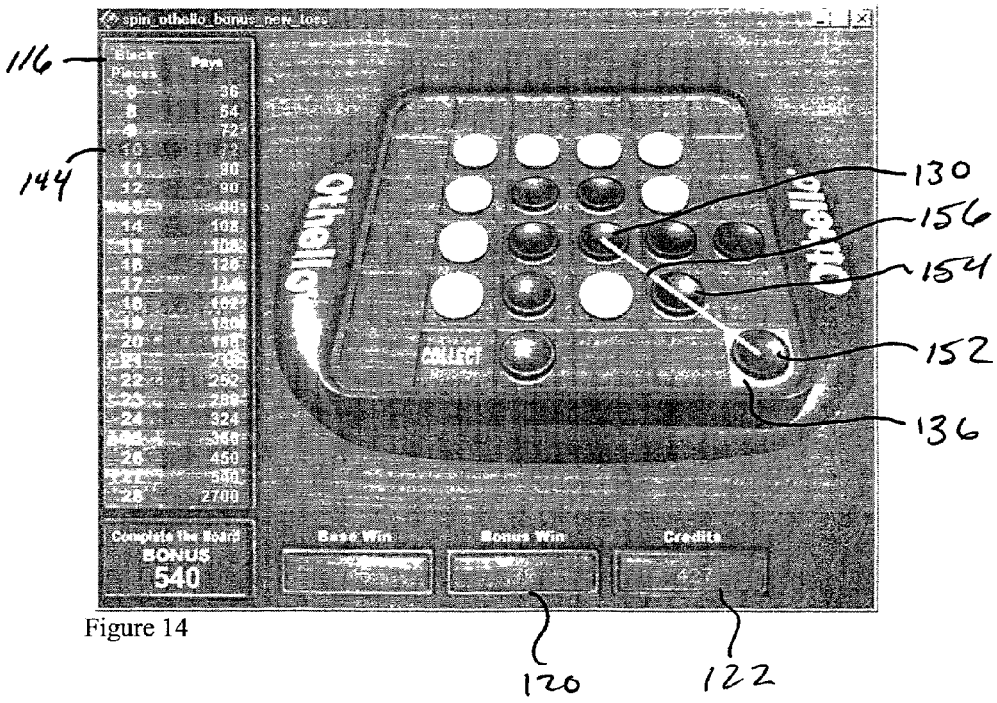

FIG. 14 shows a new black piece 152 placed in the selected square 136 with the outflanked piece 154 turned from white to black. A line 156 is drawn between the player's original piece 130 and the new black piece 152. The highlighted line 144 of the paytable 116 is updated to indicate that 72 credits have been won so far in the bonus game and the "Bonus Win" meter 120 is updated to reflect the winnings.

Figure 15:
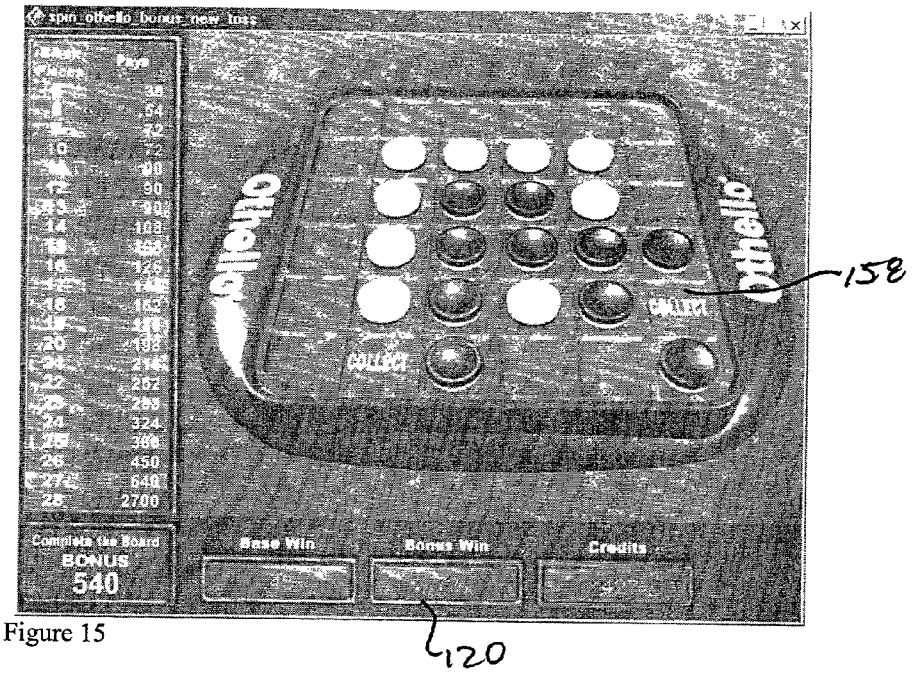

The CPU again analyzes the legal moves which results in the addition of another "Collect" square 158 without removing any collect squares as shown in FIG. 15.

Figure 16:
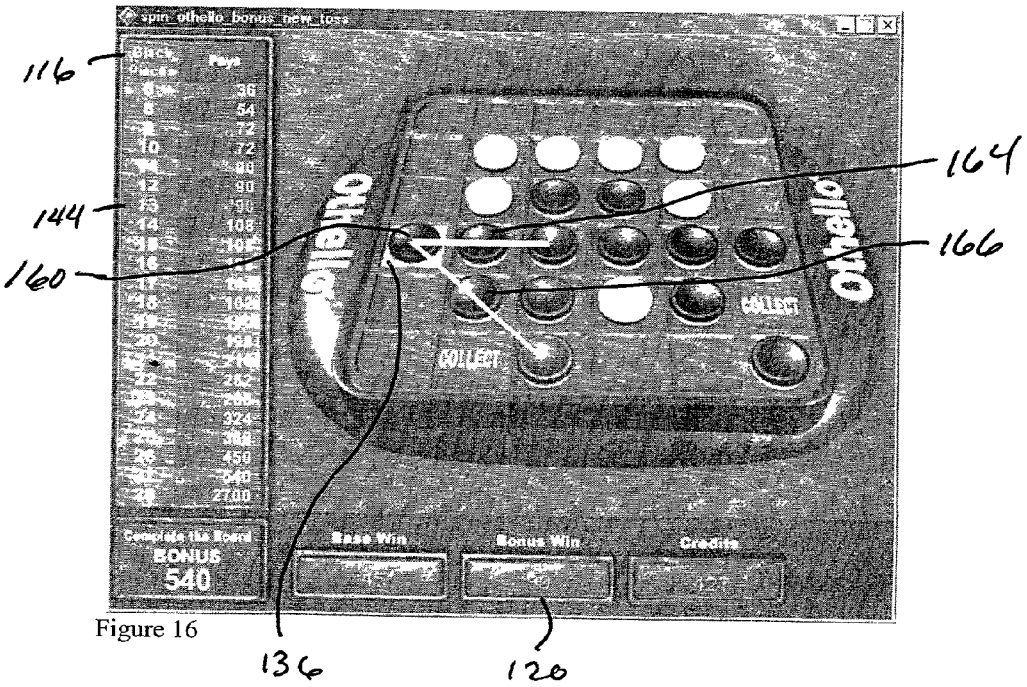

In FIG. 16, the CPU randomly selects another open square and places a new piece with the player's color 160 in the new square 136. The new black piece 160 outflanks two white pieces 164 and 166 in two different directions. Each of the outflanked pieces 164 and 166 is turned to black. The highlighted line 144 of the paytable 116 is updated to indicate that 90 credits have been won so far in the bonus game and the "Bonus Win" meter 120 is also updated.

Figure 17:
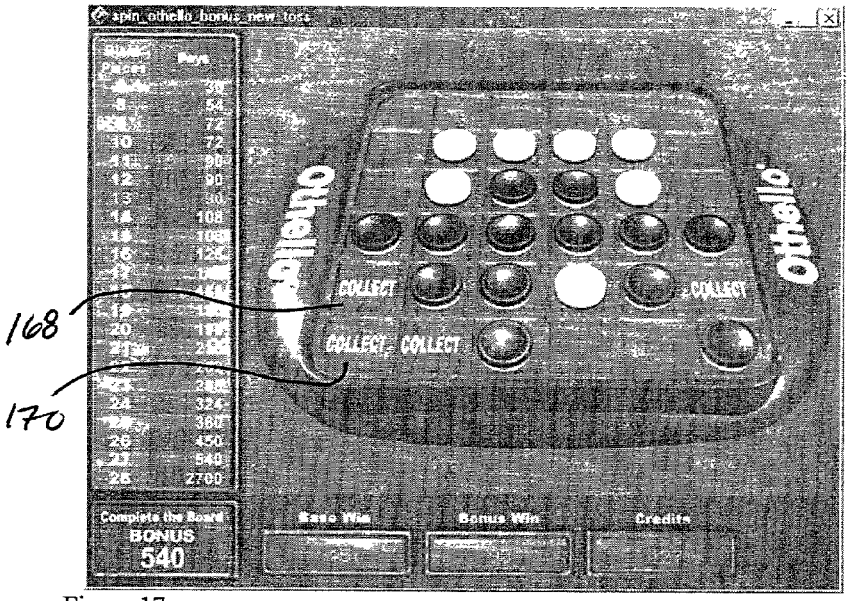

FIG. 17 shows that after a re-analysis of legal moves that no "Collect" squares were removed and two additional "Collect" squares 168 and 170 were added. The bonus game is ready for placement of the next piece.

Figure 18:
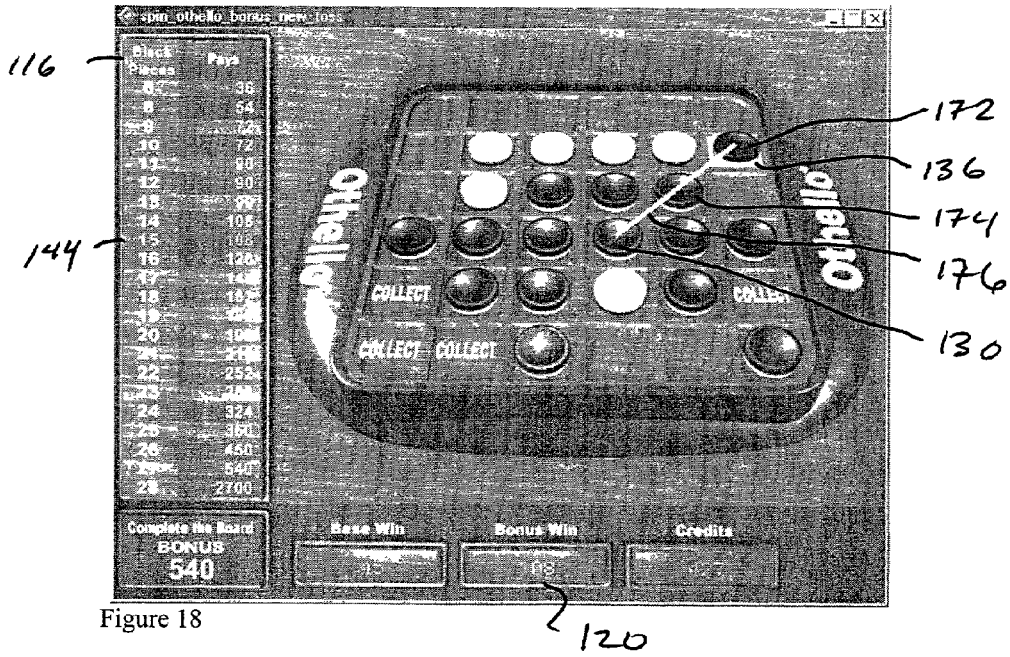

FIG. 18 shows that the RNG selected another square 136 that is a legal move in the bonus game. A new piece 172 placed in the selected square 136 with the outflanked piece 174 turned from white to black. Again a line 176 is drawn between the player's original piece 130 and the new black piece 172. The highlighted line 144 of the paytable 116 is updated to indicate that 108 credits have been won so far in the bonus game and 108 credits are shown in the "Bonus Win" meter 120.

Figure 19:
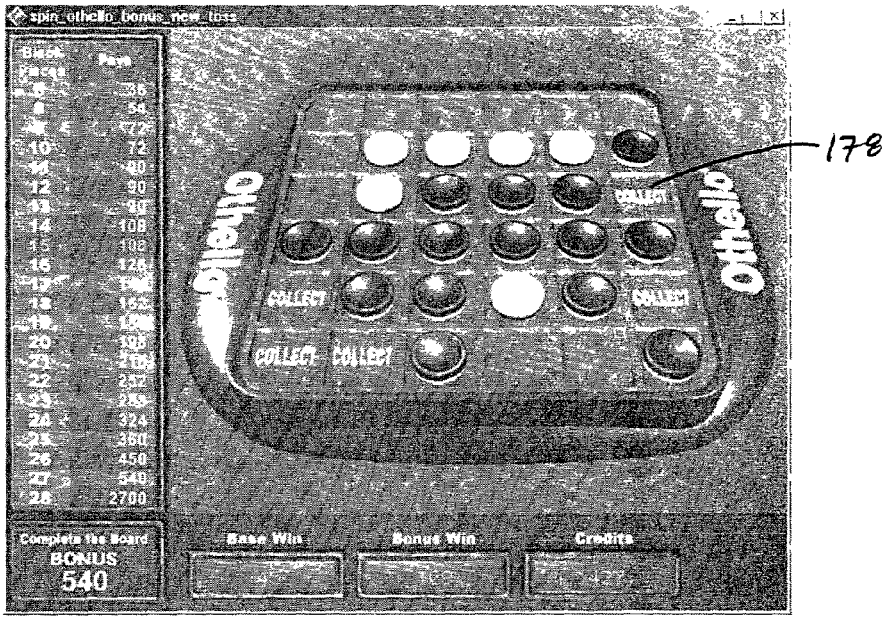

FIG. 19 shows the labeling of another square to be a "Collect" square 178 without removing any of the other collect squares. The game is ready for the selection of the next square.

Figure 20:
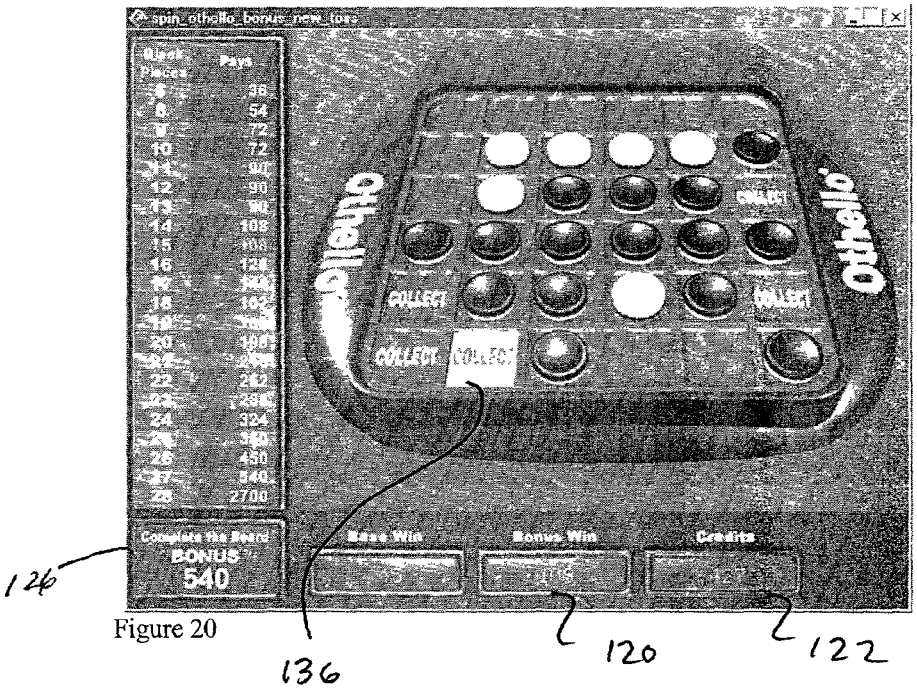

FIG. 20 illustrates that the CPU has selected a square 136 that is not a legal move and thus was labeled as a "Collect" square. The selection of a "Collect" square ends the bonus game, with a total bonus game win of 108 credits as indicated in the "Bonus Win" meter 120.

Figure 21:
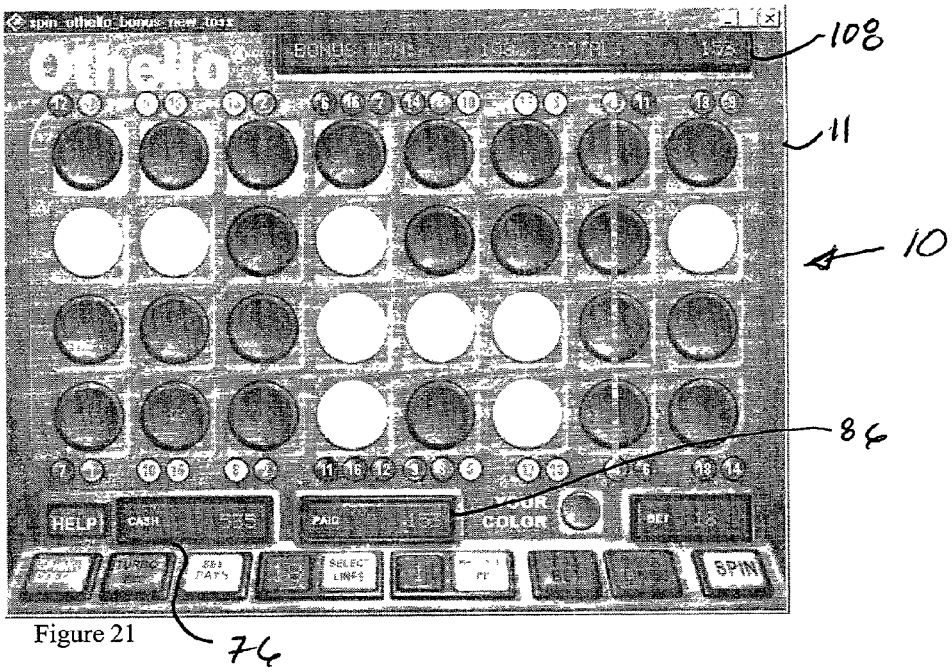
FIG. 21 shows a game display of one embodiment of the invention similar to that of, e.g., FIGS. 1 through 4.

FIG. 21 shows the screen 10 reverting to the base game screen 10 showing the initiating spin results of FIG. 7. The display 108 at the top of the screen 10 shows that 108 credits were won in the bonus game. The total win is the 108 credits of the bonus game plus the 45 credits won for four winning lines of the base game which totals to 153 total credits. The total win of 153 credits is also shown in the display 108. The 153 credits won are added to the 382 credits of the base game and the "Cash" meter 76 is updated to display 535 credits available to the player. Additionally, the "Paid" meter 86 is updated to reflect the payout.

While the above example showed "Collect" symbols added to the board after most piece placements, it is envisioned that there are occasions when the placement of a piece and subsequent flipping of the outflanked pieces will result in the removal of a "Collect" symbol where the square that was an illegal move becomes a legal move.

Figure 22:
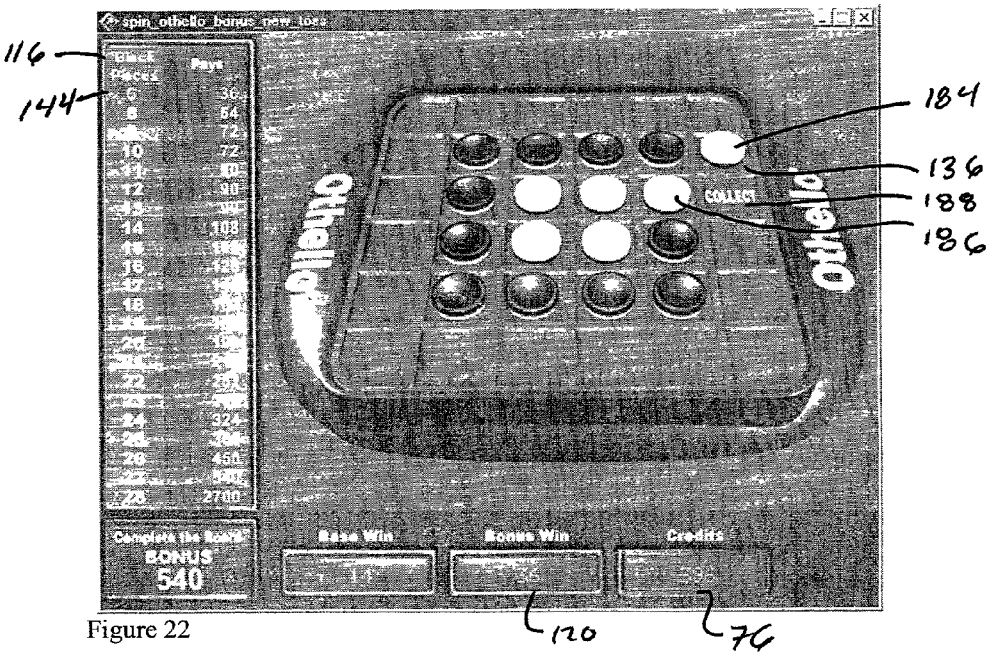
FIGS. 22 through 24 show additional views of game displays of an embodiment of the invention similar to that of, e.g., FIGS. 8 through 20.

FIG. 22 shows another embodiment of a bonus game that is already in progress. In this embodiment the player is playing the white pieces and the opponent's pieces are black. In FIG. 22 a new white piece 184 is placed in the chosen square 136, which resulted in the flipping of one outflanked black piece 186 and the lighting of a "Collect" in a square 188 that is no longer a legal move. Additionally, the highlighted line 144 of the paytable 116 is updated to indicate that 36 credits have been won so far in the bonus game and the "Bonus Win" meter 120 is updated to reflect the thirty-six credit win. There are now nineteen open squares remaining with only one square that will end the bonus round.

Figure 23:
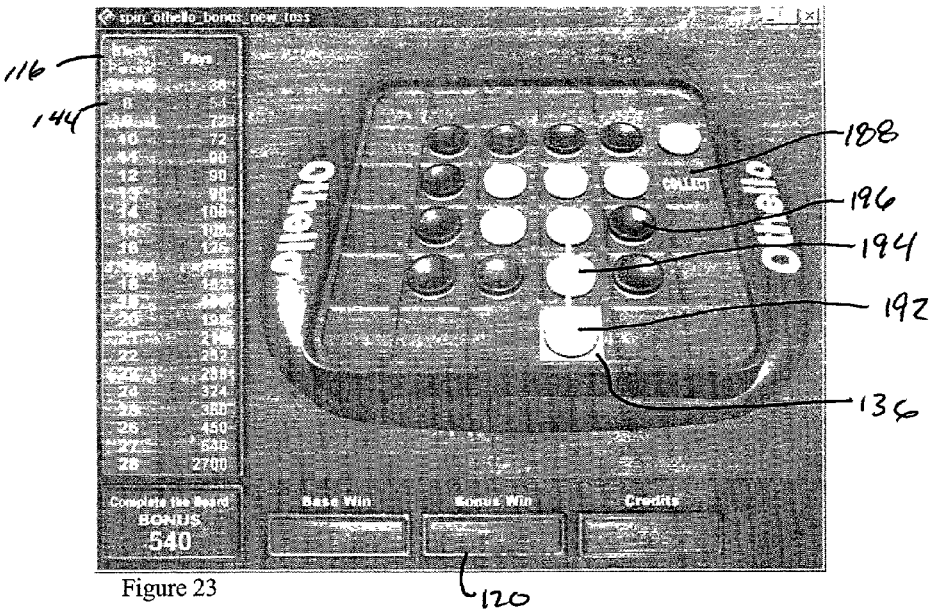

FIG. 23 shows one possible random selection of the nineteen remaining squares of FIG. 22. The chosen square 136 is highlighted and a new white piece 192 is added to the chosen square 136. The outflanked black piece 194 is then flipped to become a white piece. Additionally, the highlighted line 144 of the paytable 116 is updated to indicate that 54 credits have been won so far in the bonus game and the "Bonus Win" meter 120 indicates 54.

As a result of the placement of the new white piece 192, the square 188 marked "Collect" in FIG. 23 has become a legal move, because it may now outflank the black piece 196 in a diagonal manner. The bonus game recalculates which open squares are illegal moves, and displays a "Collect" label on any open squares that would be an illegal move while removing "Collect" labels from any squares that would be a legal move. Upon completing this recalculation, FIG. 24 shows that as a result of the new piece 192 placed in the square 136 on the bottom row and the flipping of the outflanked black piece 194 that all remaining open squares are determined to be legal moves and no "Collect" labels are displayed, including the square 188 that was marked "Collect" in FIG. 23.

The "reduction of peril" aspect described above is considered to be a novel feature where one step of a bonus round can result in less encouraging probabilities, but a subsequent step of the bonus round can result in more encouraging probabilities. This is illustrated by the square 188 labeled "Collect" in FIG. 22. The random selection of the next square has a one in 19 or 5.3% chance of ending the bonus round since the next open square chosen could be the square 188 that is labeled "Collect." By comparison, although there is one less open square (19-1) available in FIG. 24, there is no chance of ending the bonus round in selecting the next open square because no squares are labeled "Collect." Furthermore, if this square 188 is selected as the next square to place a new white piece, no additional squares will be labeled as "Collect" squares. Reviewing FIG. 24, a selection of any one of seven open squares 188, 198, 200, 202, 204, 208, and 210 of the game board for the next play will not result in any squares being labeled as "Collect" squares. Referring back to FIG. 8, only four open squares 198, 204, 210, 212 can be used to outflank the opponent's pieces that would not add a collect square (namely the four comer squares). FIG. 24 is a more favorable piece arrangement than the piece arrangement of the initial game board of FIG. 8. Due to the geometry and the rules of the game there are many situations where a player can get far into the bonus game with little or no peril on subsequent moves. In addition, there are many situations where there is less peril after a move than before it.

Figure 24:
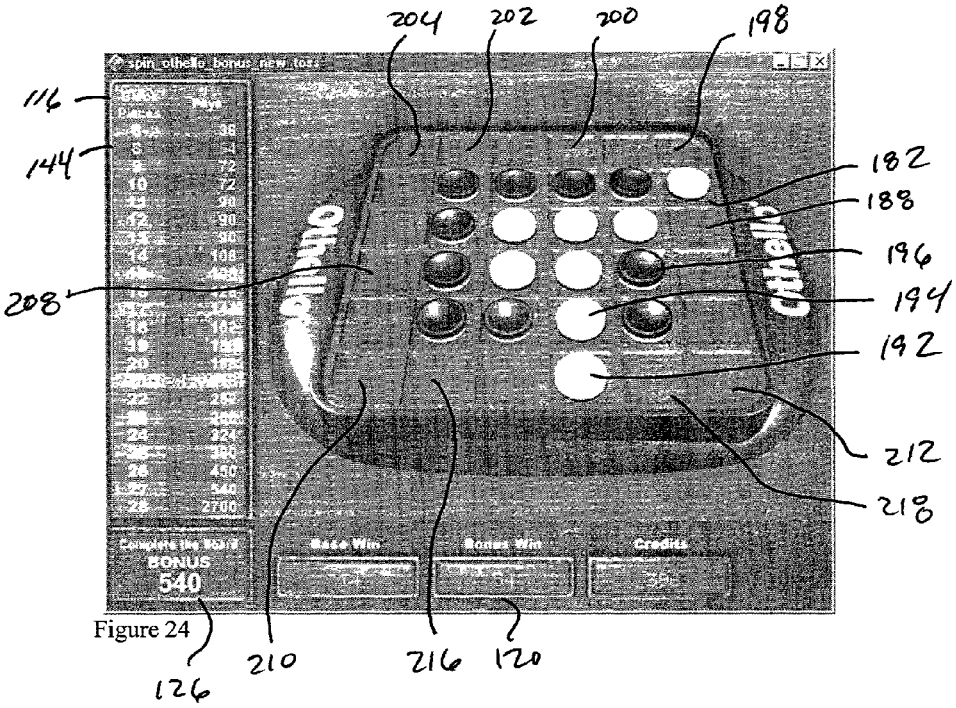

Referring to the bonus game paytable in FIG. 24, there is a large bonus of thirty times the player's total wager (30*18=540) for completing the board as shown in the "Completing The Board Bonus" meter 126. This bonus is awarded anytime the player is able to flip all of the opponent's pieces to the player's color. This award is in addition to the award from the paytable 116 for the number of pieces on the board matching the player's color. It should be noted that the board may be "completed" by placing as few as four pieces (which will result in twenty total pieces matching the player's color). One of the several possible ways to complete this is by placing the player pieces in squares 216, 202, 182, and 218 respectively. At the other extreme the board may be completed as a result of the placement of twelve pieces in which case a total of twenty-eight pieces will match the player's color. This is the most preferred result for the player in this example of play of the bonus game, and results in a very large award of 150 times the player's wager plus value of the "Completing The Board Bonus" meter 126. It will be shown in the analysis below that the board is completed once in about every 17.5 bonus games, however, because of the specific requirements for getting twenty-eight pieces on the board, this event is more than 100 times less likely, and therefore offers a much higher award.

In the above discussion of the Othello®-type bonus game, play of the game sometimes is described as completing a series of steps of play as "moves." Completion of a step may also be referred to as "making a move," placing a game element, making a selection, etc. These are alternatively named steps consistent with phases associated with game play. Such phases do not necessarily indicate or require an actual "movement" of a piece from one location or another.

Figure 25:
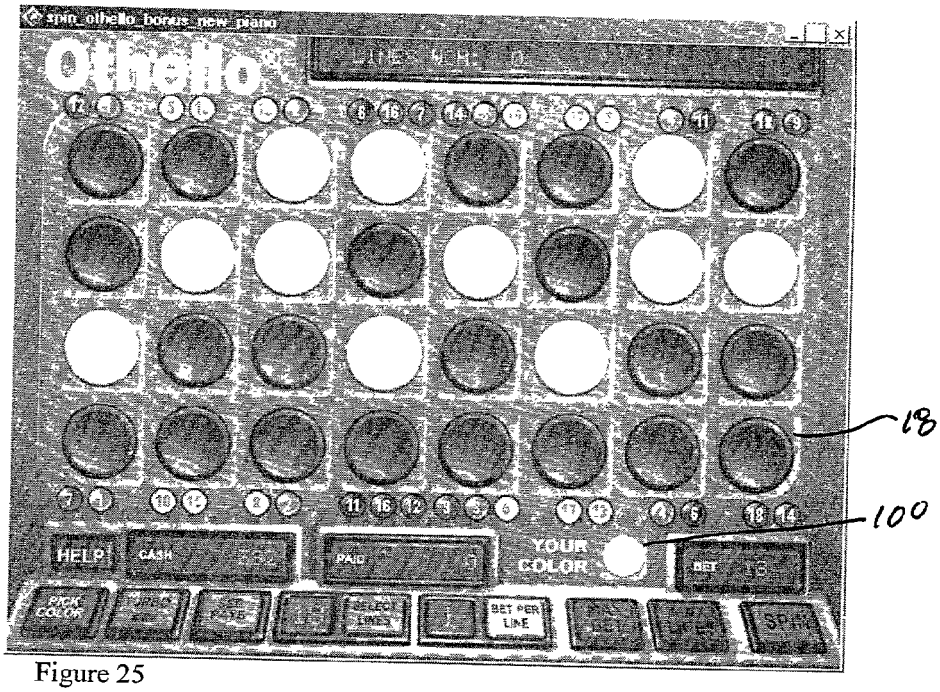
FIGS. 25 through 28 show game displays of an embodiment of the invention similar to that of, e.g., FIGS. 1 through 4.

Another embodiment of a bonus game of a related nature to the underlying game is shown in FIG. 25. In this embodiment, the bonus game is played when all eight pieces in a row (e.g., lead line 18) match the opponent's color. This is an award which is available in this version independently of the number of paylines played. In this embodiment it is meant to be a consolation type of award to make the player feel better, since the player selected the other color (see "Your Color" indicator 100). The consolation bonus round rewards the player for a rare event happening in the base game even though the event did not happen using pieces with the player's chosen color. This bonus game could be available instead of or in addition to the above bonus game and may be initiated by this losing-line scatter-type trigger or any other scatter or payline initiator. In another embodiment, the consolation bonus round is initiated when the first seven of the eight pieces in a row match the player's color (e.g., FIG. 28, lead lines 228, 230, 232, 222, 234, 224, and 226).

The possible winnings of the consolation bonus round are made smaller than the other bonus round described above, because the rare event did not happen using pieces with the player's chosen color. In this embodiment, the consolation bonus round allows the player to select three of eight symbols, each of which has a hidden value associated with it. It is envisioned that the hidden values are credit values. Additionally, the hidden values may include the word "ALL" to indicate the value of the particular symbol is the sum of the hidden values of the seven remaining symbols.

Figure 26:
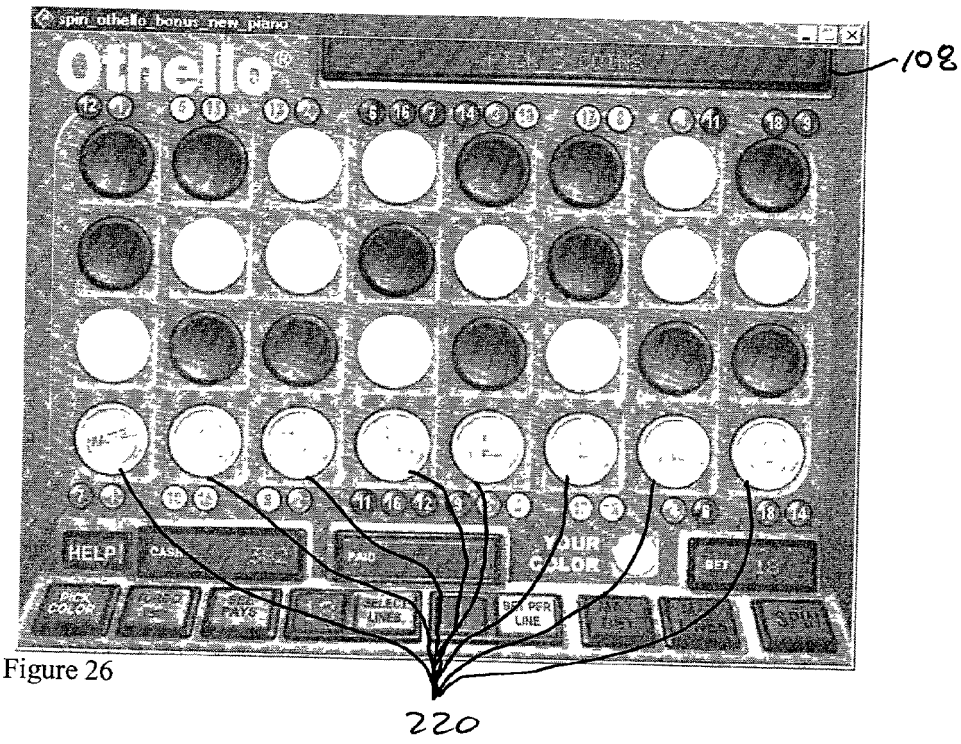

Accordingly, and with reference to FIG. 26, the eight black pieces on the particular row of pieces with the opponents color change to gold colored coins 220, and the display 108 directs the player to select ("Pick") three of the coins 220.

Figure 27:
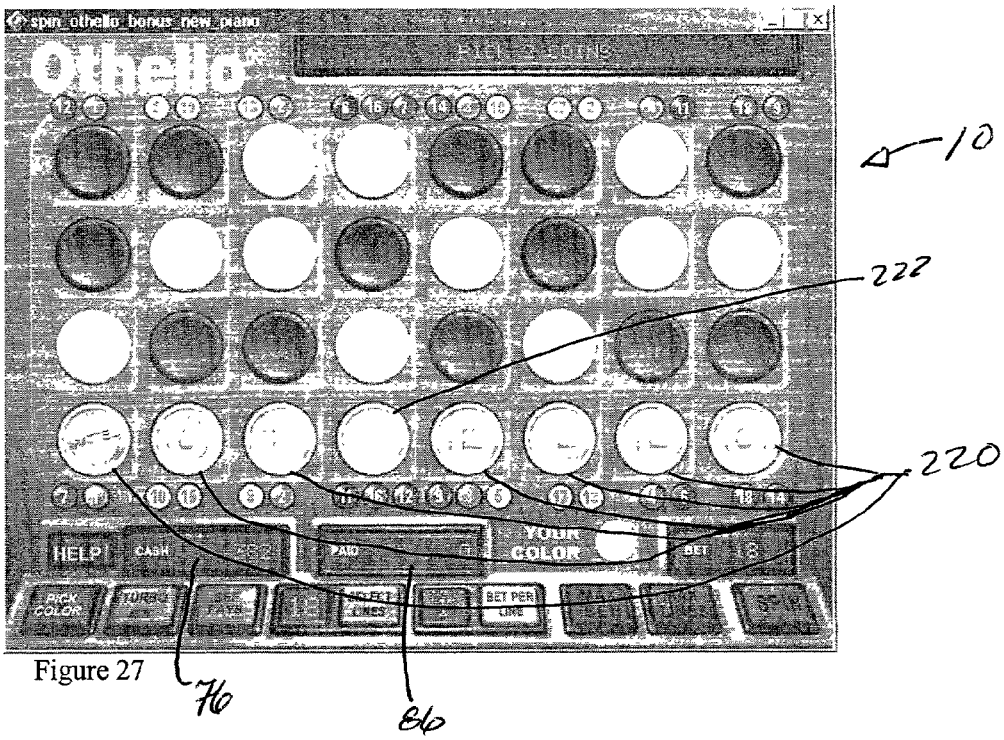

The player may use a touchscreen, mouse or other pointing device or a control panel button to select the three coins. FIG. 27 shows the screen 10 after the player has selected a gold coin 222. The hidden value of the selected gold coin 222 is revealed as a value of 36, indicating the player has won thirty-six credits for selecting this particular coin. The player repeats this process twice more. After the three coin selections are made, the CPU displays the total amount won in the "Paid" meter 86 and the total is added to the "Cash" meter 76.

Figure 28:
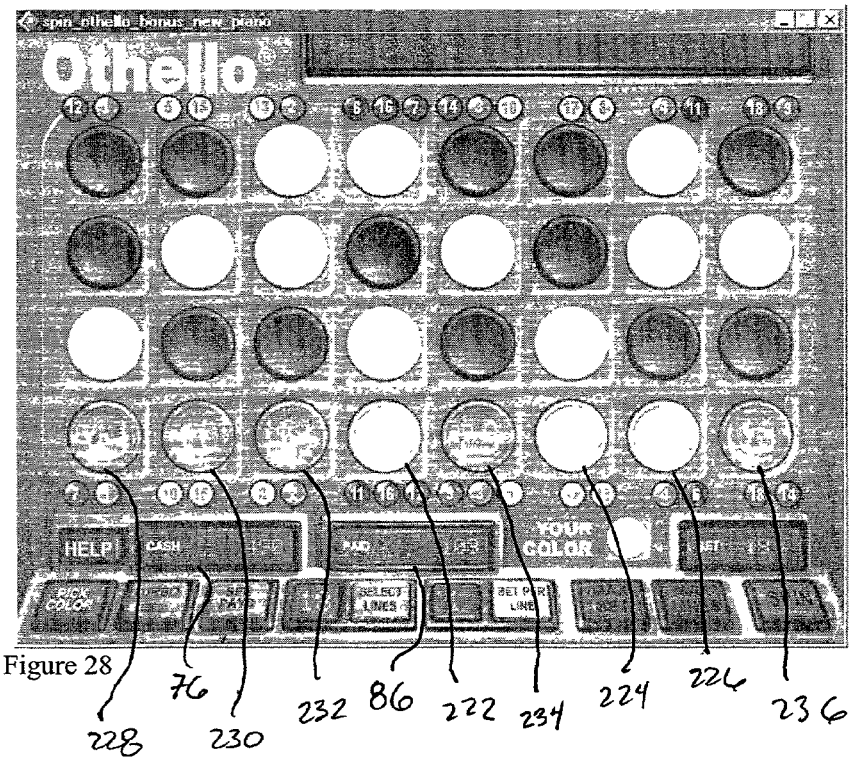

FIG. 28 shows the three gold coins 222, 224, 226 that the player selected for a total value of 108 credits or coins as indicated in the "Paid" meter 86. A brighter or highlighted coin indicates that the coin was selected by the player.

It is envisioned that the values associated with each of the gold coins not selected by the player may also be revealed after selection of the others has been made. In this case, the hidden values of coins not selected by the player are revealed. FIG. 28 reveals the coins not selected by the player that are the first three coins 228, 230, and 232, the fifth coin 234, (and the eighth) coin 236. The hidden values of these coins are "ALL," 18, 18, 36, and 18, respectively. If the player had chosen the first coin 228 with the hidden value of "ALL", the player would have won the sum of all the hidden values, which in this case would have been 198 coins or credits.

It will be understood that the foregoing self-described bonus games may themselves be adapted as a base or primary game. They have been described hereafter in a preferred form as adjuncts to another base game, but are not necessarily to be so limited in terms of scope of the invention. The operation of the bonus game of, e.g., FIGS. 8 through 20, while described as being totally driven by the CPU, need not exclude player input, however, as by selection of a move to make. Thus, the game could include player selection of a piece and its move, whether throughout the entire game or only at a designated point in the game.

The programming for certain embodiments described above is operationally summarized in the flow charts of FIGS. 29 through 48. FIG. 29 generally describes a main loop 300 of the Othello®-type game program. First in step 302, the program proceeds to read one or more switches that register if any coins, dollar bills, credit cards, etc. were inserted in the gaming machine. Next, a check is made as to whether the player has inserted any coins, dollar bills, credit cards, etc. at step 304. If so, then at step 306 the coins, bills, or credit cards are processed, registered, and displayed on the "Cash" meter 76 (e.g., FIG. 2). After step 306, the program proceeds to complete a "Set Button Active/Inactive States" subroutine, described hereinafter, to activated any buttons of the gaming machine needed for initiation of play at step 308. In one embodiment, the buttons that are activated include the "Help" button 72, the "Pick Color" button 74, the "See Pays" button 80, the "Select Lines" button 84, the "Bet Per Line" button 90, the "Max Bet" button 92, the "Max Lines" button 94, and the "Spin" button 96 (e.g., FIG. 2). Other embodiments may include additional buttons that will also be activated, such as a "Turbo" button 78 that can speed up the response time of the game. This causes the audio and video presentation of the "spin" and/or bonus round play to occur faster for players that wish to play faster. This is well known to those skilled in the art. Referring back to step 304, if the player had not entered any coins, dollar bills, credit cards, etc. into the gaming machine, the program would have proceeded directly to step 308.

After the program returns from the "Set Button Active/Inactive States" subroutine, the program reads any active buttons of the gaming machine in step 310. In step 312, a determination is made of whether the player actuated any active buttons. If the player did not actuate any of the active buttons, the program returns to complete step 302 again. If the player did actuate one of the active buttons, the program proceeds to complete a subroutine associated with the particular active button.

If the player actuates the "Help" button 72 (e.g. FIG. 2), the program proceeds to complete a "Display Help Screen" subroutine, described hereinafter, at step 314. After the program returns from the "Display Help Screen" subroutine, the program returns to the main loop 300 to complete step 302.

If the player actuates the "See Pays" button 80, the program calls a "Display Paytable Screen" subroutine, described hereinafter, at step 316. After the program returns from the "Display Paytable Screen" subroutine, the program returns to the main loop 300 to complete step 302.

If the player actuates the "Pick Color" button 74, the program proceeds to complete a "Switch Picked Color" subroutine, described hereinafter, at step 318. After the program returns from the "Switch Picked Color" subroutine, the program again returns to the main loop 300 to complete step 302.

If the player actuates the "Bet Per Line" button 90, the program calls an "Increment Bet Per Line" subroutine, described hereinafter, at step 320. After the program returned from the "Increment Bet Per Line" subroutine, the program returns to the main loop 300 to complete step 302.

If the player actuates the "Select Lines" button 84, the program proceeds to complete an "Increment Select Lines" subroutine, described hereinafter, at step 322. After the program returns from the "Increment Select Lines" subroutine, the program returns to complete step 302 of the main loop 300.

If the player actuates the "Max Lines" button 94, the program proceeds to complete a "Set Maximum Lines" subroutine, described hereinafter, at step 324. After the program returns from the "Set Maximum Lines" subroutine, the program returns to the main loop 300 to complete step 302.

If the player actuates the "Spin" button 96, the program proceeds to complete a "Play A Spin" subroutine, described hereinafter, at step 326. Note, however, that the amount wagered per line, the number of lines wagered, and the total amount bet used in the previous game are kept as default values for the next game. Therefore, if a player actuates the "Spin" button 96 without changing these values, the game will use the default values from the previous game. After the program returns from the "Play A Spin" subroutine, the program goes to step 328 and determines if a bonus earned state was set in the "Play A Spin" subroutine. If the bonus earned state was not set in the "Play A Spin" subroutine, then the program proceeds to complete step 330. In step 330, the program updates the "Cash" meter 76 and "Paid" meter 86, as in a "bang up" fashion, if appropriate. After step 330 is completed, the program proceeds back the beginning of the main loop 300 ready to complete step 302.

Returning back to step 328, if the bonus earned state was set in the "Play A Spin" subroutine, the program proceeds to call a "Play Bonus Game" subroutine, described hereinafter, at step 332. After completion of the "Play Bonus Game" subroutine, the program again proceeds back to the beginning of the main loop 300 ready to complete step 302.

The player has the option of skipping all of the line and coins-per-line selections, by actuating a "Max Bet" button 92. If the player actuates the "Max Bet" button 92, the program calls a "Set Maximum Bet" subroutine, described hereinafter, at step 334. After the program returns from the "Set Maximum Bet" subroutine, the program calls the "Play a Spin" subroutine of step 326 and continues from there as described previously. It will be understood that the foregoing sequence of button actuations need not be completed as a whole or follow the order indicated, but are available for use by the player when the specific buttons are active.

FIG. 30 depicts the steps of the "Set Button Active/Inactive States" subroutine of step 308 of FIG. 29. In step 336 of this subroutine, the program determines if the program is in the middle of a turn or spin of either the base game or the bonus game. If it is not in the middle of a turn or spin of either the base game or the bonus game, the program proceeds to step 338 and enables the "Help" button 72 and the "See Pays" button 80 on the gaming machine. After step 338 is completed, the program verifies if any credits are registered on the gaming machine in step 340. If credits are registered on the gaming machine, the program enables the "Pick Color" button 74, the "Bet Per Line" button 90, the "Select Lines" button 84, the "Max Bet" button 92, and the "Spin" button 96 in step 342. In step 344, the program determines if eighteen or more credits are registered on the gaming machine. If so, the program enables the "Max Lines" button 94 in step 346. After completion of step 346, the program returns to the main loop 300 of FIG. 29 to complete step 310.

Referring back to step 344, if the program determines that less than eighteen credits are registered on the gaming machine, the program returns to the main loop 300 of FIG. 29 to complete step 310, thus avoiding step 346.

Referring back to step 340, if the program determines that no credits are registered on the gaming machine, the program disables "Pick Color" button 74, the "Bet Per Line" button 90, the "Select Lines" button 84, the Max Lines"button 94, the "Max Bet" button 92, and the "Spin" button 96 in step 348. After completion of step 348, the program returns to the main loop 300 of FIG. 29 to complete step 310.

Returning back to step 336, if the program is in the middle of a turn or spin of either the base game or the bonus game, the program disables the "Help" button 72, the "See Pays" button 80, the "Pick Color" button 74, the "Bet Per Line" button 90, the "Select Lines" button 84, the "Max Lines" button 94, the "Max Bet" button 92, and the "Spin" button 96 in step 350. After completion of step 350, the program returns to the main loop 300 of FIG. 29 to complete step 310.

Figure 31:
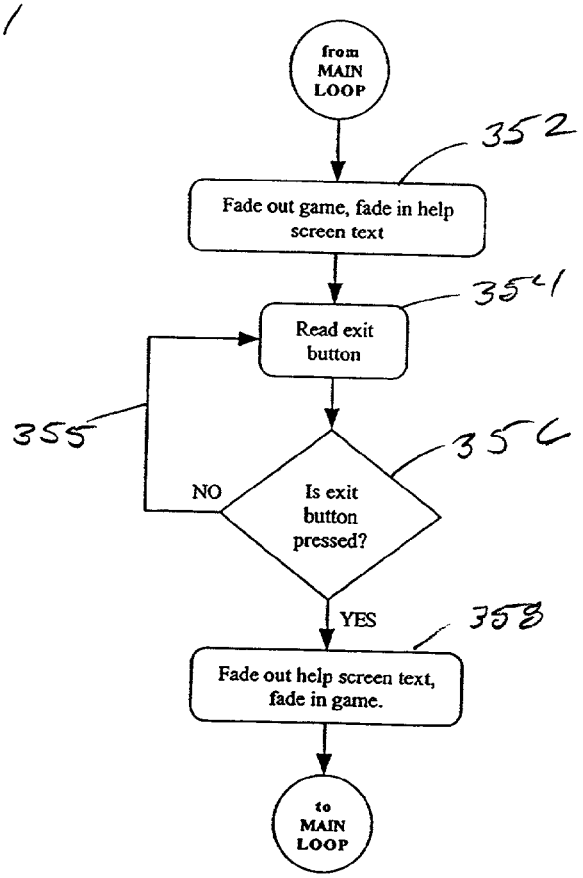

FIG. 31 depicts the "Display Help Screen" subroutine of step 314 of FIG. 29. When the "Display Help Screen" subroutine is initiated, the program suspends the game, fades out the game on the screen 10, fades in a Help Display (not shown), and enables an "Exit" Button 112 (e.g. FIG. 5) in step 352. Next, the program proceeds to read the "Exit" button 112 at step 354. A determination is made of whether the "Exit" button 112 has been actuated by the player at step 356. If the "Exit" button 112 has not been actuated, the program returns to step 354 and cycles through a loop 355 until the player actuates the "Exit" button 112.

If the program determines that the "Exit" button 112 was actuated in step 356, the program fades out the Help Display and fades in the game on the screen 10 in step 358. Once step 358 is completed, the program returns to the main loop 300 of FIG. 29 at step 302 and reads the coin, bill, and credit card switches.

Figure 32:
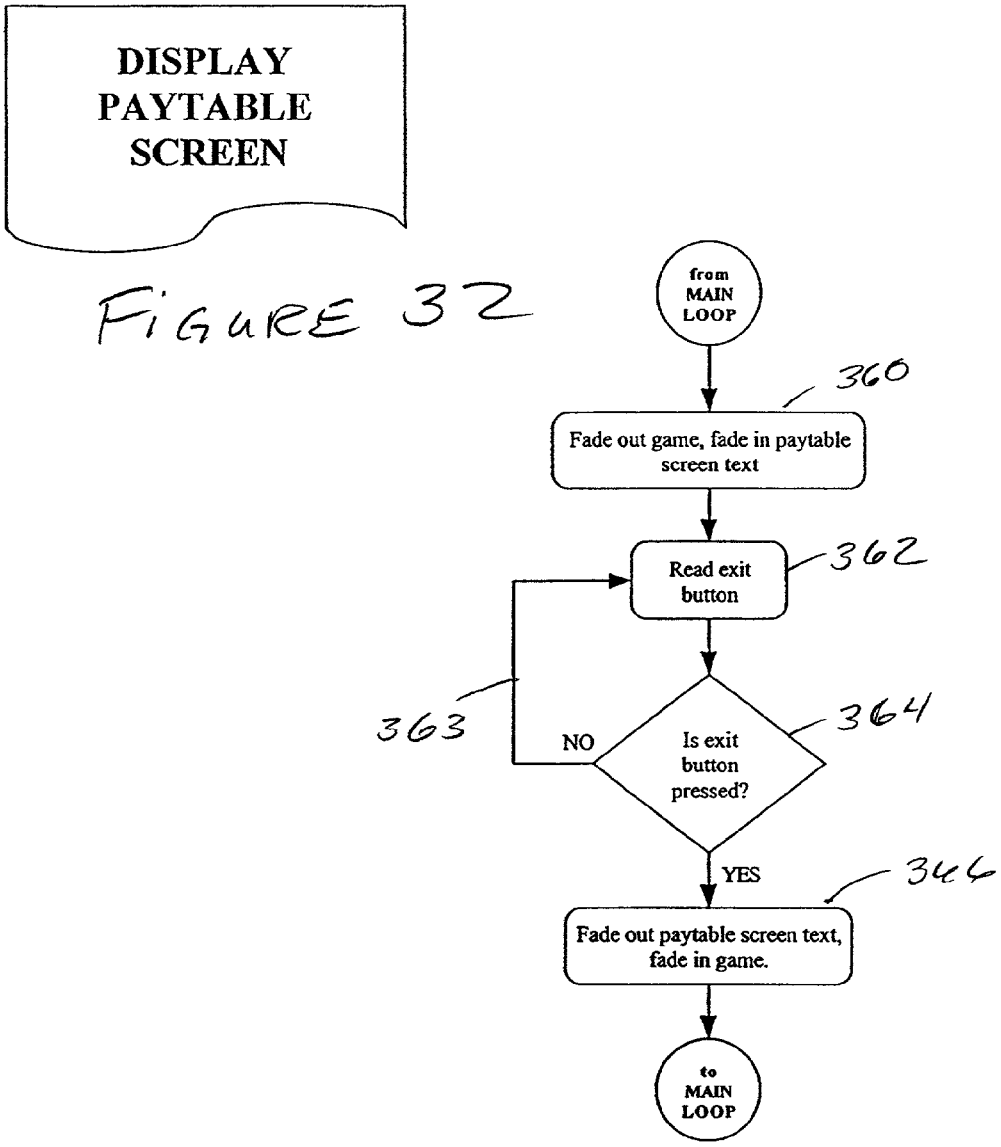

FIG. 32 depicts the "Display Paytable Screen" subroutine of step 316 of FIG. 29. When the "Display Paytable Screen" subroutine is initiated, the program suspends the game, fades out the game on the screen 10, fades in a Paytable Display 110 (e.g., FIG. 5) and enables the "Exit" Button 112 (e.g., FIG. 5) in step 360. Next, the program proceeds to read the "Exit" button 112 at step 362. In step 364, a determination is made of whether the "Exit" button 112 has been actuated by the player. If the "Exit" button 112 has not been actuated, the program returns to complete step 362 and cycles through a loop 363 until the player actuates the "Exit" button 112.

If the program determines that the "Exit" button 112 was actuated in step 364, the program fades out the Paytable Display 110 and fades in the game on the screen 10 in step 366. Once step 366 is completed, the program returns to the main loop 300 of FIG. 29 to complete step 302.

Figure 33:
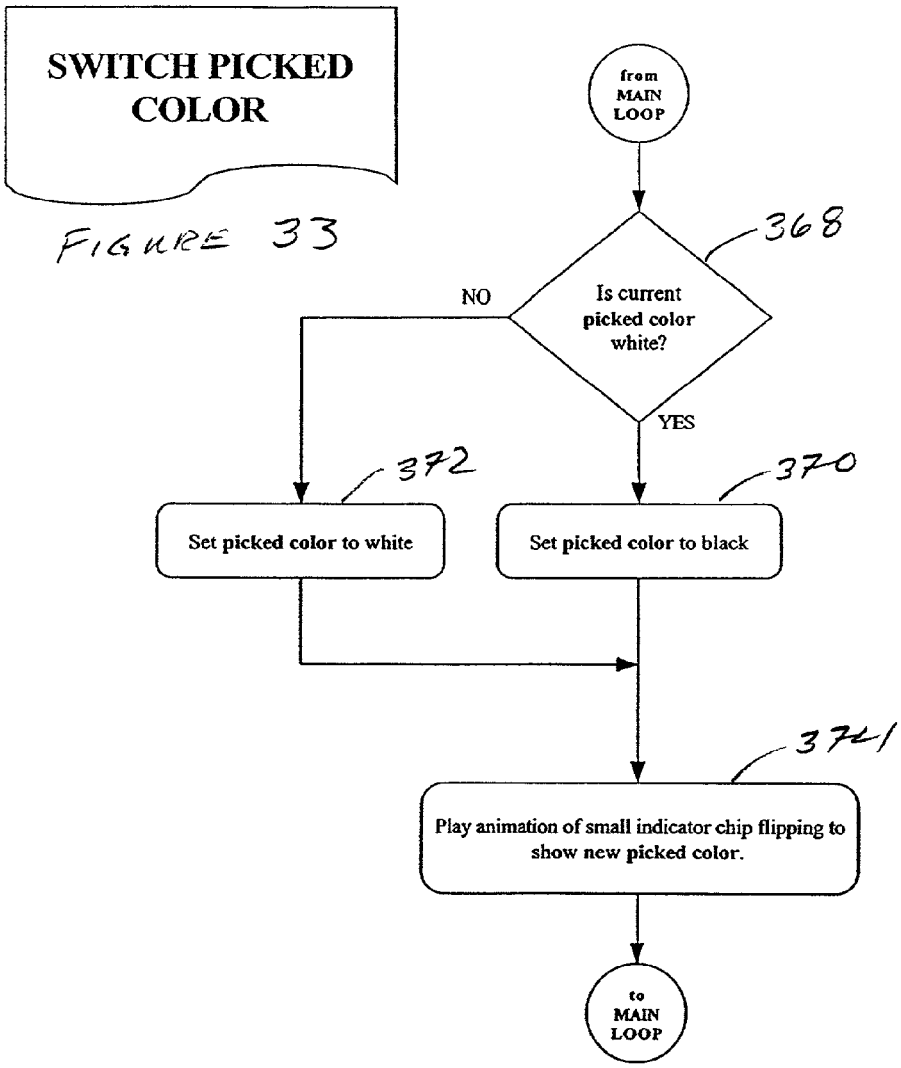

FIG. 33 illustrates the "Switch Picked Color" subroutine of step 318 of FIG. 29. When the "Switch Picked Color" subroutine is initiated, the program determines if a "Picked Color" variable is set to white in step 368. If the "Picked Color" variable is set to white, the program resets the "Picked Color" to black in step 370. Alternatively, if the program determines that the "Picked Color" variable is not set to white in step 368, the program sets the "Picked Color" variable to white in step 372. After completion of either step 370 or step 372, the program initiates an animation of an indicator chip being flipped to reveal the color of the current "Picked Color" variable in step 374. Once step 374 is completed, the program returns to the main loop 300 of FIG. 29 to complete step 302.

Figure 34:
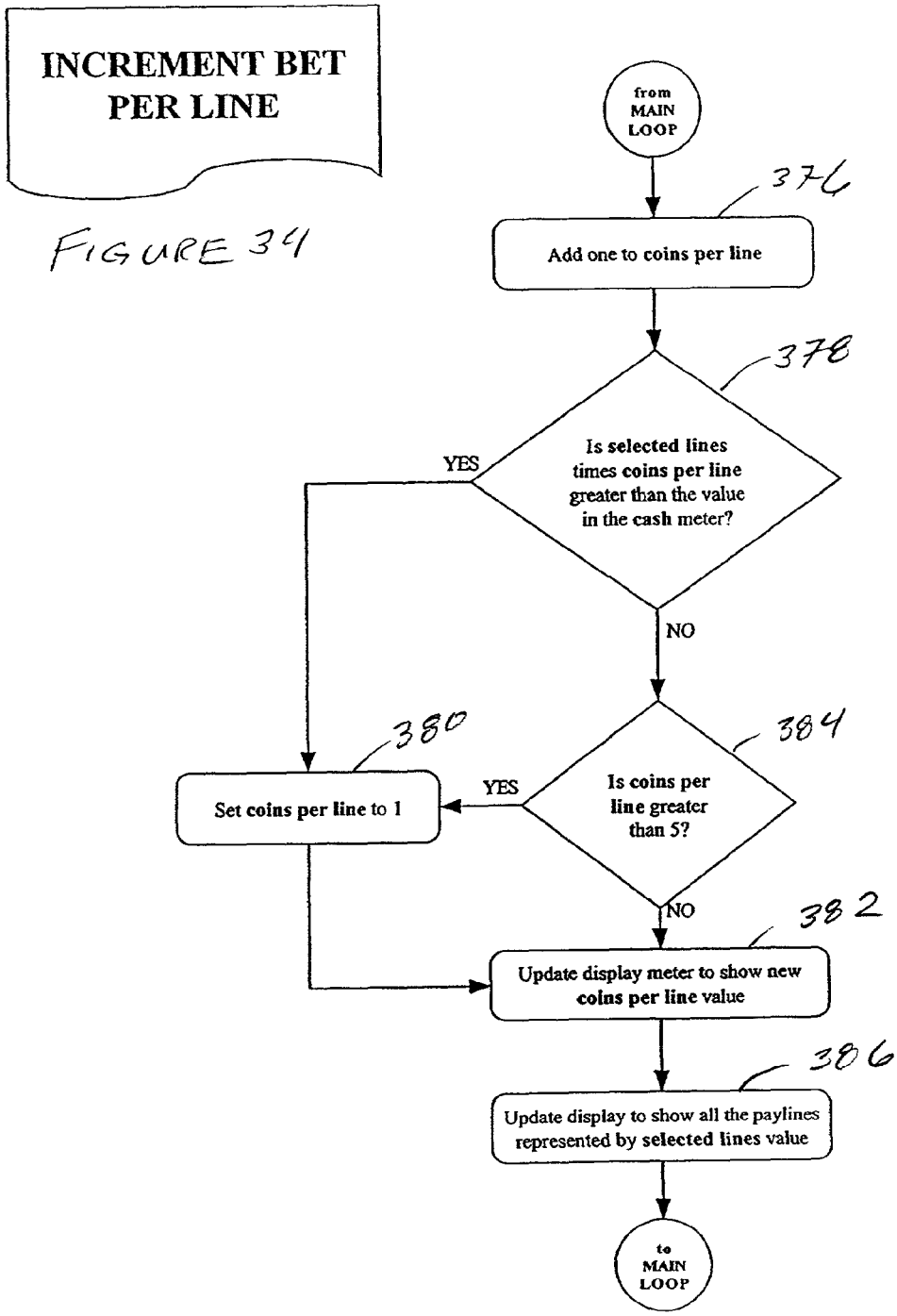

FIG. 34 illustrates the steps of the "Increment Bet Per Line" subroutine of step 320 of FIG. 29. First, the program increments or increases a "Coins Per Line" variable by one credit in step 376. A determination is then made in step 378 of whether a "Selected Lines" variable multiplied by the "Coins Per Line" variable is greater than number displayed in the "Cash" meter 76 (e.g., FIG. 2). If the "Selected Lines" variable multiplied by the "Coins Per Line" variable is greater than number displayed in the "Cash" meter 76, the program sets the "Coins Per Line" variable to one in step 380. After step 380 is completed, the program updates the "Bet Per Line" meter 88 to display the new value of the "Coins Per Line" variable in step 382.

Referring back to step 378, if the "Selected Lines" variable multiplied by the "Coins Per Line" variable is not greater than number displayed in the "Cash" meter 76, the program proceeds to step 384 and determines if the "Coins Per Line" variable is greater than five. If the "Coins Per Line" variable is greater than five, the program proceeds to step 380 and continues on from there as previously described. If the "Coins Per Line" variable is not greater than five, the program proceeds to step 382.

Once step 382 is completed, the program proceeds to step 386 and updates the screen 10 (e.g., FIG. 1) to indicate all of the paylines that are being wagered upon by the player as represented by the "Selected Lines" variable. Once step 386 is completed, the program returns to the main loop 300 of FIG. 29 to complete step 302.

Figure 35:
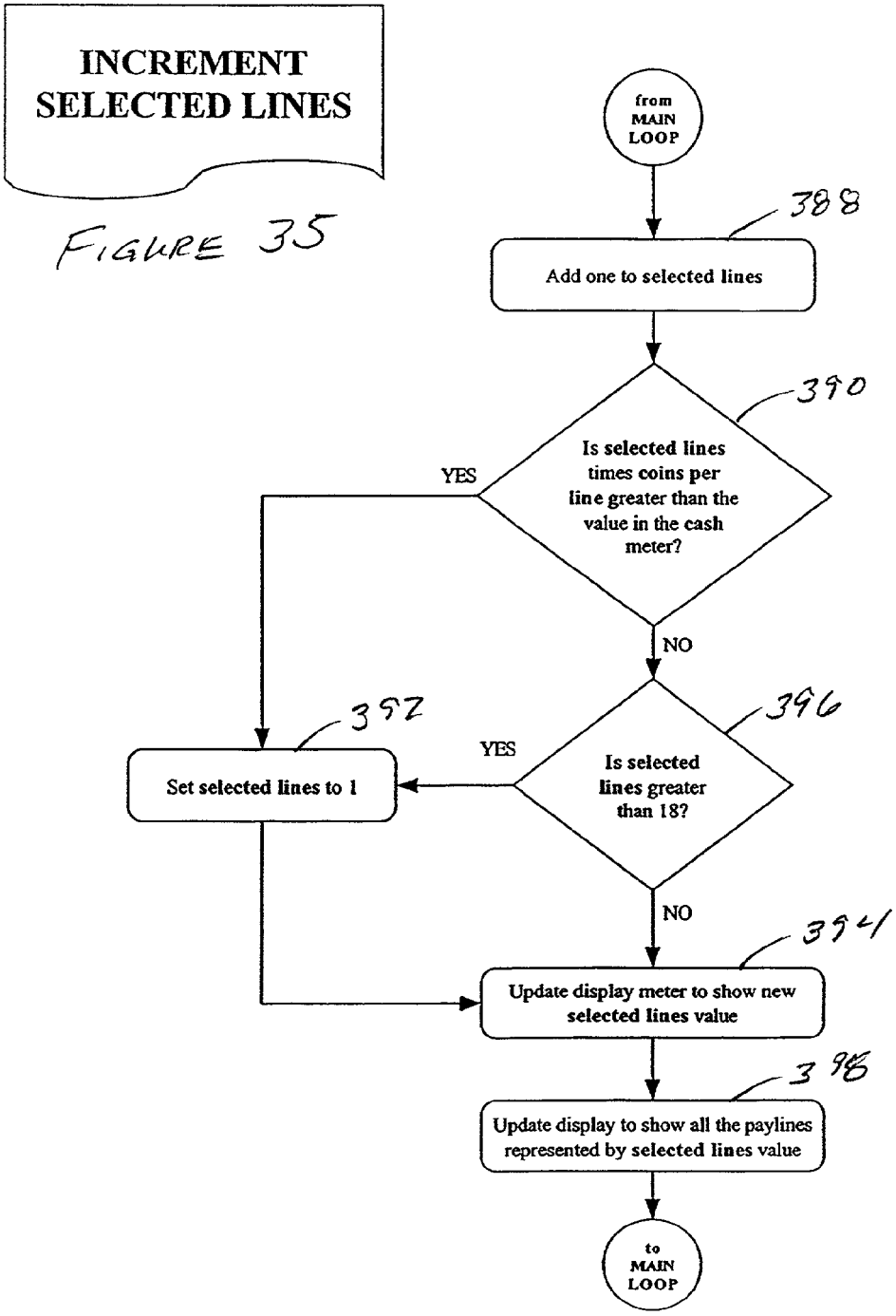

FIG. 35 illustrates the steps of the "Increment Selected Lines" subroutine of step 322 of FIG. 29. First, the program increments or increases the "Selected Lines" variable by one credit in step 388. A determination is made in step 390 of whether the "Selected Lines" variable multiplied by the "Coins Per Line" variable is greater than number displayed in the "Cash" meter 76 (e.g., FIG. 1). If the "Selected Lines" variable multiplied by the "Coins Per Line" variable is greater than number displayed in the "Cash" meter 76 (e.g., FIG. 1), the program sets the "Selected Lines" variable to one in step 392. After step 392 is completed, the program updates the "Lines Selected" meter 82 to display the new value of the "Selected Lines" variable in step 394.

Referring back to step 390, if the value of the "Selected Lines" variable multiplied by the value of the "Coins Per Line" variable is not greater than number displayed in the "Cash" meter 76 (e.g., FIG. 1), the program proceeds to step 396 and determines if the "Selected Lines" variable is greater than eighteen. If the "Selected Lines" variable is greater than eighteen, the program proceeds to step 392 and continues on from there as previously described. If the "Selected Lines" variable is not greater than eighteen, the program proceeds to step 394.

Once step 394 is completed, the program proceeds to step 398 and updates the screen 10 (e.g., FIG. 1) to indicate all of the paylines that are being wagered upon by the player as represented by the "Selected Lines" variable. Once step 398 is completed, the program returns to the main loop 300 of FIG. 29 to complete step 302.

Figure 36:
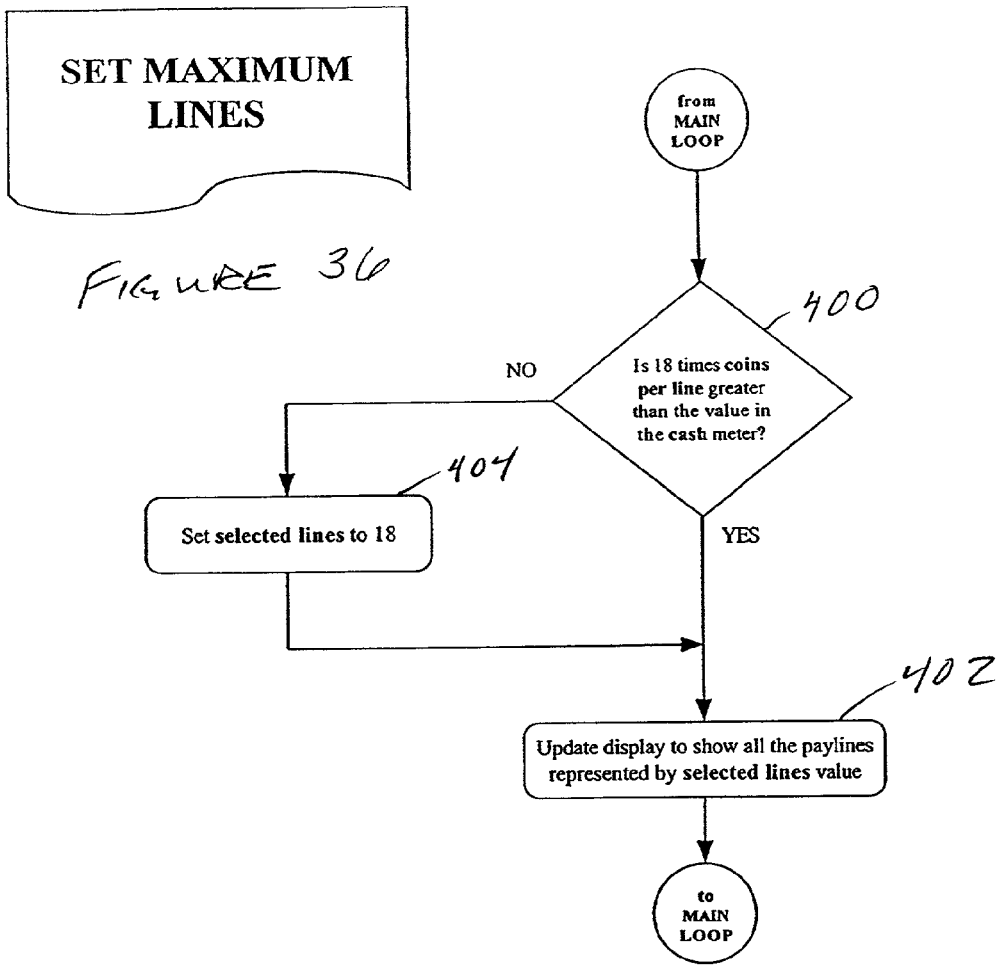

FIG. 36 depicts the steps of the "Set Maximum Lines" subroutine of step 324 of FIG. 29. This subroutine starts with step 400 and a determination is made of whether eighteen multiplied by the value of the "Coins Per Line" variable is greater than number displayed in the "Cash" meter 76. If eighteen multiplied by the value of the "Coins Per Line" variable is greater than number displayed in the "Cash" meter 76 (e.g., FIG. 2), the program proceeds to step 402, keeps the current value of the "Selected Lines" variable, and updates the screen to show the currently selected lines.

Referring back to step 400, if eighteen multiplied by the value of the "Coins Per Line" variable is not greater than value displayed in the "Cash" meter 76, the program proceeds to step 404 and sets the value of the "Selected Lines" variable to eighteen. Once step 404 is complete, the program proceeds to step 402 as previously described and updates the screen as needed. Once step 402 is completed, the program returns to the main loop 300 of FIG. 29 to complete step 302.

Figure 37:
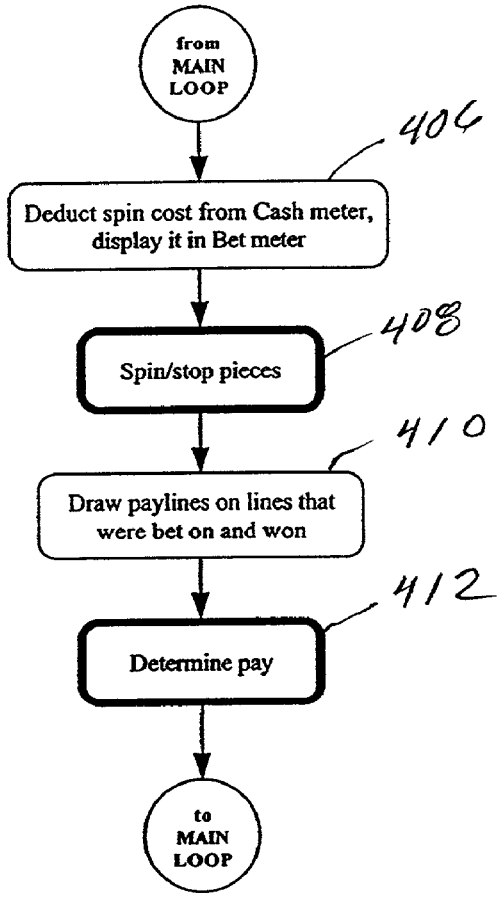

FIG. 37 illustrates the steps of the "Play A Spin" subroutine of step 326 of FIG. 29. In step 406 the program determines a product of the "Selected Lines" variable multiplied by the "Coins Per Line" variable. The value of the "Cash" meter 76 is then reduced by the product of the "Selected Lines" variable multiplied by the "Coins Per Line" variable. Step 406 concludes by updating the "Bet" meter 98 to display the value of the product. The program then calls a "Spin/Stop Pieces" subroutine, described hereinafter, in step 408. After the program has returned from the "Spin/Stop Pieces" subroutine, the program determines any winning paylines for the lines that the player wagered upon and highlights the winning paylines on the screen 10 in step 410. Next in step 412, the program calls a "Determine Pay" subroutine, described hereinafter, to determine what winnings, if any, were won by the player in the base game. When the program returns form the "Determine Pay" subroutine, the program returns to the main loop routine of FIG. 29 to complete step 328.

Figure 38:
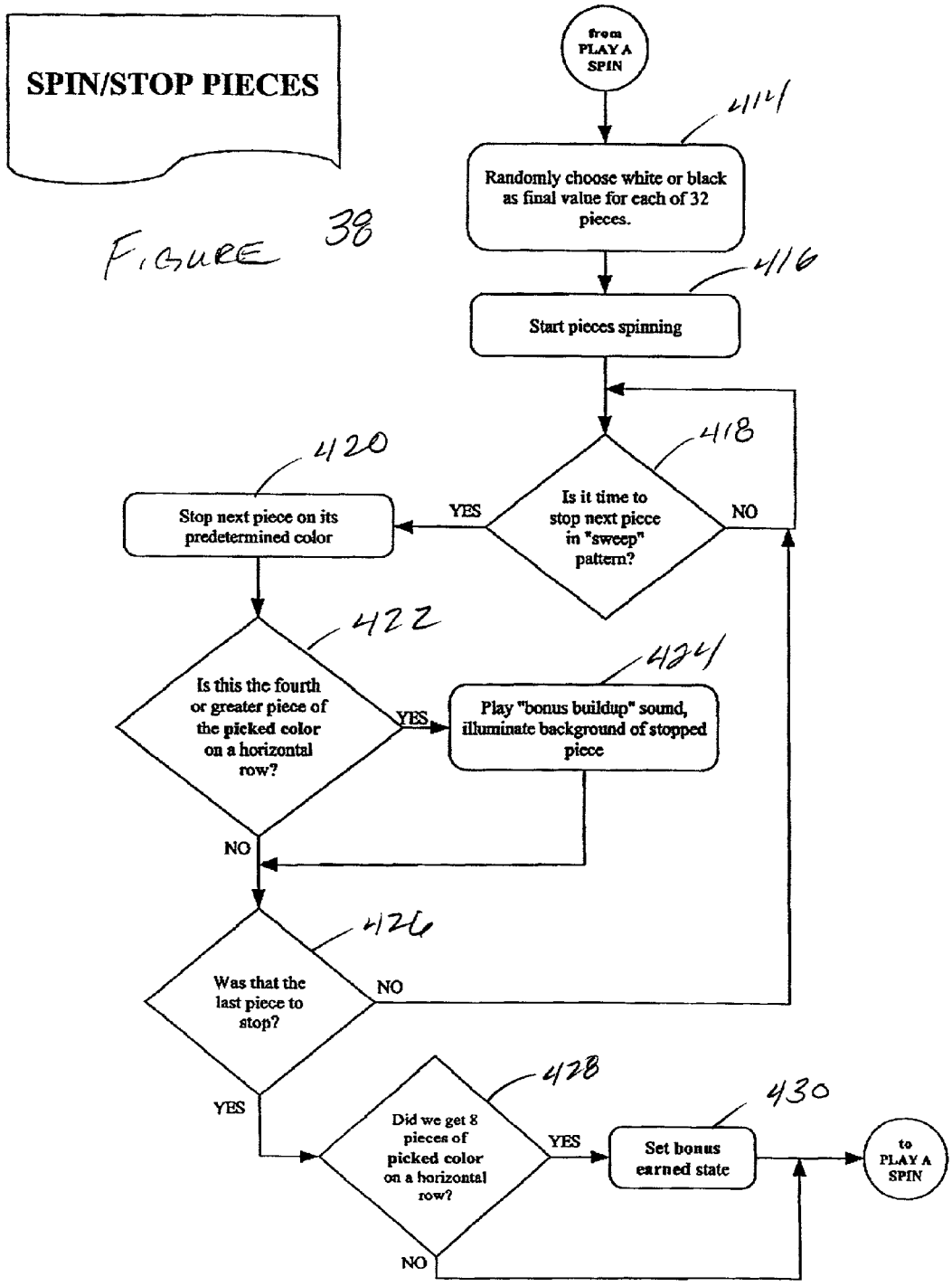

FIG. 38 illustrates the steps of the "Spin/Stop Pieces" subroutine of step 408 of FIG. 37. First the program randomly selects black or white as a final piece position for each of the thirty-two pieces in step 414. In step 416, the program initiates a spinning display of the thirty-two pieces on the screen 10 (e.g., FIG. 3). In step 418, the program determines if it is time to stop the piece that is to be stopped next in a sweep pattern. If it is not time to stop the next spinning piece, the program loops back to complete step 418 again. If it is time to stop the next spinning piece, the program advances to step 420 and stops the spinning piece in the final piece position for that particular piece as determined in step 414.

In step 422, the program determines if the piece that was just stopped is the fourth or more consecutive piece matching the player's color in the row that the piece resides within. If so, the program initiates a "bonus buildup" sound and illuminates the background of consecutively colored piece in the row at step 424.

After step 424 is completed or if the piece that was just stopped was not the fourth or more consecutively picked color-stopped piece in the row, the program advances to complete step 426. In step 426, the program determines if the piece that was stopped was the last or thirty-second piece spinning to stop. If the stopped piece was not the last spinning piece to stop, the program loops back to complete step 418 for the next spinning piece that is to be stopped. If the stopped piece was the last spinning piece to stop, the program determines in step 428 if any of the four horizontal rows have all eight pieces with the player's color for their respective final piece position. If not, the program returns to complete step 410 of FIG. 37. However, if any of the four horizontal rows have all eight pieces with the player's color, the program sets the "bonus earned" state in step 430 and then returns to complete step 410 of FIG. 37.

Figure 39:
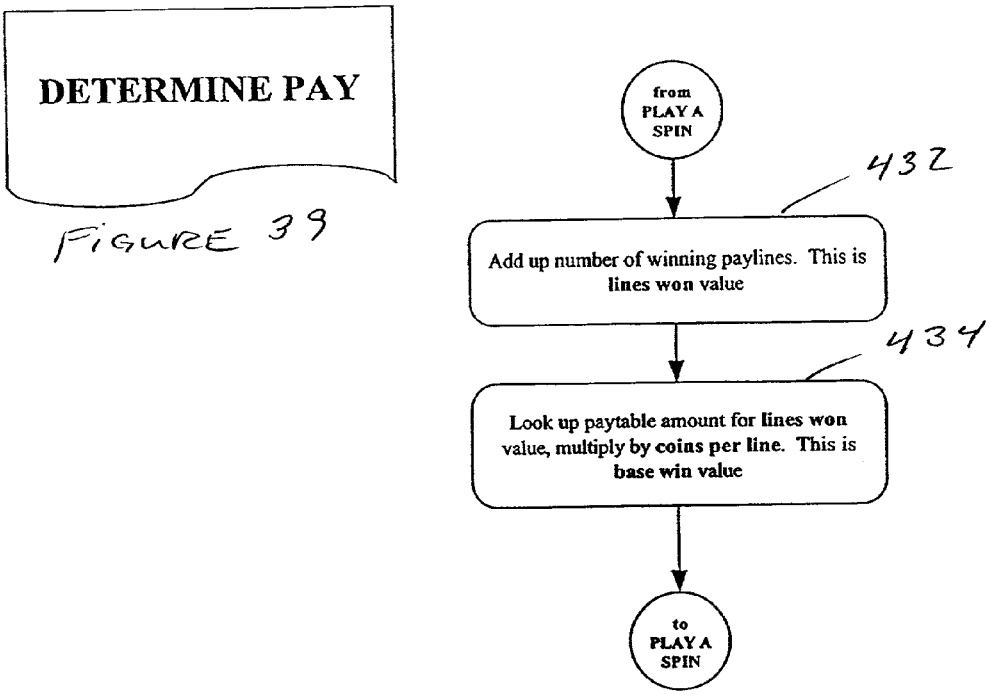

FIG. 39 depicts the steps of the "Determine Pay" subroutine of step 412 of FIG. 37. In this subroutine, the program adds up the number of winning paylines and sets a "Lines Won" variable to this value in step 432. In step 434, the program determines a value for a "Base Win" variable, if any. The "Base Win" variable is determined by multiplying the value of the "Lines Won" variable by the value of the "Coins Per Line" variable. After completion of step 434, the program returns back to the "Play A Spin" subroutine of FIG. 37 and further on back to complete step 328 of FIG. 29.

Figure 40:
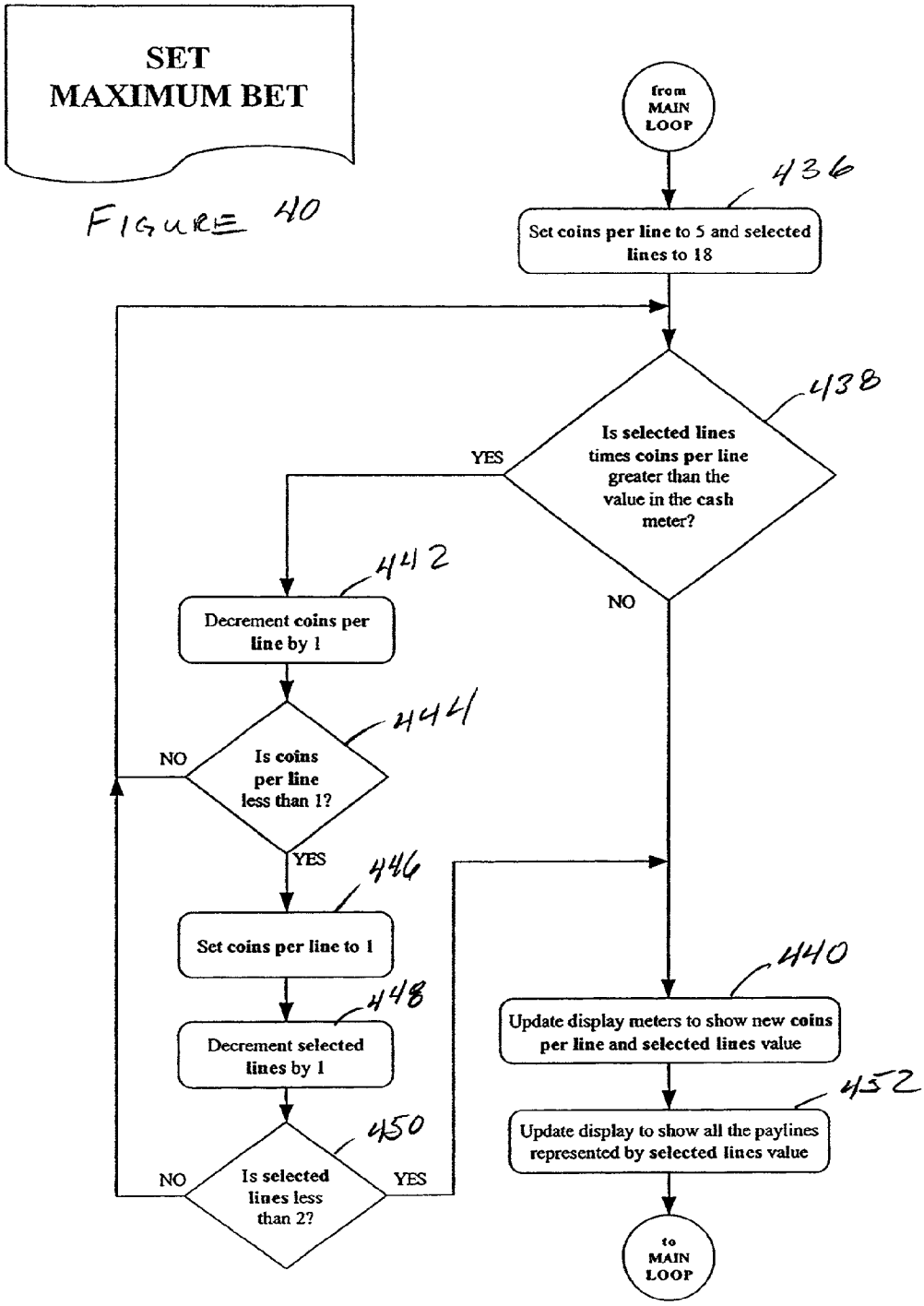

FIG. 40 illustrates the steps of the "Set Maximum Bet" subroutine of step 334 of FIG. 29. In step 436 the program sets the "Coins Per Line" variable to five and the "Selected Lines" variable to eighteen. In step 438, the program determines if the "Coins Per Line" variable multiplied by the "Select Lines" variable is greater than the amount displayed in the "Cash" meter 76. If not, the "Bet Per Line" meter 88 is set to five and the "Lines Selected" meter 82 is set to eighteen in step 440. Back in step 438, if the "Coins Per Line" variable multiplied by the "Select Lines" variable is greater than the amount displayed in the "Cash" meter 76, the program decreases the "Coins Per Line" variable by one in step 442. In step 444, the program checks if the "Coins Per Line" variable is less than one. If not, the program loops back to complete step 438 again and continues on from there. If the "Coins Per Line" variable is less than one, the "Coins Per Line" variable is set to one in step 446. In step 448 the "Select Lines" variable is decreased by one. In step 450, a check is made of whether the "Selected Lines" variable is less than two. If so, the program proceeds back to complete step 440 and continues from there. If the "Selected Lines" variable is not less than two, the program loops back to complete step 438 again and continues on from there.

Looking at step 440, once the "Bet Per Line" meter and the "Lines Selected" meter 82 are updated, the program updates the screen 10 to reflect all paylines represented by the "Selected Lines" variable in step 452. Once step 452 is complete, the program returns to perform step 326 of FIG. 29.

Figure 41:
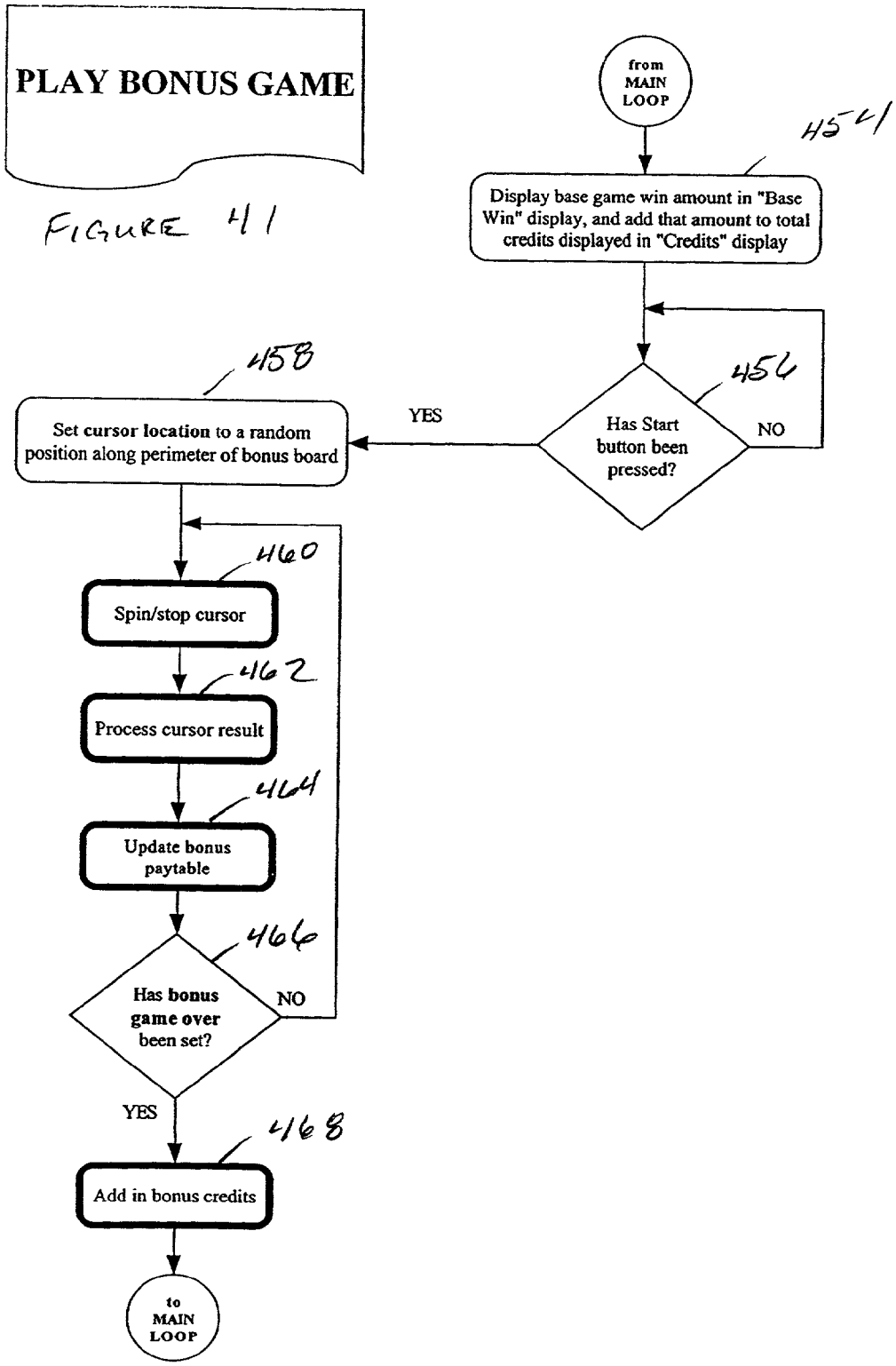

FIG. 41 illustrates the steps of the "Play Bonus Game" subroutine of step 332 of FIG. 29. In step 454, the program displays the amount won in the "Base Win" meter 118 as shown in FIG. 8. This base win amount is added to the credit (cash) meter 122 and displayed as shown in FIG. 8. Next, a determination is made as to whether the player has actuated the "Start Button" 124 in step 456. If the player has not actuated the "Start Button" 124, the program loops back to complete step 456 again. If the player has actuated the "Start Button" 124, the program sets a "Cursor Location" variable to a random location of one open square on the perimeter of the board game in step 458 as indicated in FIG. 9. In step 460, the program calls a "Spin/Stop Cursor" subroutine, described hereinafter. After the program has returned from the "Spin/Stop Cursor" subroutine, the program calls a "Process Cursor Result" subroutine, described hereinafter in step 462. After the program returns from the "Process Cursor Result" subroutine, the program calls an "Update Bonus Paytable" subroutine, described hereinafter, in step 464. After the program has returned from the "Update Bonus Paytable" subroutine, the program determines if a "Bonus Game Over" variable has been set in step 466. If the "Bonus Game Over" variable has not been set, the program loops back to complete step 460 again. If the "Bonus Game Over" variable has been set, the program calls an "Add In Bonus Credits" subroutine, described hereinafter, in step 468. Once the program has returned from the "Add In Bonus Credits" subroutine, the program returns to the main loop 300 of the program to complete step 302.

Figure 42:
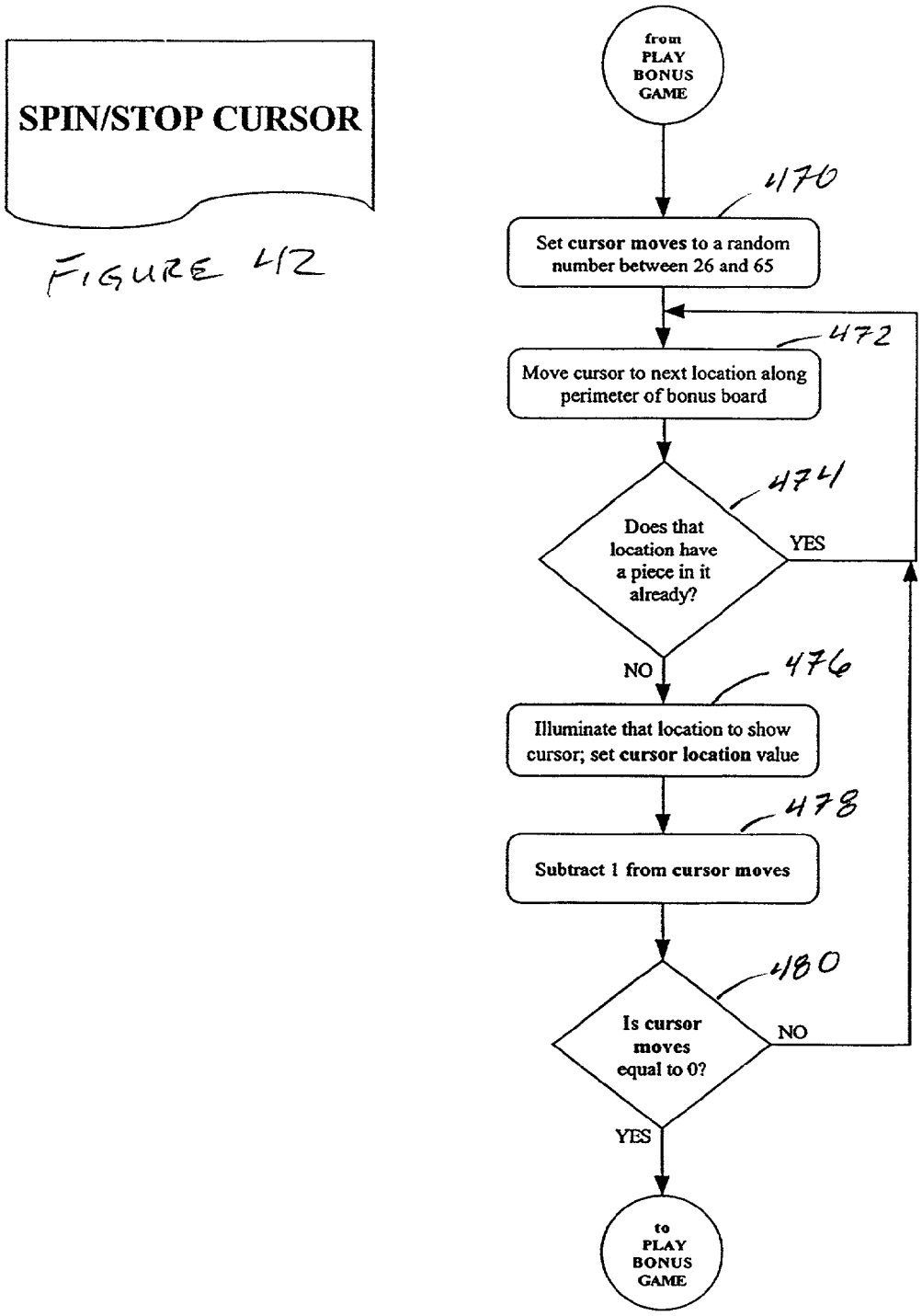

FIG. 42 describes the steps involved in the call of the "Spin/Stop Cursor" subroutine of step 460 of FIG. 41. In step 470, the program sets a "Cursor Moves" variable to a random integer between 26 and 65. Next, the program moves a cursor to the next square or location along the perimeter of the game board in step 472. The program then makes a determination as to whether this square or location is occupied by a piece or if the square is an open square in step 474. If the square is occupied by a piece, then the program loops back to complete step 472 again. If the square is an open square and is not occupied by a piece, the program continues on to step 476 and illuminates the square to show the cursor in this square and sets the "Cursor Location" variable to represent this square. Next in step 478, the program subtracts one from the current value of the "Cursor Moves" variable. A determination is made in step 480 whether the "Cursor Moves" variable is equal to zero. If the "Cursor Moves" variable is not equal to zero, the program loops back to complete step 472 again. If the "Cursor Moves" variable is equal to zero, the program returns to the "Play Bonus Game" subroutine to complete step 462.

Figure 43:
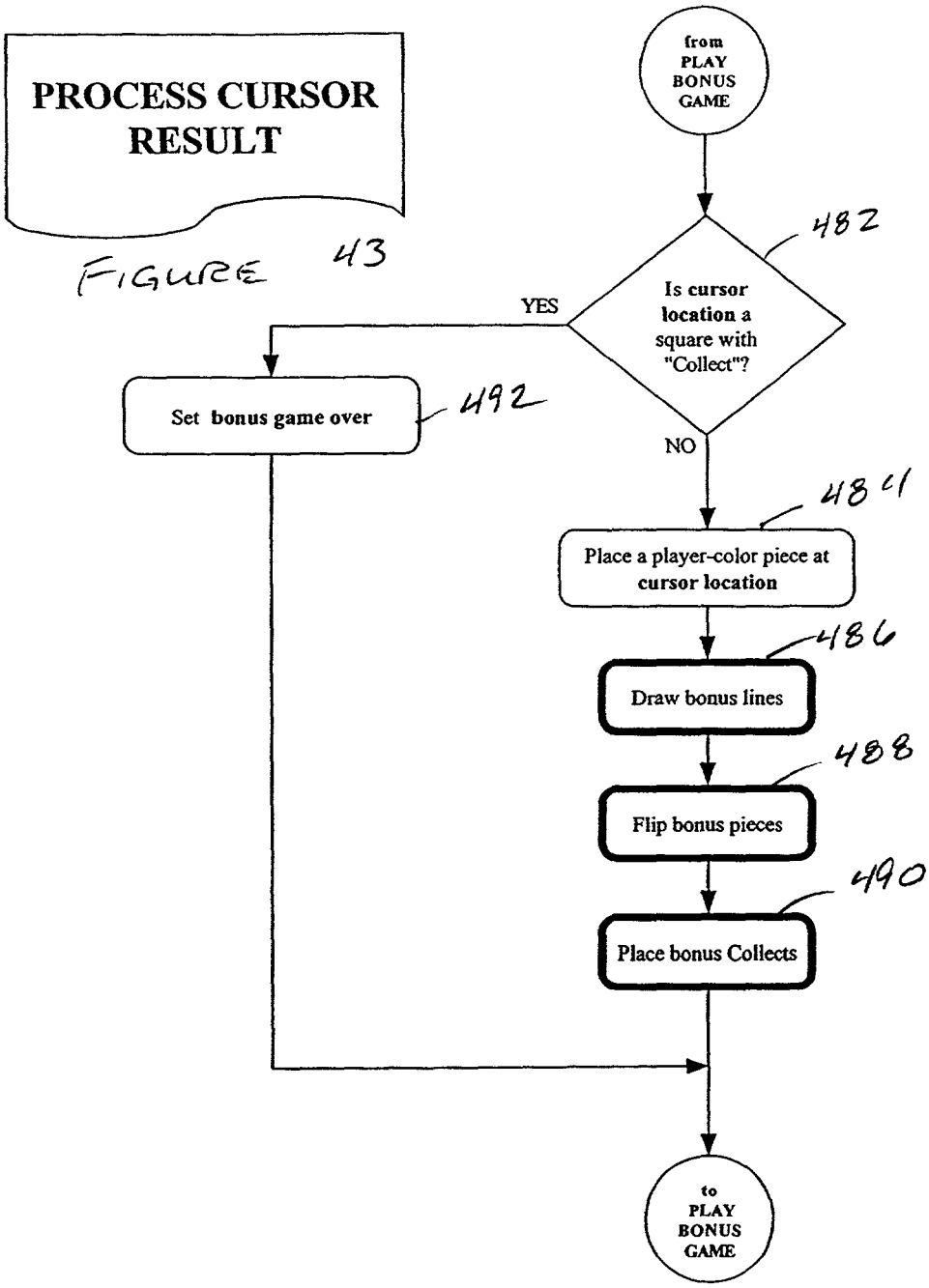

FIG. 43 illustrates the "Process Cursor Results" subroutine of step 462 of FIG. 41. In step 482, the program checks if the square represented by the "Cursor Location" variable is labeled "Collect." If the square represented by the "Cursor Location" value is not labeled "Collect," then the program proceeds to visually place a player-colored piece in the square represented by the "Cursor Location" variable in step 484. Next the program calls a "Draw Bonus Lines" subroutine, described hereinafter, in step 486. When the program has returned from the "Draw Bonus Lines" subroutine, the program proceeds to a "Flip Bonus Pieces" subroutine, described hereinafter, in step 488. When the program has returned from the "Flip Bonus Pieces" subroutine, the program calls a "Place Bonus Collects" subroutine, described hereinafter, in step 490.

Referring back to step 482, if the square represented by the "Cursor Location" variable is labeled "Collect," then the program sets the "Bonus Game Over" variable in step 492. After the program has returned from the "Place Bonus Collects" subroutine or after completion of step 492, the program returns to complete step 464 in the "Play Bonus Game" subroutine as shown in FIG. 41.

FIG. 44 depicts the steps involved in the "Draw Bonus Lines" subroutine of step 486 of FIG. 43. Here in step 494, the program examines the next adjoining square of the square represented by the "Cursor Location" variable. The program then checks if this adjoining square is occupied by a piece with the opponent's color in step 496. If adjoining square is not occupied by a piece with the opponent's color, the program proceeds to step 498 and determines if all adjoining squares of the square represented by the "Cursor Location" variable have been examined. If so, the program returns to complete step 488 of FIG. 43. If not, the program advances to the next square adjoining the square represented by the "Cursor Location" variable in step 500. After step 500 is complete the program loops back to complete step 496 again.

Referring back to step 496, if the adjoining square is occupied by a piece with the opponent's color, the program examines the next square along the same line in step 502. In step 504, the program determines if this next square along the same line is occupied by a piece with the opponent's color. If so, the program loops back and completes step 502 again. If not, the program proceeds to step 506 and checks if this square is occupied by a piece with the player's color. If this square is not occupied by a piece with the player's color, the program loops back to perform step 498, described above, and continues from there. If this square is occupied by a piece with the player's color, the program illustrates or draws a highlighted line from the current square to the square represented by the "Cursor Location" variable in step 508. Then in step 510, the program records or registers any pieces with the opponent's color along this line to be flipped. After step 510 is complete, the program loops back to perform step 498, described above, and continues from there.

FIG. 45 illustrates the steps of the "Flip Bonus Pieces" subroutine of step 488 in FIG. 43. The program examines any pieces with the opponent's color in rows and columns closest to the current cursor location in step 512. In step 514, the program determines if any of the pieces in rows and columns closest to the current cursor location were marked to be flipped in step 510 of FIG. 44. If not, the program checks to see if all pieces with the opponent's color have been examined in step 516. If so, then the program returns to perform step 490 of the "Process Cursor Result" subroutine of FIG. 43. If not, the program examines the pieces with the opponent's color in the next rows and columns in step 518. After step 518 is complete, the program loops back to perform step 514 again.

Referring back to step 514, if any of the pieces in rows and columns closest to the current cursor location are to be flipped, the program initiates a flipping animation of pieces to be flipped to end such that each piece is displayed with the player's color showing in step 520. After step 520 is complete, the program performs step 516, described above, and continues from there.

Figure 46:
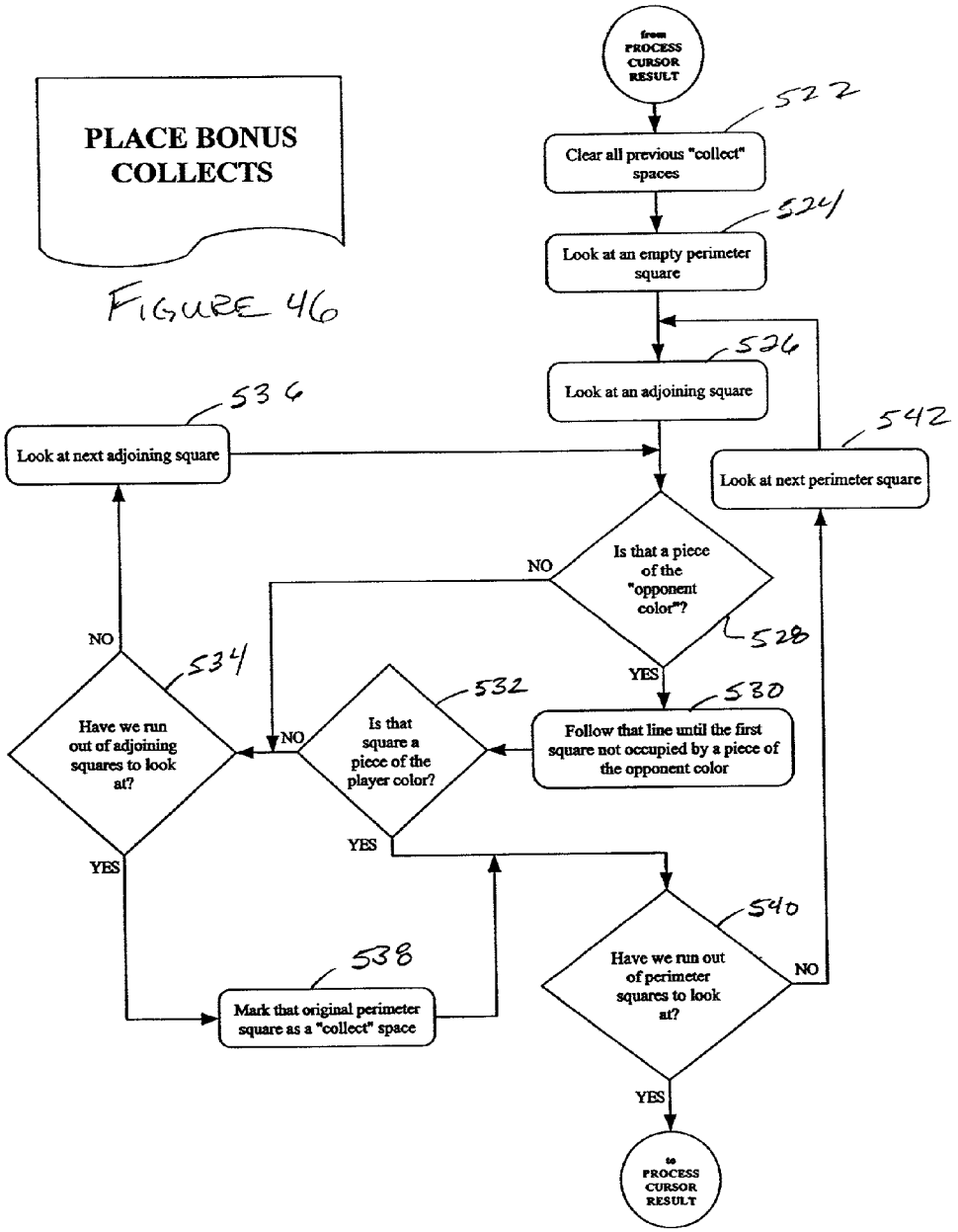

FIG. 46 depicts the steps involved in the "Place Bonus Collects" subroutine of step 490 in FIG. 43. First, the program clears all squares previously labeled "Collect" in step 522. In step 524, the program examines an empty square in the perimeter of the game board. In step 526, the program examines an adjoining square to this empty square. In step 528 the program determines if the adjoining square is occupied by a piece with the opponent's color. If so, the program follows or proceeds along the line formed by the adjoining square (from the empty square in the perimeter) to a square not occupied by a piece with the opponent's color in step 530. Next, the program determines if the next square in the line is occupied by a piece with the player's color in step 532. If not, the program makes another determination as to whether all adjoining squares have been examined in step 534. If not, the next adjoining square is examined in step 536 and then the program loops back to complete step 528, described previously, and continues from there.

Referring back to step 534, if all adjoining squares have been examined, then the original perimeter square of this process is labeled a "Collect" square in step 538. After step 538 is completed, the program determines if all squares on the perimeter have been examined in step 540. If all perimeters squares have been examined, the program returns to the "Process Cursor Result" subroutine in FIG. 43 and returns further back to complete step 464 of "Play Bonus Game" subroutine in FIG. 41. If the program determines that not all of the squares on the perimeter have been examined in step 540, the program completes step 542 and indexes to the next perimeter square on the game board. After step 542 is performed, the program loops back to complete step 526, described previously, and proceeds normally from that step.

Referring back to step 532, if the next square along the line being examined is occupied by a piece with the player's color, then we have found that the perimeter square is a legal move and the program proceeds to complete step 540, described previously, and continues on normally from that step.

Finally, referring back to step 528, if the adjoining square is not occupied by a piece with the opponent's color, the program proceeds to complete step 534 and continues on normally from that step.

FIG. 47 illustrates the steps involved in the "Update Bonus Paytable" subroutine of step 464 of the "Play Bonus Game" subroutine in FIG. 41. Here the program counts or tallies the number of pieces having the player's color in step 544. In step 546, a highlighted line 144 is positioned in the paytable 116 displayed on the screen 10 (e.g., FIG. 10) that corresponds to the number of pieces having the player's color. In step 548, the corresponding Pays value of the paytable 116 is displayed in a "Bonus Win" meter 120. In step 550, the program determines if any pieces with the opponent's color remain on the game board. If so, the program returns to the "Play Bonus Game" subroutine to complete step 466 of FIG. 41.

Back in step 550, if the program determines that no pieces with the opponent's color remain on the game board, then the program proceeds to step 552. Here the program highlights the "Complete The Board Bonus" meter 126 (e.g., FIG. 20) and tallies the amount displayed in the "Complete The Board Bonus" meter 126 to the value shown on the "Bonus Win" meter 120. In step 554 the program sets the "Bonus Game Over" variable. After completing step 554, the program returns to the "Play Bonus Game" subroutine to complete step 466 of FIG. 41.

Figure 48:
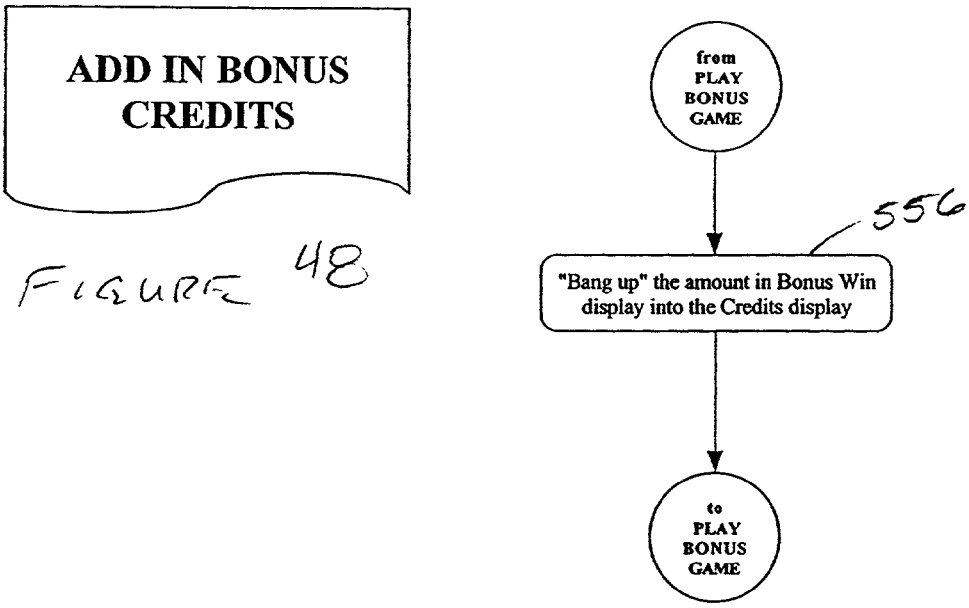

FIG. 48 depicts the step of the "Add In Bonus Credits" subroutine of step 468 in FIG. 41. In step 556 the program adds the value of the "Bonus Win" meter 120 into the "Credits" meter or display 120 (e.g., FIG. 20). After this step is complete, the program returns to the "Play Bonus Game" subroutine of FIG. 41 and returns further back to the main loop 300 to complete step 302.

Analysis of an Embodiment of the Game

For each number of paylines played there is a separate calculation of paytable values based on the distribution of the number of "hits" on the selected line(s). The method used to generate two such paytables will be shown, with the others being easily developed by those skilled in the art.

The expected return for the base game and bonus game are computed independently, and then added together as is well known in the art. Table 1 shows the base game calculation for the game when eighteen lines are played. Each row of the table in Table 1 contains information about achieving wins on the number of lines shown in the first column.

TABLE 1

| Lines won | Occurrences | Probability | Pay | EV |
|---|---|---|---|---|
| 0 Lines | 1,599,669,107 | 0.372451988 | 0 | 0.00000000 |
| 1 Line | 1,399,486,818 | 0.325843417 | 9 | 0.16292171 |
| 2 Lines | 761,083,078 | 0.177203463 | 14 | 0.13782492 |
| 3 Lines | 334,071,638 | 0.077782115 | 25 | 0.10803071 |
| 4 Lines | 130,092,869 | 0.030289606 | 45 | 0.07572402 |
| 5 Lines | 46,872,368 | 0.010913324 | 170 | 0.10307028 |
| 6 Lines | 16,024,317 | 0.003730952 | 500 | 0.10363756 |
| 7 Lines | 5,267,224 | 0.001226371 | 625 | 0.04258233 |
| 8 Lines | 1,673,186 | 0.000389569 | 750 | 0.01623204 |
| 9 Lines | 513,616 | 0.000119586 | 900 | 0.00597928 |
| 10 Lines | 152,969 | 3.56159E-05 | 1500 | 0.00296799 |
| 11 Lines | 43,862 | 1.02124E-05 | 5000 | 0.00283678 |
| 12 Lines | 12,121 | 2.82126E-06 | 10000 | 0.00156786 |
| 13 Lines | 3,112 | 7.24569E-07 | 15000 | 0.00060381 |
| 14 Lines | 795 | 1.851E-07 | 25000 | 0.00025708 |
| 15 Lines | 172 | 4.00469E-08 | 25000 | 0.00005562 |
| 16 Lines | 37 | 8.61473E-09 | 25000 | 0.00001196 |
| 17 Lines | 6 | 1.39698E-09 | 25000 | 0.00000194 |
| 18 Lines | 1 | 2.32831E-10 | 25000 | 0.00000032 |
| | 4,294,967,296 | 1.000000 | | 76.4306% |

The selection of each of the thirty-two pieces in one of the embodiments is a fair 50/50 choice between black and white. The game could nevertheless be designed using weighted probabilities, as is well known by those skilled in the art. The thirty-two independent choices each having two possible values results in $2^{32}$ possible outcomes or 4,294,967,296 possible spins. A program was written in the C programming language to generate each of the 4,294,967,296 boards. Each of these "boards" was analyzed to determine the number of winning lines among the "paid lines" being analyzed (eighteen lines in the case of Table 1). A counter was kept for each line count. The total count of each possible result is shown in the second column of Table 1, labeled "Occurrences." The third column shows the probability of achieving the exact number of winning lines shown in the first column. This was calculated by dividing the value of occurrences of 15 the second column by the 4,294,967,296 total occurrences. The total of the probability column always sums to 1, defining all possible occurrences. The pay value for the indicated number of winning lines is shown in the fourth column. The Expected Value (EV) contribution is shown in the fifth column (last) and is computed by multiplying the third column probability by the fourth column pay value, then dividing by the eighteen credits wagered. The sum of the EV column is the return of the base game to the player. Approximately 76.43% of the money wagered will be returned to the player in the long run through wins in the base game when eighteen lines are played. If it is desired to modify the payout percentage then it can be easily done by changing the pay values in the fourth column as is well known in the art. The distribution of the payouts (how much of the EV is awarded at what frequencies) may also be modified by changing the pay values as is well known in the art.

Table 2 shows the same analysis done for when nine lines are wagered. The C program was run to analyze each of the 4,294,967,296 possible spins, computing how many of paylines 1–9 are winners in each spin. The EV column is now divided by 9 instead of by eighteen credits wagered.

TABLE 2

| Lines won | Occurrences | Probability | Pay | EV |
|---|---|---|---|---|
| 0 Lines | 2,550,622,208 | 0.59386301 | 0 | 0.00000000 |
| 1 Line | 1,232,470,528 | 0.286956906 | 8 | 0.25507281 |
| 2 Lines | 385,966,080 | 0.089864731 | 17 | 0.16974449 |
| 3 Lines | 98,342,912 | 0.022897243 | 55 | 0.13992760 |
| 4 Lines | 22,327,296 | 0.005198479 | 225 | 0.12996197 |
| 5 Lines | 4,377,600 | 0.001019239 | 360 | 0.04076958 |
| 6 Lines | 745,472 | 0.000173569 | 600 | 0.01157125 |
| 7 Lines | 104,448 | 2.43187E-05 | 750 | 0.00202656 |
| 8 Lines | 10,240 | 2.38419E-06 | 1500 | 0.00039736 |
| 9 Lines | 512 | 1.19209E-07 | 2500 | 0.00003311 |
| | 4,294,967,296 | 1.000000 | | 74.9505% |

The bonus game that is played on the Othello®-type format incorporates a scatter-type pay, so the calculation yields an expected multiplier which is multiplied by the player's entire wager without regard to which or how many lines received wagers.

For the analysis of the bonus game, a program was again written in the C program language to operate each possible outcome of the bonus round. There are a maximum of twelve piece placements in the bonus round, because each placed piece must flip one or more outflanked opponents pieces, and the bonus round always starts with twelve opponents pieces. If each piece placed outflanks exactly one opponent piece then the bonus round places the maximum of twelve pieces.

The program starts with each possible first piece placement, then tries each second piece placement and so on until it either selects a "collect" square, or completes the board. The total number of bonus game boards analyzed is 137,748,043,640.

For each possible game, this program recorded the number of attempts to place a piece (bonus game spins) and the total number of pieces of the player's color on the board at the end of the bonus game. Table 3 shows the breakdown of number of player pieces based on number of piece placement attempts. Each row of Table 3 represents games that ended with the number of player pieces shown in the first column. Each column represents the number of piece placement attempts (bonus game spins) to result in the number of total pieces in the first column.

TABLE 3

Occurrences of Bonus Game Length by Piece Count

| Player | Number of Bonus Round Placement attempts (Bonus Game Spins) | | | | | | | | | | | |
|---|---|---|---|---|---|---|---|---|---|---|---|---|
| Pieces | 1 | 2 | 3 | 4 | 5 | 6 | 7 | 8 | 9 | 10 | 11 | 12 |
| 6 | 0 | 16 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 |
| 8 | 0 | 0 | 312 | 0 | 0 | 0 | 0 | 0 | 0 | 0 | 0 | 0 |
| 9 | 0 | 0 | 104 | 0 | 0 | 0 | 0 | 0 | 0 | 0 | 0 | 0 |
| 10 | 0 | 0 | 112 | 3,760 | 0 | 0 | 0 | 0 | 0 | 0 | 0 | 0 |
| 11 | 0 | 0 | 48 | 3,904 | 0 | 0 | 0 | 0 | 0 | 0 | 0 | 0 |
| 12 | 0 | 0 | 64 | 3,248 | 40,960 | 0 | 0 | 0 | 0 | 0 | 0 | 0 |
| 13 | 0 | 0 | 0 | 2,944 | 68,824 | 0 | 0 | 0 | 0 | 0 | 0 | 0 |
| 14 | 0 | 0 | 0 | 1,944 | 67,176 | 413,776 | 0 | 0 | 0 | 0 | 0 | 0 |
| 15 | 0 | 0 | 0 | 80 | 73,120 | 870,512 | 0 | 0 | 0 | 0 | 0 | 0 |
| 16 | 0 | 0 | 0 | 384 | 36,984 | 1,116,208 | 3,776,144 | 0 | 0 | 0 | 0 | 0 |
| 17 | 0 | 0 | 0 | 0 | 19,168 | 1,040,896 | 9,609,016 | 0 | 0 | 0 | 0 | 0 |
| 18 | 0 | 0 | 0 | 0 | 9,368 | 761,552 | 12,978,336 | 31,951 176 | 0 | 0 | 0 | 0 |
| 19 | 0 | 0 | 0 | 0 | 1,352 | 435,328 | 13,232,736 | 87,238,288 | 0 | 0 | 0 | 0 |
| 20 | 0 | 0 | 0 | 128 | 0 | 196,576 | 10,933,016 | 125,861,656 | 240,776,504 | 0 | 0 | 0 |
| 21 | 0 | 0 | 0 | 0 | 6,664 | 0 | 6,632,928 | 139,789,080 | 679,771,776 | 0 | 0 | 0 |
| 22 | 0 | 0 | 0 | 0 | 0 | 225,416 | 0 | 117,221,136 | 1,050,176,968 | 1,610,733,024 | 0 | 0 |
| 23 | 0 | 0 | 0 | 0 | 0 | 0 | 4,971,632 | 0 | 1,171,036,064 | 4,621,329,856 | 0 | 0 |
| 24 | 0 | 0 | 0 | 0 | 0 | 0 | 0 | 70,193,040 | 0 | 7,182,149,312 | 9,468,634,064 | 0 |
| 25 | 0 | 0 | 0 | 0 | 0 | 0 | 0 | 0 | 624,354,176 | 0 | 26 358,565,208 | 0 |
| 26 | 0 | 0 | 0 | 0 | 0 | 0 | 0 | 0 | 0 | 3,553,657,424 | 0 | 46,858,266 608 |
| 27 | 0 | 0 | 0 | 0 | 0 | 0 | 0 | 0 | 0 | 0 | 12,353,498,960 | 0 |
| 28 | 0 | 0 | 0 | 0 | 0 | 0 | 0 | 0 | 0 | 0 | 0 | 21,335,296,504 |

Table 4 was generated by a C program, which counts the number of times the board is completed (resulting in all pieces matching the player's color). Table 4 shows the number of completions as a function of the number of piece placement attempts (bonus game spins) in the bonus game.

$$\left(\frac{1}{20}*\frac{1}{19}*\frac{1}{18}*\frac{1}{17}*\frac{1}{16}*\frac{1}{15}*\frac{1}{14}*\frac{1}{13}*\frac{1}{12}*\frac{1}{11}*\frac{1}{10}*\frac{1}{9}\right)=1.66\times10^{-14}$$

TABLE 4

Occurrences of Completions by Length of Game

| Number of Bonus Round Placement attempts (Bonus Game Spins) | | | | | | | | | | | |
|---|---|---|---|---|---|---|---|---|---|---|---|
| 1 | 2 | 3 | 4 | 5 | 6 | 7 | 8 | 9 | 10 | 11 | 12 |
| 0 | 0 | 0 | 128 | 6,664 | 225,416 | 4,971,632 | 70,193,040 | 624,354,176 | 3,553,657,424 | 12,353,498,960 | 21,335,296,504 |

The numbers in Tables 3 and 4 represent a distribution of possible games, however this distribution must be weighted by the probability of each event. For example, looking at the occurrence count of a game ending with six player pieces, Table 3 shows that it can happen sixteen different ways, all of which occur on the second "spin" of the bonus round. The probability of each of these ways is 1/20*1/19=0.00263 represented by the 1 in 20 probability of the selection of the $1^{st}$ perimeter square times the 1 in 19 probability of the selection of the second perimeter square. There are billions of occurrences of 28 pieces on the board at the end of the game as a result of all of the different combinations of 12 moves that will eventually leave 28 pieces on the board. The probability of each of these however is After multiplying each occurrence count by its probability we find that the actual probability of ending the game with 6 pieces is much larger that 28 pieces, as would be expected:

Probability of 6 pieces=16*0.00263=0.04211

Probability of 28 pieces=21,335,296,504*$1.66\times10^{-14}$=0.00035

Table 5 shows the probability of the bonus game reaching each number of possible spins (or piece placement attempts). The row labeled "calculation" shows that the first move has probability 1/20, the $2^{nd}$ move is 1/20*1/19, the $3^{rd}$ move is 1/20*1/19*1/18 and so on. The row labeled "result" is the numerical result of this calculation.

TABLE 5

| Probability of Bonus Game Length | | | | |
|---|---|---|---|---|
| | 1 | 2 | 3 | 4 |
| Calculation | 1/20 | 1/20*1/19 | 1/20*1/19*1/18 | 1/20*1/19*1/18*1/17 |
| Result | 0.05000 | 0.00263 | 1 46E-04 | 8.60E-06 |

| Number of Bonus Round Placement attempts (Bonus Game Spins) | | | | | | | |
|---|---|---|---|---|---|---|---|
| 5 | 6 | 7 | 8 | 9 | 10 | 11 | 12 |
| etc | etc | etc | etc. | etc. | etc. | etc. | etc. |
| 5.37E-07 | 3.58E-08 | 2.56E-09 | 1.97E-10 | 1.64E-11 | 1.49E-12 | 1.49E-13 | 1.66E-14 |

Table 6 now shows the weighted probability of the possible outcomes in the bonus game. Table 6 was created by taking each row of Table 3 and multiplying the occurrence count by the corresponding probability "result" in Table 5. The rightmost column of Table 6 (labeled "Total") is the probability of a game ending with the specified piece count (either by landing on a collect or completing the board). It is the sum of all of the probability values in the row. This column of numbers is needed to create the paytable and determine the expected value of the bonus round. It should be noted that these probabilities of all possible outcomes add up to 1 as expected as shown by the lower right number in Table 6.

Table 7 is a table similar to Table 6 showing the probability for completing the board based on piece placement attempts or bonus game spins. Table 7 was created by combining the Tables 4 and 5 in the same manner used to create Table 6. The right of Table 7 is the total probability that the board will be completed on a play of the game. This probability of 0.05705 is the value needed to set the award for completing the board. This probability indicates that the board will be completed approximately every 17.5 bonus games on average in the long run.

TABLE 6

| Probability of Bonus Game Length by Piece Count | | | | | | | | | | | | | |
|---|---|---|---|---|---|---|---|---|---|---|---|---|---|
| Player | Number of Bonus Round Placement attempts (Bonus Game Spins) | | | | | | | | | | | | |
| Pieces | 1 | 2 | 3 | 4 | 5 | 6 | 7 | 8 | 9 | 10 | 11 | 12 | Total |
| 6 | 0 00000 | 0 04211 | 0 00000 | 0 00000 | 0 00000 | 0 00000 | 0 00000 | 0 00000 | 0 00000 | 0 00000 | 0 00000 | 0 00000 | 0.04211 |
| 7 | 0 00000 | 0 00000 | 0 00000 | 0 00000 | 0 00000 | 0 00000 | 0 00000 | 0 00000 | 0 00000 | 0 00000 | 0 00000 | 0 00000 | 0.00000 |
| 8 | 0 00000 | 0 00000 | 0 04561 | 0 00000 | 0 00000 | 0 00000 | 0 00000 | 0 00000 | 0 00000 | 0 00000 | 0 00000 | 0 00000 | 0.04561 |
| 9 | 0 00000 | 0 00000 | 0 01520 | 0 00000 | 0 00000 | 0 00000 | 0 00000 | 0 00000 | 0 00000 | 0 00000 | 0 00000 | 0 00000 | 0.01520 |
| 10 | 0 00000 | 0 00000 | 0 01637 | 0 03234 | 0 00000 | 0 00000 | 0 00000 | 0 00000 | 0 00000 | 0 00000 | 0 00000 | 0 00000 | 0.04871 |
| 11 | 0 00000 | 0 00000 | 0 00702 | 0 03426 | 0 00000 | 0 00000 | 0 00000 | 0 00000 | 0 00000 | 0 00000 | 0 00000 | 0 00000 | 0.04128 |
| 12 | 0 00000 | 0 00000 | 0 00936 | 0 02793 | 0 02202 | 0 00000 | 0 00000 | 0 00000 | 0 00000 | 0 00000 | 0 00000 | 0 00000 | 0.05931 |
| 13 | 0 00000 | 0 00000 | 0 00000 | 0 02532 | 0 03699 | 0 00000 | 0 00000 | 0 00000 | 0 00000 | 0 00000 | 0 00000 | 0 00000 | 0.06231 |
| 14 | 0 00000 | 0 00000 | 0 00000 | 0 01672 | 0 03611 | 0 01483 | 0 00000 | 0 00000 | 0 00000 | 0 00000 | 0 00000 | 0 00000 | 0.06765 |
| 15 | 0 00000 | 0 00000 | 0 00000 | 0 00069 | 0 03930 | 0 03119 | 0 00000 | 0 00000 | 0 00000 | 0 00000 | 0 00000 | 0 00000 | 0.07118 |
| 16 | 0 00000 | 0 00000 | 0 00000 | 0 00330 | 0 01988 | 0 04000 | 0 00967 | 0 00000 | 0 00000 | 0 00000 | 0 00000 | 0 00000 | 0.07284 |
| 17 | 0 00000 | 0 00000 | 0 00000 | 0 00000 | 0 01030 | 0 03759 | 0 02459 | 0 00000 | 0 00000 | 0 00000 | 0 00000 | 0 00000 | 0.07248 |
| 18 | 0 00000 | 0 00000 | 0 00000 | 0 00000 | 0 00504 | 0 02729 | 0 03322 | 0 00629 | 0 00000 | 0 00000 | 0 00000 | 0 00000 | 0.07183 |
| 19 | 0 00000 | 0 00000 | 0 00000 | 0 00000 | 0 00073 | 0 01560 | 0 03387 | 0 01718 | 0 00000 | 0 00000 | 0 00000 | 0 00000 | 0.06737 |
| 20 | 0 00000 | 0 00000 | 0 00000 | 0 00110 | 0 00000 | 0 00704 | 0 02798 | 0 02478 | 0 00395 | 0 00000 | 0 00000 | 0 00000 | 0.06486 |
| 21 | 0 00000 | 0 00000 | 0 00000 | 0 00000 | 0 00358 | 0 00000 | 0 01698 | 0 02752 | 0 01115 | 0 00000 | 0 00000 | 0 00000 | 0.05923 |
| 22 | 0 00000 | 0 00000 | 0 00000 | 0 00000 | 0 00000 | 0 00808 | 0 00000 | 0 02308 | 0 01723 | 0 00240 | 0 00000 | 0 00000 | 0.05079 |
| 23 | 0 00000 | 0 00000 | 0 00000 | 0 00000 | 0 00000 | 0 00000 | 0 01272 | 0 00000 | 0 01921 | 0 00689 | 0 00000 | 0 00000 | 0.03883 |
| 24 | 0 00000 | 0 00000 | 0 00000 | 0 00000 | 0 00000 | 0 00000 | 0 00000 | 0 01382 | 0 00000 | 0 01071 | 0 00141 | 0 00000 | 0.02594 |
| 25 | 0 00000 | 0 00000 | 0 00000 | 0 00000 | 0 00000 | 0 00000 | 0 00000 | 0 00000 | 0 00864 | 0 00000 | 0 00393 | 0 00000 | 0.01418 |
| 28 | 0 00000 | 0 00000 | 0 00000 | 0 00000 | 0 00000 | 0 00000 | 0 00000 | 0 00000 | 0 00000 | 0 00530 | 0 00000 | 0 00078 | 0.00608 |
| 27 | 0 00000 | 0 00000 | 0 00000 | 0 00000 | 0 00000 | 0 00000 | 0 00000 | 0 00000 | 0 00000 | 0 00000 | 0 00184 | 0 00000 | 0.00184 |
| 28 | 0 00000 | 0 00000 | 0 00000 | 0 00000 | 0 00000 | 0 00000 | 0 00000 | 0 00000 | 0 00000 | 0 00000 | 0 00000 | 0 00035 | 0.00035 |
| | | | | | | | | | | | | | 1.0000 |

TABLE 7

| Probability of Completions by Length of Game | | | | | | | | | | | | |
|---|---|---|---|---|---|---|---|---|---|---|---|---|
| Number of Bonus Round Placement attempts (Bonus Game Spins) | | | | | | | | | | | | |
| 1 | 2 | 3 | 4 | 5 | 6 | 7 | 8 | 9 | 10 | 11 | 12 | Total |
| 0 | 0 | 0 | 0.00110 | 0.00358 | 0.00808 | 0.01272 | 0.01382 | 0 0864 | 0.00530 | 0.00184 | 0.00035 | 0.05705 |

Table 8 shows the computation of the expected value of this Bonus Game. The first column shows the number of the player's colored pieces at the end of the bonus game. The second column is the probability of ending a bonus game with this number of pieces. This number is taken from the right column of Table 6. The third column is the pay value for ending the bonus game with this many pieces of the player's color. This number is multiplied by the player's total bet. For example, if the bonus round ends with fifteen pieces of the player's color, the pay column of Table 8 shows a pay value of 6. This means the player is awarded 6 times the total bet. In the FIG. 20 example where the player has bet eighteen credits, this bonus round award is 6*18=108 credits.

The fourth column is the Expected Value (EV) contribution, and is calculated by multiplying the second column probability by the third column pay value. The sum of these EV values is 8.30152, which means that the pay for total pieces in the bonus round results in an expected value of over 8 times the player's total bet. As with the paytables of Tables 1 and 2, one skilled in the art would modify the pay values to change the expected return or pay distributions.

TABLE 8

| Pieces | Probability | Pay | EV |
|---|---|---|---|
| 6 | 0.04211 | 2 | 0.08421 |
| 7 | 0.00000 | 2 | 0.00000 |
| 8 | 0.04561 | 3 | 0.13684 |
| 9 | 0.01520 | 4 | 0.06082 |
| 10 | 0.04871 | 4 | 0.19484 |
| 11 | 0.04128 | 5 | 0.20640 |
| 12 | 0.05931 | 5 | 0.29653 |
| 13 | 0.06231 | 5 | 0.31155 |
| 14 | 0.06765 | 6 | 0.40591 |
| 15 | 0.07118 | 6 | 0.42710 |
| 16 | 0.07284 | 7 | 0.50990 |
| 17 | 0.07248 | 8 | 0.57986 |
| 18 | 0.07183 | 9 | 0.64650 |
| 19 | 0.06737 | 10 | 0.67371 |
| 20 | 0.06486 | 11 | 0.71344 |
| 21 | 0.05923 | 12 | 0.71081 |
| 22 | 0.05079 | 14 | 0.71105 |
| 23 | 0.03883 | 16 | 0.62130 |
| 24 | 0.02594 | 18 | 0.46701 |
| 25 | 0.01418 | 20 | 0.28351 |
| 26 | 0.00608 | 25 | 0.15193 |
| 27 | 0.00184 | 30 | 0.05528 |
| 28 | 0.00035 | 150 | 0.05304 |
| | 1.00000 | | 8.30152 |
| Board Completions | 0.05705 | 30 | 1.71136 |
| Total Return of Bonus Game | | | 10.01288 |

At the bottom of Table 8, the return for completing the board in the bonus round is calculated. The probability is taken from Table 7 as described above. The product of this probability with the pay multiplier of 30 results in a 1.71136 Expected Return for completions of the board. The entire return of this bonus game is 10.01288, which is the sum of the two EV components above it (EV of total piece payouts and EV of board completion payouts).

To integrate the bonus game return with the base game return of Table 1, all that remains is to determine the probability of initiating the bonus game. The bonus game analyzed herein is triggered when one or more rows of eight pieces match the player's selected color. It is easy to calculate the probability that no row matches the selected color. In each row of eight pieces there are 255 combinations that are not bonus initiators and only one combination where all pieces match the player's color. Therefore the probability of not having a bonus initiator is $(255/256)^4=0.984466315$. The probability of initiating the bonus round is found by subtracting the above number from 1:

$1-0.984466315=0.015533685$.

Table 9 shows the paytable of Table 1 integrated with the bonus game's EV contribution to the game (the product of the 0.015533685 probability and the 10.01288 EV of Table 8). The combined game has a return of just under 92%. The bonus game calculation as configured here is independent of how many lines are played. It has an expected pay value of 10.01288 and an EV contribution of 0.15553692 for the paytable for each number of lines played (such as the nine line table of Table 2).

TABLE 9

| | Occurrences | Probability | Pay | EV |
|---|---|---|---|---|
| 0 Lines | 1,599,669,107 | 0.372451988 | 0 | 0.00000000 |
| 1 Line | 1,399,486,818 | 0.325843417 | 9 | 0.16292171 |
| 2 Lines | 761,083,078 | 0.177203463 | 14 | 0.13782492 |
| 3 Lines | 334,071,638 | 0.077782115 | 25 | 0.10803071 |
| 4 Lines | 130,092,869 | 0.030289606 | 45 | 0.07572402 |
| 5 Lines | 46,872,368 | 0.010913324 | 170 | 0.10307028 |
| 6 Lines | 16,024,317 | 0.003730952 | 500 | 0.10363756 |
| 7 Lines | 5,267,224 | 0.001226371 | 625 | 0.04258233 |
| 8 Lines | 1,673,186 | 0.000389569 | 750 | 0.01623204 |
| 9 Lines | 513,616 | 0.000119586 | 900 | 0.00597928 |
| 10 Lines | 152,969 | 3.56159E-05 | 1500 | 0.00296799 |
| 11 Lines | 43,862 | 1.02124E-05 | 5000 | 0.00283678 |
| 12 Lines | 12,121 | 2.82126E-06 | 10000 | 0.00156786 |
| 13 Lines | 3,112 | 7.24569E-07 | 15000 | 0.00060381 |
| 14 Lines | 795 | 1.851E-07 | 25000 | 0.00025708 |
| 15 Lines | 172 | 4.00469E-08 | 25000 | 0.00005562 |
| 16 Lines | 37 | 8.61473E-09 | 25000 | 0.00001196 |
| 17 Lines | 6 | 1.39698E-09 | 25000 | 0.00000194 |
| 18 Lines | 1 | 2.32831E-10 | 25000 | 0.00000032 |
| Bonus Game | | 0.015533685 | 10.01288 | 0.15553692 |
| | 4,294,967,296 | | | 91.9843% |

The pick three coins bonus game is much easier to analyze. The CPU randomly selects values to associate with each of the eight coins shown in FIG. 26. Table 10 shows the weighted table that is used for selection of the numbers 1, 2 or 3. As in the previous bonus round, these values are multiplied by the player's total bet (which would be 18, 36 or 54 in the FIG. 26 example using an eighteen coin total bet). The first column shows the possible selected values. The second column shows the "weight" out of 40 possible random numbers of selecting the number in the first column. The third column shows the probability of this weighted pick. The fourth column is the EV contribution for the first column value of the coin pick, and is the product of the first column value and the third column probability. The sum of these EV components results in the expected pay value of each coin pick of 1.4 (times the player's total bet). The Expected Value of three picks is 3 times that amount or 4.2.

TABLE 10

| Value | Weight | Probability | EV |
|---|---|---|---|
| 1 | 26 | 0.65 | 0.65 |
| 2 | 12 | 0.3 | 0.6 |
| 3 | 2 | 0.05 | 0.15 |
| Total | 40 | 1.0000 | 1.4 |
| Value of 3 Picks | | | 4.2 |

Table 11 shows the Expected Value of the bonus game in games where the "All" symbol is associated with one of the coins. To fill in this table we need to know the likelihood of selecting the "All" coin in three picks among eight coins. This is computed by first calculating the probability of not selecting the "All" coin in any of the picks. The probability of not selecting the "All" coin in any of the three picks is 7/8*6/7*5/6=0.625. Therefore the probability of selecting the "All" is 1−0.625=0.375. The Expected Value of any bonus round where "All" is picked is 7 times the value of picking a coin which is 1.4*7=9.8. Table 11 combines these probabilities and values to result in an expected value when "All" is in the board of 6.3 (times the player's total bet). Finally, in Table 12 we factor in that in 40% of the bonus games the CPU randomly replaces one of the chosen coin values with the "All" symbol. Using the methods of computing EV that we have used throughout this discussion we combine the 4.2 multiplier expected from games without "All" on the board with the 6.3 multiplier expected from games where "All" is on the board for a total expected multiplier of 5.04.

TABLE 11

EV calculation when "All" is in the board

| Result | Probability | Value | EV |
|---|---|---|---|
| All Not Picked | 0.625 | 4.2 | 2.625 |
| All is Picked | 0.375 | 9.8 | 3.675 |
| | 1.0000 | | 6.3 |

TABLE 12

Combined EV for all Bonus Games

| | Probability | Value | EV |
|---|---|---|---|
| Games with ALL on board | 0.4 | 6.3 | 2.52 |
| Games without ALL | 0.6 | 4.2 | 2.52 |
| | | | 5.04 |

The Expected Value for this bonus game could be modified by changing the values or weights in Table 10, the probability of placing the "All" symbol (0.4 in Table 12) or by changing the number of picks or the number of coins to pick from. These methods are well known by those of ordinary skill in the art.

If this bonus game is offered in addition to the board game bonus, then it could be combined into Table 9 as another EV component. If it is desired to replace the board game bonus round with this one, then it would replace the bonus game contribution in Table 9.

Thus, while the invention has been disclosed and described with respect to certain embodiments, those of skill in the art will recognized modifications, changes, other applications and the like which will nonetheless fall within the spirit and ambit of the invention, and the following claims are intended to capture such variations.

We claim:

1. A method of operating a gaming machine, comprising the steps of:

providing a plurality of game elements for a display in a row and column matrix of game element locations, with said game elements having at least one feature categorizable into a particular set of one of only two predetermined sets of features, each of said sets of features having a characteristic matching a set together and differentiating that set from the other set;

registering a wager input by a player upon a final outcome of the game, said wager requiring selection of at least one possible winning spatial arrangement of said game elements of a plurality of winning arrangements, wherein said arrangements are chosen from a group including matches of game elements of a particular set in geometric vertical, horizontal and diagonal lines yielded by said matrix, said wager further including registration of an amount to bet;

randomly selecting game elements and associating each selected game element with a respective location for a play of the game;

displaying said at least one feature of each said selected game element in said play of the game;

determining an outcome of said play of the game based upon the number of winning arrangements actually achieved, if any; and providing a payout based upon the number of winning arrangements achieved and the amount bet.

2. The method of claim 1 wherein said payout increases in a non-linear fashion as the number of winning arrangements achieved in said outcome approaches a preset maximum number of arrangements.

3. The method of claim 2 wherein said game elements are depicted in said display as being two sided with one side different in appearance than the other side.

4. The method of claim 3 wherein said winning arrangements include a minimum plurality of game elements presenting the same side in a line.

5. A method of operating a gaming machine, comprising the steps of:

providing a game matrix having a plurality of locations;

providing a plurality of game elements used in play of the game, said game elements consisting of a first set of indicia and a second set of indicia, where said first and second sets of indicia match game elements together and are differentiable from each other;

providing a methodology establishing a plurality of predetermined winning arrangements of game elements of a set of indicia when said game elements are associated in said matrix;

placing a wager based in part upon a player selecting a desired number of potentially winning spatial arrangements of said game elements;

randomly selecting game elements and associating a respective game element with a respective location for at least some of said locations in a played presentation;

providing a paytable having a structure of payouts wherein said payouts increase in value in a non-linear fashion as the aggregate number of winning arrangements approaches a maximum number of winning arrangements;

determining an outcome for the game based upon comparison of the aggregate number of winning arrangements achieved in said played presentation against its corresponding value in said paytable; and providing a payout based upon said outcome.

6. The method of claim 5 wherein said predetermined arrangements of game elements are discrete spatial arrangements.

7. The method of claim 6 wherein said matrix is comprised of rows and columns which establish said locations, and said discrete spatial arrangements are selected from a group of arrangements comprising a plurality of indicia of a set of indicia appearing in: a column; a row; a diagonal line.

8. The method of claim 6 wherein said matrix is comprised of rows and columns which establish said locations, and said discrete spatial arrangements are preset geometric organizations of indicia of a set of indicia.

9. The method of claim 7 wherein said game elements are two-sided with one side representing said first set of indicia and said other side being different in appearance from said one side and representing said second set of indicia.

10. The method of claim 8 wherein said game elements are two-sided with one side representing said first set of indicia and said other side being different in appearance from said one side and representing said second set of indicia.

11. The method of claim 7 wherein all of said locations have a game element associated therewith in said played presentation.

12. The method of claim 9 wherein all of said locations have a game element associated therewith in said played presentation.

13. The method of claim 6 wherein said matrix is comprised of rows and columns which establish said locations, and said discrete spatial arrangements are selected from a group of arrangements comprising indicia of a set of indicia appearing in the entirety of: a column; a row; a diagonal line across said matrix.

14. A gaming machine, comprising:

a display for a plurality of game elements, said display defining rows and columns in a matrix of game element locations;

game elements having at least one feature categorizable into a particular set of at least two predetermined sets of features, each of said sets of features having a characteristic matching a set together and differentiating that set from another set;

a wager input mechanism which registers a wager input by a player upon an outcome of the game, said wager requiring selection of at least one possible winning spatial arrangement of said game elements of a plurality of winning arrangements, said wager further including registration of an amount bet; and an operating system including a methodology for playing the game wherein said winning arrangements are chosen from a group including matches of game elements of a particular set in a predetermined spatial organization in said matrix, and further including a mechanism randomly selecting game elements and associating each selected game element with a respective location for a play of the game, with determination of an outcome of said play of the game based upon the aggregate number of winning arrangements actually achieved, if any, along with a payout based upon the aggregate number of winning arrangements achieved and the amount bet.

15. The gaming machine of claim 14 wherein said gaming machine further includes a look-up paytable having a payout that increases in a non-linear fashion as the number of winning arrangements achieved in said outcome approaches a maximum number of arrangements.

16. The gaming machine of claim 15 wherein said game elements are depicted in said display as being two sided with one side different in appearance than the other side.

17. The gaming machine of claim 14 wherein said winning arrangements include a minimum plurality of game elements presenting the same feature in a line.

18. The gaming machine of claim 15 wherein said gaming machine is a video gaming machine, said display is a video monitor, said operating system includes a CPU with a program having said methodology as part of said program, said program further driving said display according to said program, said mechanism randomly selecting game elements and associating each selected game element with a respective location comprising a random number generating routine.

19. A gaming machine, comprising:

a display;

a game matrix defined for said game having a plurality of locations;

a plurality of game elements used in play of the game, said game elements comprising a first set of indicia and a second set of indicia, where said first and second sets of indicia match game elements together and are differentiable from each other;

a wager input mechanism which registers a wager based in part upon a player selecting a desired number of potentially winning spatial arrangements of said game elements;

an operating system including methodology establishing a plurality of predetermined winning arrangements of game elements of a set of indicia when said game elements are associated in said matrix; a mechanism randomly selecting game elements and associating a respective game element with a respective location for at least some of said locations in a played presentation;

a paytable having a structure of payouts wherein said payouts increase in value in a non-linear fashion as the aggregate number of winning arrangements approaches a maximum number of winning arrangements; and determining an outcome for the game based upon comparison of the aggregate number of winning arrangements achieved in said played presentation against its corresponding value in said paytable, and providing a payout based upon said outcome.

20. The gaming machine of claim 19 wherein said predetermined arrangements of game elements are discrete spatial arrangements in said matrix.

21. The gaming machine of claim 20 wherein said matrix is comprised of rows and columns which establish said locations, and said discrete spatial arrangements are selected from a group of arrangements comprising a plurality of indicia of a set of indicia appearing in: a column; a row; a diagonal line.

22. The gaming machine of claim 20 wherein said matrix is comprised of rows and columns which establish said locations, and said discrete spatial arrangements are preset geometric organizations of indicia of a set of indicia.

23. The gaming machine of claim 21 wherein said game elements are two-sided with one side representing said first set of indicia and said other side being different in appearance from said one side and representing said second set of indicia.

24. The gaming machine of claim 22 wherein said game elements are two-sided with one side representing said first set of indicia and said other side being different in appearance from said one side and representing said second set of indicia.

25. The gaming machine of claim 20 wherein all of said locations have a game element associated therewith in said played presentation.

26. The gaming machine of claim 23 wherein all of said locations have a game element associated therewith in said played presentation.

27. The gaming machine of claim 20 wherein said matrix is comprised of rows and columns which establish said locations, and said discrete spatial arrangements are selected from a group of arrangements comprising indicia of a set of indicia appearing in the entirety of: a column; a row; a diagonal line across said matrix.

28. The gaming machine of claim 19 wherein said gaming machine is a video gaming machine, said display is a video monitor, said operating system includes a CPU with a program having said methodology as part of said program, said program further driving said display according to said program, said mechanism randomly selecting game elements and associating each selected game element with a respective location comprising a random number generating routine.

29. A video gaming machine, comprising:

a video monitor;

a game matrix defined for a display on said monitor, said game matrix having a plurality of locations;

a CPU, said CPU having a computer program for operating said game, operating said machine and driving said monitor, said program generating a plurality of game elements used in play of the game, said game elements comprising a first set of indicia and a second set of indicia, where said first and second sets of indicia match game elements together and are differentiable from each other;

a wager input mechanism which registers a wager based in part upon a player selecting a desired number of potentially winning spatial arrangements of said game elements; and said computer program further including methodology establishing a plurality of predetermined winning arrangements of game elements of a set of indicia when said game elements are associated in said matrix; a mechanism randomly selecting game elements from said sets of indicia for association of a respective game element with a respective location in a played presentation; a paytable having a structure of payouts wherein said payouts increase in value in a non-linear fashion as the aggregate number of winning arrangements approaches a maximum number of winning arrangements; with said computer program determining an outcome for the game based upon comparison of the aggregate number of winning arrangements achieved in said played presentation against its corresponding value in said paytable, and providing a payout based upon said outcome.

30. The gaming machine of claim 29 wherein said predetermined winning arrangements of game elements are discrete spatial arrangements in said matrix.

31. The gaming machine of claim 30 wherein said matrix is comprised of rows and columns which establish said locations, and said discrete spatial arrangements are selected from a group of arrangements comprising a plurality of indicia of a set of indicia appearing in: a column; a row; a diagonal line.

32. The gaming machine of claim 30 wherein said matrix is comprised of rows and columns which establish said locations, and said discrete spatial arrangements are preset geometric organizations of indicia of a set of indicia.

33. The gaming machine of claim 31 wherein said game elements are displayed as being two-sided with one side representing said first set of indicia and said other side being different in appearance from said one side and representing said second set of indicia.

34. The gaming machine of claim 32 wherein said game elements are displayed as being two-sided with one side representing said first set of indicia and said other side being different in appearance from said one side and representing said second set of indicia.

35. The gaming machine of claim 33 wherein all of said locations have a game element associated therewith in said played presentation.

36. The gaming machine of claim 34 wherein all of said locations have a game element associated therewith in said played presentation.

37. The gaming machine of claim 30 wherein said matrix is comprised of rows and columns which establish said locations, and said discrete spatial arrangements are selected from a group of arrangements comprising indicia of a set of indicia appearing in the entirety of: a column; a row; a diagonal line across said matrix.

38. An improved gaming machine, wherein the game includes a plurality of different predetermined winning spatial arrangements of game elements upon which a wager can be placed for a payout, wherein the improvement comprises:

a paytable for the gaming machine wherein at least some portion of a payout relative to a game outcome increases in a non-linear fashion as the aggregate number of winning spatial arrangements approaches a maximum number of winning arrangements.

39. An improved gaming machine, wherein the game includes a plurality of different predetermined winning spatial arrangements of game elements upon which a wager can be placed for a payout, wherein the improvement comprises:

a paytable for the gaming machine wherein at least some portion of a payout relative to a game outcome is based solely upon the aggregate number of winning spatial arrangements without consideration of any qualitative aspect of an arrangement.

40. The improved gaming machine of claim 39 wherein said paytable payouts increase in a non-linear fashion.

* * * * *